US005594800A

United States Patent [19]

Gerzon

[11] Patent Number: 5,594,800

[45] Date of Patent: Jan. 14, 1997

[54] SOUND REPRODUCTION SYSTEM HAVING A MATRIX CONVERTER

[75] Inventor: Michael A. Gerzon, Oxford, United Kingdom

[73] Assignee: Trifield Productions Limited, London, United Kingdom

[21] Appl. No.: 589,994

[22] Filed: Jan. 23, 1996

Related U.S. Application Data

[63] Continuation of Ser. No. 513,166, Aug. 9, 1995, abandoned, which is a continuation of Ser. No. 104,097, filed as PCT/GB92/00267, Feb. 14, 1992 published as WO92/15180, Sep. 3, 1992, abandoned.

[30] Foreign Application Priority Data

Feb. 15, 1991 [GB] United Kingdom ..... 9103207.8

[51] Int. Cl.[6] ..... H04R 5/00

[52] U.S. Cl. ..... 381/20; 381/18

[58] Field of Search ..... 381/17–18, 20, 381/24

[56] References Cited

U.S. PATENT DOCUMENTS

| | | | |
|---|---|---|---|
| 3,697,692 | 10/1972 | Hafler | 381/18 |
| 3,757,047 | 9/1973 | Ito et al. | 381/18 |
| 3,772,479 | 11/1973 | Hilbert | 381/18 |
| 4,097,688 | 6/1978 | Ochi | 381/18 |
| 4,204,092 | 5/1980 | Bruney | 381/18 |
| 4,807,217 | 2/1989 | Ide | 381/20 |
| 4,873,722 | 10/1989 | Torihari | 381/17 |
| 5,043,970 | 8/1991 | Holman | 381/20 |
| 5,119,422 | 6/1992 | Price | 381/24 |

FOREIGN PATENT DOCUMENTS

| | | | |
|---|---|---|---|
| 0404117 | 12/1990 | European Pat. Off. | 381/18 |
| 1459188 | 12/1976 | United Kingdom | 381/18 |
| 1528138 | 10/1978 | United Kingdom . | |
| WO81/02502 | 9/1981 | WIPO . | |

OTHER PUBLICATIONS

International Search Report Dated 6 May 1992 Corresponding to International Patent Application PCT/GB92/00267 International Preliminary Examination Report.

*Primary Examiner*—Stephen Brinich
*Attorney, Agent, or Firm*—Baker & Daniels

[57] ABSTRACT

Matrix reproduction decoding means derive from input signals intended to feed a stereophonic plurality of loudspeakers output signals intended to feed a second greater plurality of loudspeakers in a stereophonic arrangement covering a sector of directions, substantially so as to preserve total reproduced energy to within an overall gain and equalization, and to preserve to within constants of proportionality the angular dispositions of reproduced acoustical velocity and sound intensity vectors at an ideal listening position. Preferably for two-channel signals matrix means is frequency-dependent giving increased angular width above 5 kHz, and may incorporate width control. Matrix means encoding loudspeaker feed signals into transmission channel signals, and matrix means decoding transmission channel signals into loudspeaker feed signals may be used giving overall matrix means in accordance with the invention. Matrix means may be used to provide improved directional matching of sounds and associated visual images.

44 Claims, 34 Drawing Sheets

— FIG. 6 —

SOUND REPRODUCTION SYSTEM HAVING A MATRIX CONVERTER

This is a continuation of application Ser. No. 08/513,166, filed Aug. 9, 1995, which is a continuation of application Ser. No. 08/104,097, filed as PCT/GB92/00267, Feb. 14, 1992 published as WO92/15180, Sep. 3, 1992 both abandoned.

This invention relates to the reproduction and transmission of sound using more than two loudspeakers.

The reproduction of stereophonic sound using two loudspeakers has long been known to give an imperfect illusion of phantom illusory sound images lying between the locations of the two loudspeakers. For a listener positioned at an ideal stereo seat position in the listening area, the high frequencies of phantom illusory images are displaced further from the point midway between the two loudspeakers than are the low frequencies, resulting in imperfect image sharpness. For listeners away from the ideal stereo seat position, the illusory sound images are all displaced towards the nearer of the two loudspeakers. As a listener at the ideal stereo seat position rotates his/her head, the illusory images also rotate in position to a lesser extent.

These defects degrade the naturalness of the stereophonic illusion, and cause listening fatigue and lessened enjoyment, and also make it difficult for several listeners in a room all to enjoy a good stereophonic illusion. These defects become particularly serious when the stereophonic sound is associated with a visual image, such as is the case with Television, video or film programmes, audiovisual and son et lumière presentations, theatrical performances with stereophonic sound effects, and amplified live musical performances. It is found empirically that angular discrepancies between the apparent directions of visual images and their associated sounds are noticeable if greater than four degrees, and are objectionable if greater than eleven degrees.

It has long been known that these faults can be reduced or ameliorated by the use of three or more loudspeakers distributed across the stereophonic sound stage. These loudspeakers can either be fed with independent transmission channel signals, one for each loudspeaker system, conveying an improved stereophonic illusion, or they can be fed with signals derived from a smaller number of transmission channel signals using a mixing or matrixing process. This invention relates to the use of an improved matrixing process to obtain improved illusory phantom images.

In the prior art, it is known that the results obtained by feeding stereophonic audio transmission signals to a stereophonic arrangement of loudspeakers can sometimes be improved by adding an additional loudspeaker between each adjacent pair of loudspeakers, and feeding that additional loudspeaker with the average of the transmission signals fed to the adjacent pair of loudspeakers, possibly with an additional predetermined gain.

For example, if signals L and R are normally used to feed the respective left and right loudspeakers of a two-loudspeaker stereophonic system, then these can be supplemented by an additional central loudspeaker fed with the signal $\frac{1}{2}k(L+R)$, where k is a predetermined amplitude gain. Various values of the predetermined gain have been suggested in the prior art literature, often between k=0.7 and k=2, but no ideal value exists that improves all aspects of the stereophonic illusion. In general, it is found that the larger the value of k, the better is the stability of central illusory phantom images as a listener changes position in the listening area, but the narrower is the apparent total width of the reproduced illusory stereophonic stage.

This above prior art proposal, sometimes known as the "bridged centre loudspeaker" method, not only gives an imperfect improvement of the illusory stereophonic effect, but gives a degree of improvement that varies considerably according to the nature of the recording or mixing technique used to produce the original stereophonic signals L and R. It will be appreciated that many different methods have been proposed and used to produce transmission signals suitable for stereophonic reproduction via two or more loudspeakers, for example, signals derived from widely spaced microphones, signals derived from a plurality of spacially coincident directional microphones pointing in different directions, signals derived by electrically simulating stereophonic positioning of multiple monophonic source signals, and various hybrids of these above techniques.

It is desirable that any method of reproducing such signals over a greater number of loudspeakers should work well for all such different recording techniques. It is found empirically that the bridged centre loudspeaker method of reproduction varies considerably in its results depending on the recording technique used to produce the original stereophonic signals, and that the best value of the predetermined gain k is very dependent upon which recording technique has been used.

Another specific defect of the bridged centre loudspeaker method is that it does not preserve the original recorded level-balance between different sounds in the original stereophonic signals. The total reproduced energy at a moment fed into the listening room is proportional to the sum of the squares of the outputs of the loudspeakers in the room, and the total energy $L^2+R^2$ of the two-speaker stereophonic signal described in the above example does not equal, and is not proportional to, the total reproduced energy $$L^2+R^2+[\tfrac{1}{2}k(L+R)]^2$$

emitted by the three loudspeakers of the bridged centre loudspeaker method.

Another prior art proposal matrixes signals L and R originally intended for reproduction via a respective left and right loudspeaker of a two-speaker stereophonic system so as to feed the respective left, centre and right loudspeakers of a three loudspeaker system by feeding the centre loudspeaker with a signal $\frac{1}{2}k_1(L+R)$ that is proportional to the average of the two original signals, and the left and right loudspeakers with respective signals $\frac{1}{2}k_2(L-R)$ and $\frac{1}{2}k_2(R-L)$ proportional to the difference between the original left and right signals and its polarity inverse. This proposal, which has been termed the Hughes SRS method, gives very stable reproduction of monophonic central images, which are only emitted by the centre loudspeaker, and also gives a reasonable impression of left/right directionality for a listener positioned at an ideal stereo seat position by means of the process known as acoustic matrixing, whereby the sounds travelling from different loudspeakers to the two ears reinforce and cancel each other in such a manner as to recreate interaural phase relationships characteristic of left/right positioning.

However, the Hughes SRS method has the defect that all sounds are reproduced with equal energy from both the left and the right loudspeakers, so that any illusion of directionality is created purely by phase relationships between the loudspeaker outputs. Under these conditions, acoustic matrixing creates an impression of left/right directionality only over a narrow listening area, and even at an ideal stereo seat position gives an illusion that gives poor reproduced width at higher frequencies, especially those above about 2 kHz.

Numerous other methods have been proposed in the prior art for feeding a first plurality $n_1$ of loudspeaker feed signals to a second greater plurality $n_2$ of loudspeakers using an $n_2 \times n_1$ linear matrix circuit or means having $n_1$ inputs and $n_2$ outputs. Much of this prior art has been applied to so-called quadraphonic or surround-sound systems intended for the reproduction of directionality over a 360° range of angular directions around a listener, but some of this prior art has also been applied to systems of the stereophonic kind intended to reproduce a directional effect over a frontal sector of directions usually subtending an angle of less than 180° at a listening position.

All prior art systems of reproducing stereophonic signals intended for a first plurality of loudspeakers via a second larger plurality of stereophonic loudspeakers have given an imperfect illusion of directionality. Although the ears and brain produce a directional illusion from stimuli in a manner that is not wholly understood, many aspects of the perception of directional effect can be described reasonably well in terms of four physical quantities at the position of the head of a listener.

These four quantities are the acoustical pressure, which is a scalar quantity, the acoustic velocity, which is a vector quantity with direction, the acoustic energy, which is a scalar quantity, and the sound intensity, which is a vector quantity describing the direction and magnitude of energy flow of the sound field.

The ratio of acoustic velocity to acoustic pressure provides a vector quantity that can be used, over any limited frequency band below a frequency of about 700 Hz, to predict the localisation of sounds according to theories of sound localisation based on interaural phase cues. The ratio of sound intensity to acoustical energy can similarly be used to predict the localisation of sounds at higher frequencies, typically between 700 Hz and 5 kHz, but can also be used to predict localisation at lower frequencies when the sounds arriving from different loudspeakers are largely uncorrelated in phase, as is the case when loudspeakers are at different distances from the listener with path length differences of a number of wavelengths.

Sound localisation theories based on the ratio of acoustic velocity to acoustic pressure are termed velocity vector localisation theories, whereas those based on the ratio of sound intensity to acoustic energy are termed energy vector theories. To a first approximation, at lower frequencies below around 700 Hz for listeners equidistant from all loudspeakers, sound is localised in the direction of the acoustic velocity vector, and at higher frequencies and for highly non-equidistant loudspeaker locations of the listener, sound is localised in the direction of the sound intensity vector. It will be understood that the frequency of 700 Hz is a broad indication, and that in practice it is found that there is a broad frequency range across which both theories of sound localisation have some applicability.

It is a defect of many existing methods of stereophonic reproduction, including conventional two-loudspeaker stereophony, that many illusory directions give rise to vector directions of acoustical velocity and of sound intensity that differ markedly from one another even at an ideal stereo seat position. The differences of direction of the vectors of acoustical velocity and of sound intensity are often considerably less for stereophonic signals originated for reproduction via three or more loudspeakers.

All prior art methods of reproduction of a first plurality of signals intended for stereophonic reproduction via a first stereophonic arrangement of loudspeakers via a second larger plurality of loudspeakers suffer from one or more defects, which include an alteration of the recorded level-balance between sounds in a stereophonic recording, angular differences between the vector directions of acoustical velocity and of sound intensity, and an inadequate width of reproduction of the stereophonic sound stage.

In the prior art, matrix methods are not only used to feed a first plurality of loudspeaker feed signals into a second larger plurality of loudspeakers, but are also used to provide third pluralities of transmission channel signals, intended for use in storage, transmission or recording of the stereophonic effect, and for providing from such third pluralities of transmission channel signals loudspeaker feed signals intended for reproduction via a second plurality of loudspeakers. The process of deriving the third plurality of transmission signals from the first plurality of loudspeaker feed signals is generally termed encoding, and the process of deriving the second plurality of loudspeaker feed signals from the third plurality of transmission channel signals is generally termed decoding.

Such systems of matrix encoding and decoding have been widely used in connection with prior art quadraphonic, surround-sound and ambisonic systems. Some such systems are hierarchical in the sense that they allow for a number of different possible values for the first plurality, a number of different values for the second plurality, and a number of different values for the third plurality, while ensuring the following desirable properties:

(i) when the first and second pluralities are equal and the third plurality is not less than the first plurality, the second loudpeaker feed signals are identical (apart from a possible overall gain change) to the first loudspeaker feed signals.

(ii) the second loudspeaker feed signals remain unchanged for any given choice of the first and second pluralities for any choice of third plurality that is not less than the smaller of the first and second plurality.

(iii) If a first plurality of loudspeaker feed signals is encoded into a third plurality of transmission channels and then decoded into a second plurality of loudspeaker feed signals, and then encoded into a fourth plurality of transmission channels and then decoded into a fifth plurality of loudspeaker feed signals, then the results are the same as for encoding the first plurality of loudspeaker feed signals into a sixth plurality (equal to the least of the second, third and fourth pluralities) of transmission channels and then decoding into the fifth plurality of loudspeaker feed signals.

(iv) the results of encoding a first plurality of loudspeaker feed signals into a not smaller third plurality of transmission channels and then decoding into a second plurality greater than the first plurality of loudspeaker feed signals is to provide a reproduction via the second loudspeaker arrangement substantially retaining or improving the subjective directional effect intended originally via the first plurality of loudspeakers.

This kind of hierarchical system of encoding and decoding is operationally desirable in that the procedure for handling a plurality of loudspeaker feed signals does not depend on whether it was originated originally for another number of loudspeakers, nor on whether it has been passed through intermediate stages of encoding and decoding. It will be appreciated that there are various proposals for stereophonic sound using different numbers of loudspeaker feed signals, including possible pluralities two, three, four or five for covering a frontal stereophonic sector of directions.

In different applications of stereophony, different pluralities of loudspeaker feed signals may be operationally convenient or customary. For example, most sound broadcasting and recordings made for record or Compact Disc release have been prepared in a two-speaker format, although some recordings in the 1950's were prepared in a three-speaker format. Many recordings made for standard Television use similarly use the two-speaker format, but many cinema soundtracks have been recorded in three or five-speaker formats for the front-stage stereophonic sound. With high definition Television (HDTV), it has been proposed to use either three or four loudspeakers for the frontal stereophonic stage, and it is possible that a different choice of plurality may be made for use with different systems of HDTV or by different broadcasters using the same system of HDTV.

A hierarchical system of encoding and decoding stereophony would greatly ease the task of converting signals intended for one plurality of stereophonic loudspeakers for reproduction via another, and would allow each recording or broadcasting organisation to make their own choice of plurality while being able to make use of stereophonic material made by other organisations using a different plurality. Similarly, the final listener will also have the choice of which plurality of loudspeakers he or she uses.

The UMX system of surround-sound reproduction is a known prior-art hierarchical system, but is not optimised for frontal-stage stereophony. The problem of designing an effective hierarchical system of stereophony has not hitherto been solved. This is because in the case of surround sound, one can make use of the rotational symmetry of the desired sound stage, whereas stereophony has a much lesser degree of mathematical symmetry, which makes the problem of finding hierarchical systems much harder to solve, especially if one takes the subjective quality of directional results into account, i.e. the requirement (iv) listed above in the requirements of a hierarchical system.

Most stereophonic loudspeaker arrangements do have at least an approximate left/right symmetry, i.e. for each speaker placed to the left of a forward direction, there is a second loudspeaker placed in a symmetrically disposed position to the right of the forward direction, and vice-versa. While in practice there are often departures from exact left/right symmetry, it is customary to design loudspeaker feed signals on the assumption of an exact such symmetry in the loudspeaker layout. It is found that with normal small departures from symmetry, the subjective results remain reasonably satisfactory. It will be understood that references to "front", "forward", "left" and "right" directions in this document are purely a matter of convenience, and that the "front" or "forward" direction may in fact be any chosen convenient direction in space, and the "left" and "right" directions may be any chosen opposite directions orthogonal to that direction designated as "front" or"forward".

One aspect of this invention provides matrix means for converting a first plurality of signals intended to feed a first plurality of loudspeakers in a stereophonic arrangement into a second greater plurality of loudspeaker feed signals suitable for feeding a second plurality of loudspeakers in a second stereophonic arrangement, in a manner that substantially preserves the width of the reproduced illusory sound stage and that substantially preserves or improves the sound localisation qualities of illusory phantom sound images for listeners across a broad listening area.

Another aspect provides matrix means for converting a first plurality of signals intended to feed a first plurality of loudspeakers in a stereophonic arrangement into a second greater plurality of loudspeaker feed signals suitable for feeding a second plurality of loudspeakers in a second stereophonic arrangement in a manner that substantially preserves or improves the sound localisation qualities and level-balance of different sounds within the original signals.

Another aspect provides matrix systems of transmission, storage, recording and reproduction of multispeaker stereophonic sound for encoding first pluralities $n_1$ of signals intended for reproduction via said first pluralities of stereophonic loudspeakers into third pluralities m of transmission, storage or recording channels, and for decoding said third pluralities m of channel signals to provide second pluralities $n_2$ of signals suitable for reproduction via said second pluralities of loudspeakers in a stereophonic arrangement, in a manner ensuring that when said third plurality is not less than said first plurality and said second plurality exceeds said first plurality, the resulting system achieves the above-stated first or second object of the invention.

Another aspect provides a hierarchical system, in the above-stated sense, for transmitting, recording, or storing of first pluralities of signals intended for stereophonic reproduction via said first pluralities of loudspeakers via third pluralities of transmission, storage or recording channels, and for decoding second pluralities of signals intended for reproduction via second pluralities of loudspeakers in a stereophonic arrangement covering a sector of reproduced directions.

Another aspect provides means for reproducing stereophonic signals intended for reproduction via two loudspeakers via three or more loudspeakers so as to achieve an improved stability of illusory phantom images near the centre of the stereophonic sound stage as the listener moves around a listening area, while retaining a wide reproduced stage width for listeners across the listening area.

Another aspect provides means for reproducing stereophonic sounds associated with a visual image in a manner ensuring improved matching of the apparent visual image and audible phantom illusory sound image directions for listeners and viewers placed across a listening area.

Another aspect provides a high quality of directional images for source directions additional to those at or halfway between originally-intended loudspeaker directions both for listeners at an ideal stereo seat position and for listeners away from said position across a broad listening area.

According to one aspect of the invention there is provided a matrix converter $R_{n2,n1}$ for converting a first audio signal stereophonically encoded for reproduction over $n_1$ speakers into a second audio signal stereophonically encoded for reproduction over $n_2$ loudspeakers, when $n_1$, $n_2$ are integers>1 and $n_2>n_1$, characterised in that the matrix converter R is an energy preserving matrix arranged substantially to preserve to within an overall constant of proportionality, which may be frequency dependent, the total reproduced energy and the directional effect of the encoded audio signal.

The matrix converter may, for example form part of a transmission encoder, or a reproduction decoder as later described. It may be implemented by software in an appropriate digital signal processor of the type well known in the art, or by a hard-wired network in the analogue domain.

According to the invent-ion in a first aspect, a matrix reproduction decoding means is provided responsive to a first plurality of signals representing loudspeaker feed signals intended for reproduction via a said first plurality of loudspeakers disposed in a first stereophonic arrangement across a first sector of directions and providing a second greater plurality of output signals representing loudspeaker feed signals intended for reproduction via a said second plurality of loudspeakers disposed in a second stereophonic arrangement across a second sector of directions, said matrix means being such as to substantially preserve, to within an overall constant of proportionality which may be dependent on frequency, the total reproduced energy intended via said first stereophonic arrangement via said second stereophonic arrangement, said matrix means being further such as to substantially preserve or improve the illusory stereophonic effect intended via said first stereophonic arrangement via said second stereophonic arrangement.

According to the invention in a second aspect, a matrix reproduction decoding means is provided responsive to a first plurality of signals representing loudspeaker feed signals intended for reproduction via a said first plurality of loudspeakers disposed in a first stereophonic arrangement across a first sector of directions and providing a second greater plurality of output signals representing loudspeaker feed signals intended for reproduction via a said second plurality of loudspeakers disposed in a second stereophonic arrangement across a second sector of directions, said matrix means being such as to substantially preserve, to within an overall constant of proportionality which may be dependent on frequency, the total reproduced energy intended via said first stereophonic arrangement via said second stereophonic arrangement, said matrix means being further such as to substantially preserve, to within a second constant of proportionality that may be dependent on frequency the angular disposition, measured as the angle of the direction from a predetermined notional forward direction at a predetermined preferred listening position, of velocity vectors intended via said first stereophonic arrangement when reproduced via said matrix means via said second stereophonic arrangement, and said matrix means being further such as to substantially preserve, to within a third constant of proportionality that may be dependent on frequency, the angular disposition of sound intensity vectors intended via said first stereophonic arrangement when reproduced via said matrix means via said second stereophonic arrangement.

In a preferred implementation of the invention when said first plurality equals two, said third constant of proportionality is dependent on frequency.

In a preferred implementation of the invention when said first and second stereophonic arrangements are substantially left/right symmetric, said matrix reproduction decoding means is preferably also left/right, symmetrical, in the sense that if all left inputs and outputs were to be exchanged with their right counterparts, the results given by the matrix reproduction decoding means would remain substantially unchanged.

In another preferred implementation of the invention, the angular dispositions of the reproduced velocity vectors at frequencies across several octaves of the audio frequency range is arranged to be substantially identical to the angular dispositions of the sound intensity vectors when said matrix means provides signals to be reproduced via said second stereophonic arrangement.

In a preferred implementation of the invention, said third constant of proportionality is arranged to be greater within an audio frequency band above 5 kHz than within the audio band at frequencies between 700 Hz and 3 kHz. Said increased third constant of proportionality above 5 kHz is especially desirable when said first plurality equals two.

In another preferred implementation of the invention when said first plurality equals two, there is provided means for modifying the reproduced width having the effect of altering the gain of that signal component representing the difference of said first loudspeaker feed signals intended for said first stereophonic arrangement.

In preferred implementations of the invention, the ratio of said second constant of proportionality to said third constant of proportionality should lie within the range from one half to two.

According to another aspect there is provided a conversion matrix for converting a first ambisonically encoded audio signal having components W, X and Y or linear combinations thereof into a second, stereophonically encoded signal for reproduction over $n_2$ loudspeakers, where $n_2$ is an integer$\geqq 3$, the conversion matrix comprising a $n_2 \times 2$ conversion matrix means according to any preceding aspect arranged to receive at one input a first signal $M_{dec}$ formed from the sum of the omnidirectional component W and a first velocity component X and at the other input a signal S formed from the other velocity component Y and means for outputting a further signal component derived from the difference $T_{dec}$ of the said components W and X.

This aspect encompasses both the case where the sum and difference components are explicitly present and also a matrix arranged to carry out equivalent operations on pseudo-left/right signal. Here, as elsewhere in the present application, the matrices referred may be split to form a functionally equivalent series of matrices or maybe coalesced into a single equivalent matrix and it will be understood that all such arrangements fall within the scope of the invention.

According to the invention in a third aspect, there is provided a transmission matrix decoder means responsive to a third plurality greater than two of transmission channel signals producing a second plurality not less than said third plurality of signals representing second loudspeaker feed signals intended for reproduction via a said second plurality of loudspeakers disposed in a second stereophonic arrangement across a second sector of directions, where said transmission channel signals represent first stereophonic loudspeaker feed signals intended to feed a first plurality of loudspeakers disposed in a first stereophonic arangement across a first sector of directions, wherein when said first plurality equals said second plurality, said transmission matrix decoding means is such that said second loudspeaker feed signals are substantially identical, to within an overall gain and equalisation, to said first stereophonic loudspeaker feed signals, and wherein when said first plurality is less than said second plurality and is not greater than said third plurality, said transmission matrix decoder means constitutes a reproduction matrix decoding means for the intended first loudspeaker feed signals according to the invention in its first or second aspects.

In a preferred implementation of the invention in its third aspect, said transmission channel signals are such that for each first plurality not greater than said third plurality, precisely a said first plurality of transmission channel signals may be substantially nonzero, and such that for any first said first plurality less than a second said first plurality. the transmission channel inputs to said transmission matrix decoding means for which said transmission matrix channel signals are substantially nonzero for said first said first plurality is a subset of the transmission channel inputs for which the transmission channel signals are substantially nonzero for said second said first plurality.

According to the invention in a fourth aspect, there is provided a transmission matrix encoder means responsive to a plurality greater than two of signals representing loudspeaker feed signals intended to feed a said plurality of loudspeakers disposed in a stereophonic arrangement across a sector of directions producing a said plurality of transmission channel signals suitable for use with a signal transmission, recording or storage means, whereby the inverse of said transmission matrix encoder means constitutes a transmission matrix decoder means according to the invention in its third aspect.

In a preferred form of the invention in its fourth aspect, the inverse transmission matrix decoder means according to the invention in its third aspect is in accordance with the preferred implementation of the invention in its third aspect, and the additional transmission matrix encoder means required to produce a smaller said first plurality greater than two of transmission channel signals that are substantially nonzero representing loudspeaker feed signals intended for reproduction via a said smaller said first plurality of loudspeakers is also a transmission matrix encoder means according to the invention in its fourth aspect.

This preferred form of the invention in its fourth aspect ensures that the different third pluralities of transmission channel signals provided in response to the different first pluralities of loudspeaker feed signals by encoding means, and the associated second pluralities of decoded loudspeaker feed signals derived from the different third pluralities of transmission channel signals derived by the inverse decoders constitutes a hierarchical system of encoding and decoding in the earlier-defined sense.

According to the invention in a fifth aspect, there is provided a matrix system for encoding a first plurality of signals representing loudspeaker feed signals intended for reproduction via a said first plurality of loudspeakers disposed in a first stereophonic arrangement across a first sector of directions into a third plurality of transmission channel signals and for decoding said third plurality of transmission channel signals into a second plurality of output signals representing loudspeaker feed signals intended for reproduction via a said second plurality of loudspeakers disposed in a second stereophonic arrangement across a second sector of directions, such that said transmission matrix encoding means used in conjunction with said transmission matrix decoding means constitutes a reproduction matrix decoding means in accordance with the invention in its first or second aspects.

According to the invention in a sixth aspect, there is provided a transmission matrix decoding means responsive to a third plurality of transmission channel signals and providing a second plurality of output signals representing loudspeaker feed signals intended for reproduction via a said second plurality of loudspeakers.disposed in a second stereophonic arrangement across a second sector of directions intended for use with transmission channel signals provided via a transmission matrix encoding means, such that the resulting system constitutes a matrix encoding and decoding system in accordance with the invention in its fifth aspect.

According to the invention in a seventh aspect, there is provided a transmission matrix encoding means responsive to one or more first pluralities of signals representing loudspeaker feed signals intended for reproduction via a said first plurality of loudspeakers disposed in a first stereophonic arrangement across a first sector of directions and providing a third plurality greater than two and not less than said said first plurality of transmission channel signals intended for use with a transmission matrix decoding means such that the resulting system constitutes a matrix encoding and decoding system in accordance with the invention in its fifth aspect.

According to the invention in an eighth aspect, there is provided matrix decoding means according to the invention in its first, second, third or sixth aspects intended for use with loudspeakers (or loudspeaker systems) some of which have a more limited bass reproduction capability than the other loudspeakers, whereby said matrix decoding means is modified at low frequencies so as to provide less bass to said loudspeakers or loudspeaker systems which have a more limited bass reproduction capability than to said other loudspeakers.

According to the invention in a ninth aspect, there is provided a matrix decoding means according to the invention in its first, second, third, sixth or eighth aspects, also incorporating or used in association with delay compensation means for output signals intended for feeding to reproduction loudspeakers not all disposed at identical distances from a preferred listening position, whereby said delay compensation means ensures that signals from all loudspeakers arrive at said listening position at a substantially identical time.

In a preferred implementation of the invention in its ninth aspect, the intended stereophonic arrangement of the reproduction loudspeakers is substantially left/right symmetric and said preferred listening position is disposed on the axis of left/right symmetry.

According to the invention in a tenth aspect, there is provided transmission encoding means for encoding a first plurality of signals representing loudspeaker feed signals intended for reproduction via a said first plurality of loudspeakers disposed in a stereophonic arrangement across a sector of directions into a larger third plurality of transmission channel signals, said encoding means providing results equivalent to a reproduction matrix decoding means according to the invention in its first, second, third, or sixth aspects responsive to said first plurality of signals providing a fourth plurality, not greater than said third plurality and larger than said first plurality, of signals representing loudspeaker feed signals intended for reproduction via a said fourth plurality of loudspeakers disposed in a stereophonic arrangement across a fourth sector of directions, followed by an encoding means according to the invention in its fourth or seventh aspects responsive to said fourth plurality of signals and providing said third plurality of transmission channel signals.

According to the invention in an eleventh aspect, there is provided reproduction matrix decoder means responsive to a first plurality of signals proportional to signals intended for reproduction via a said first plurality of loudspeakers disposed in a first left/right symmetric stereophonic arrangement across a first sector of directions and providing a second greater plurality of signals proportional to signals intended for reproduction via a said second plurality of loudspeakers disposed in a second left/right symmetric stereophonic arrangement across a second sector of directions, said matrix decoder means comprising an input sum and difference matrix means for each pair of signals intended for a left/right symmetrically disposed pair of loudspeakers in said first arrangement, a first linear or matrix means responsive to all said sum signals and to any of said first plurality of signals proportional to a central loudspeaker feed signal for said first arrangement providing a first number not less than the number of signals into said first linear or matrix means of first output signals, a second linear or matrix means responsive to all said difference signals providing a second number not less than the number of said difference signals of output difference signals, said first number and said second number adding up to said second plurality, and output sum and difference matrix means, one associated with each left/right symmetric pair of loudspeakers in said second arrangement, each responsive to one of said first output signals and one of said output difference signals and providing signals from said second plurality of signals intended for said associated pair of loudspeakers in said second arrangement, whereby any of said second plurality of signals proportional to a central loudspeaker feed signal for said second arrangement is derived from one output of said first linear or matrix means.

Other aspects, embodiments, objects and advantages of the invention will be apparent from the description.

Embodiments of the invention will now be described by way Of example with reference to the accompanying drawings in which:

FIGS. 1*a* to 1*g* illustrate examples of loudspeaker arrangements which may be used with the invention.

FIG. 3 shows a transmission decoder comprising the series connection of another transmission decoder with a reproduction decoder.

Figure 34A:
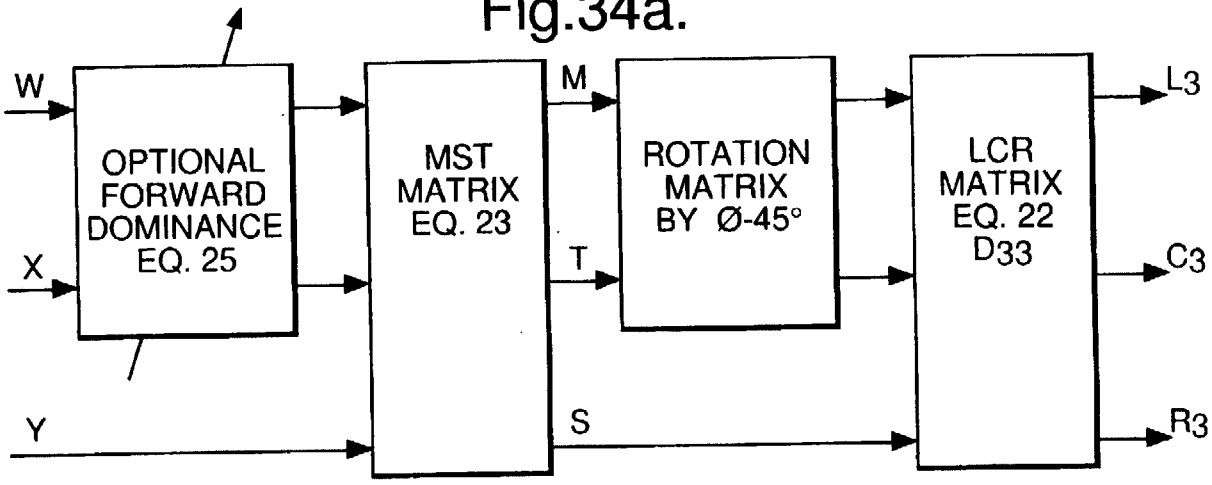
Figure 34B:
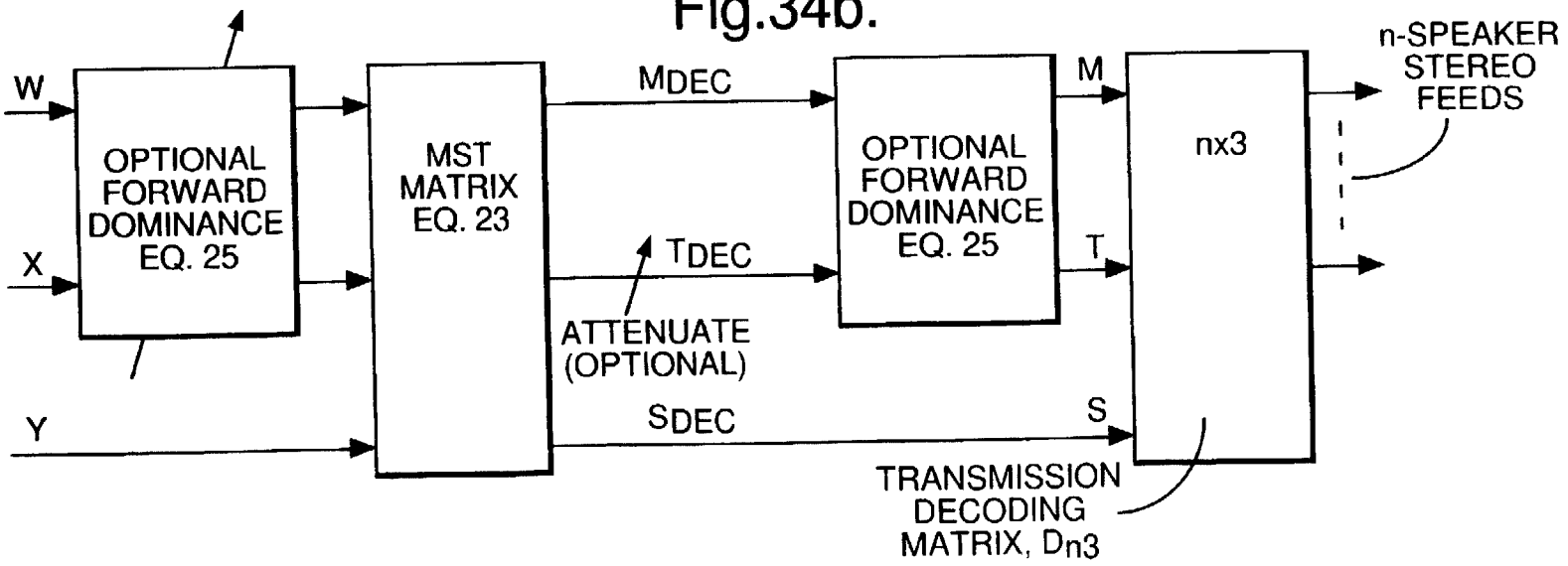
Figure 34C:
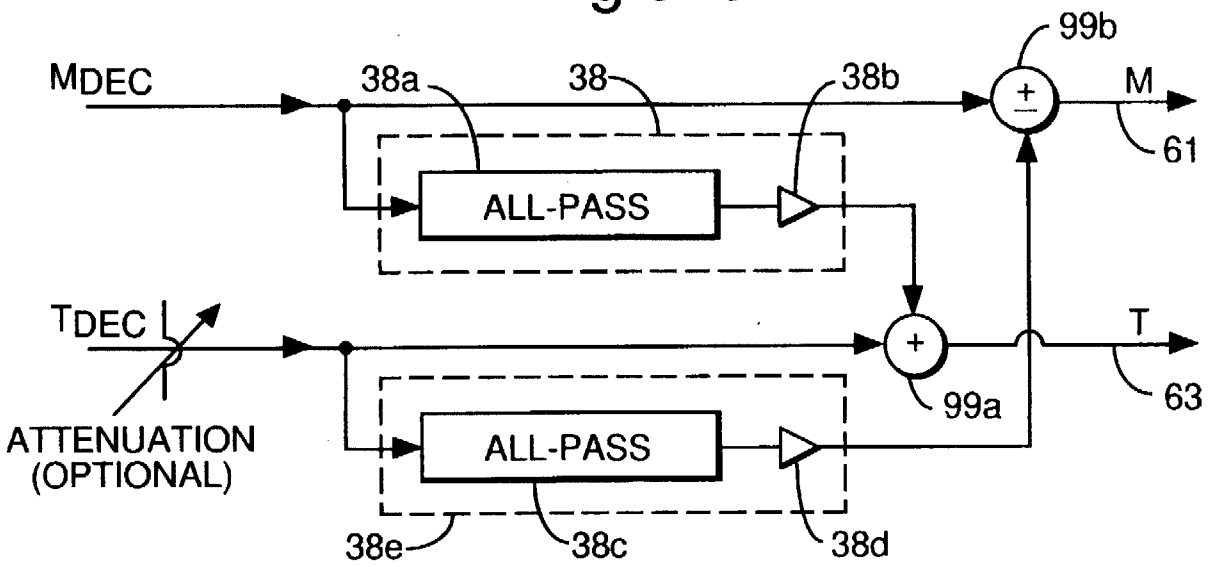

FIG. 34*a* is a 3-speaker decoder for B-format signals;

FIG. 34*b* is a n-speaker decoder for B-format signals;

FIG. 34*c* is a rotation matrix for use in the decoder of FIGS. 34*a* and 34*b;*

Figure 35:
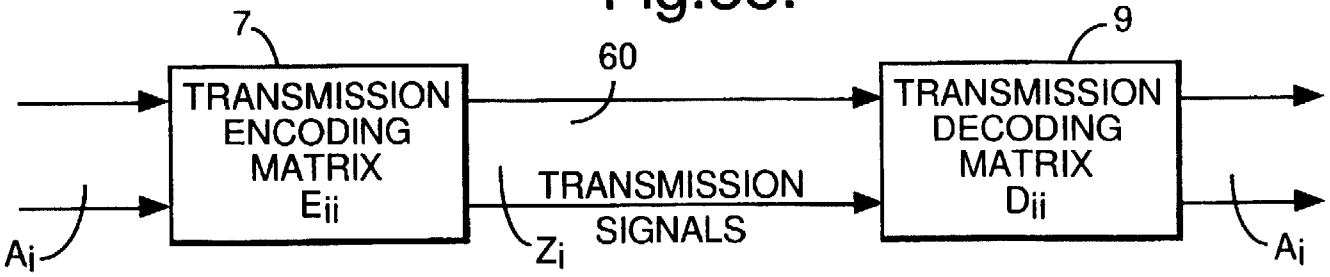
Figure 36:
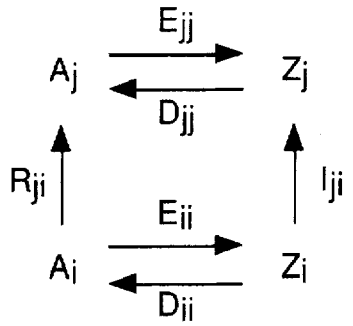
Figure 37:
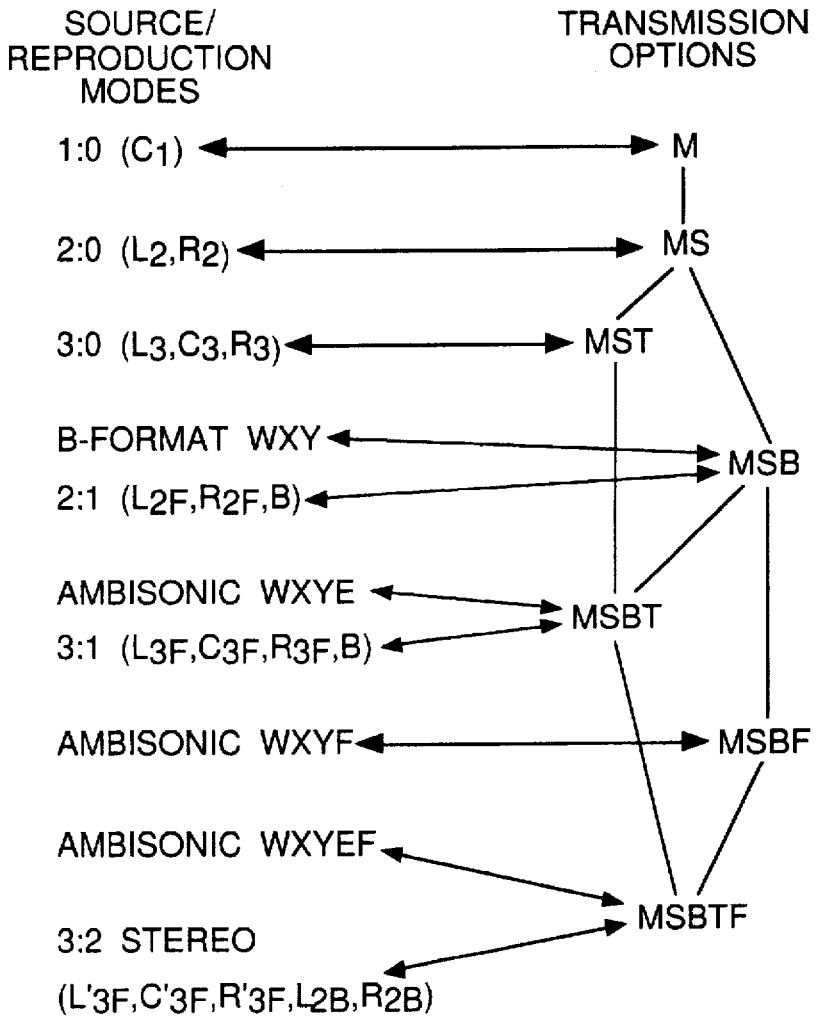

FIG. 35 shows the encoding to and decoding from transmission signals of a directional sound encoding system;

FIG. 36 shows the relationship between conversion matrices and transmission encoding matrices;

FIG. 37 shows the structure of a cascadable hierarchy for stereo and surround sound.

STEREOPHONIC LOUDSPEAKER ARRANGEMENTS

Figure 1A:
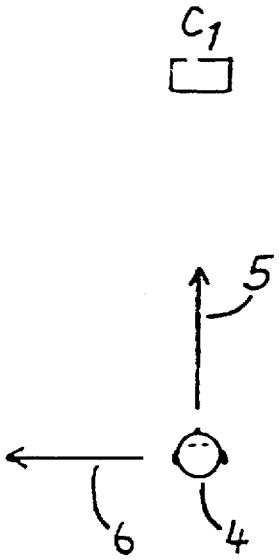
Figure 1B:
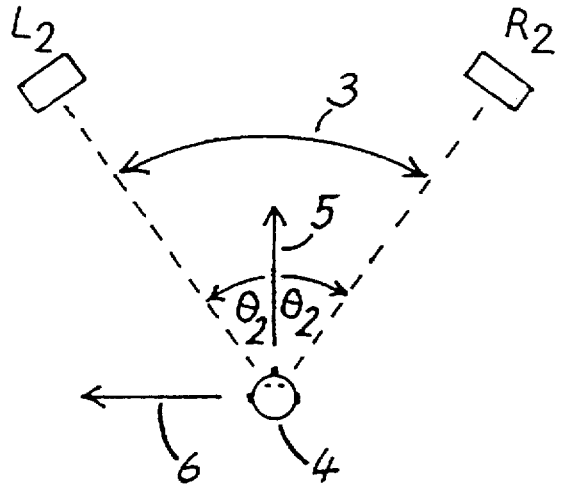
Figure 1C:
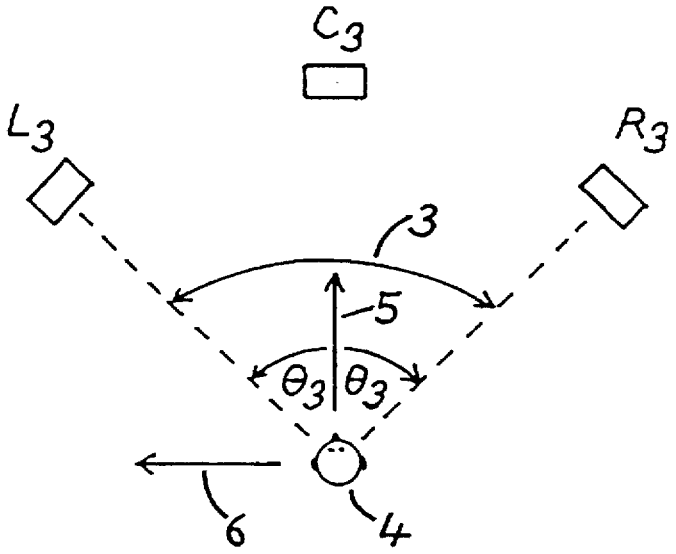
Figure 1D:
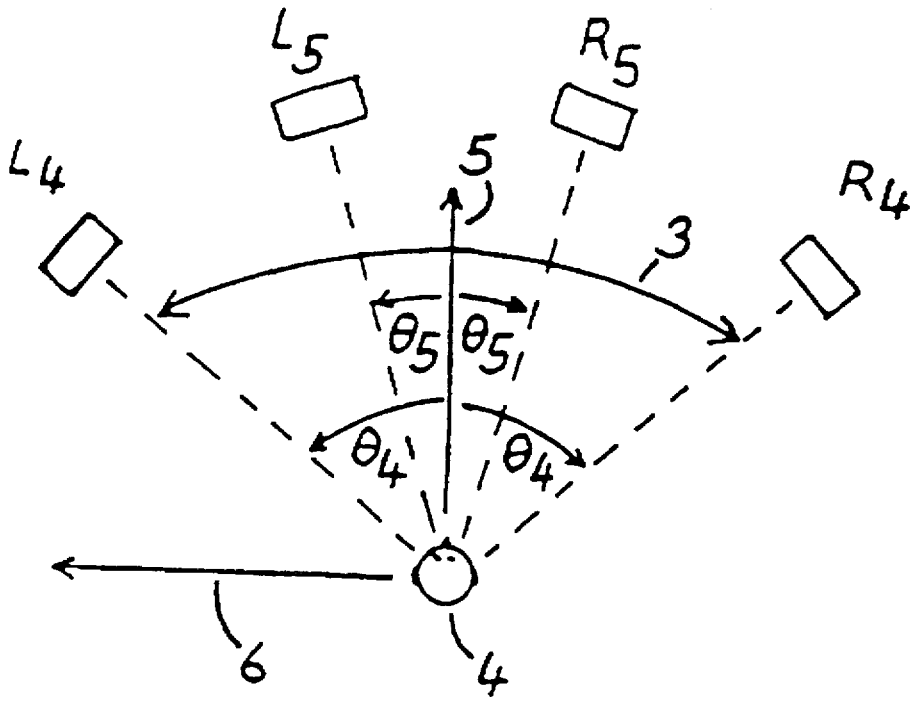
Figure 1E:
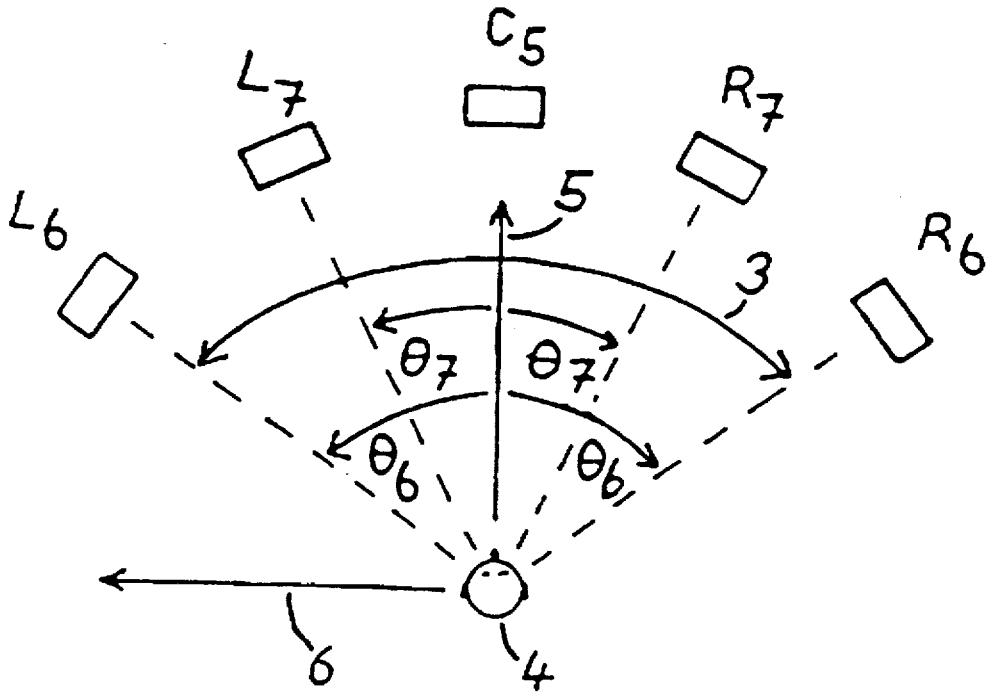

Typical stereophonic arrangements with left/right symmetry of loudspeakers covering a sector (3) of directions in front of a listener (4) which are suitable for use in connection with the invention are shown in FIGS. 1*a* to 1*g*. FIG. 1*a* shows a typical monophonic loudspeaker $C_1$ in front of a listener (4), such as might be used for monophonic reproduction of a stereophonic signal. FIG. 1*b* shows a typical two-speaker arrangement with respective left and right loudspeakers $L_2$ and $R_2$. FIG. 1*c* shows a typical three-speaker arrangement with respective left, centre and right loudspeakers $L_3$, $C_3$ and $R_3$. FIG. 1*d* shows a typical four-speaker arrangement with respective loudspeakers $L_4$, $L_5$, $R_5$ and $R_4$ from left to right in front of the listener (4). FIG. 1*e* shows a typical five-speaker arrangement with respective loudspeakers $L_6$, $L_7$, $C_5$, $R_7$, and $R_6$ from left to right in front of the listener (4).

In all these arrangements, for the various numerical subscripts p, the symbol $C_p$ is used to indicate a central loudspeaker in a (notional) frontal direction (5) with respect to an ideally situated listener (4), $L_p$ is used to indicate a loudspeaker placed in a direction at an angle $\theta_p$ towards the (notional) left (6) of due front (5) at the listener (4), measured in an anticlockwise direction, and $R_p$ is used to indicate a loudspeaker placed symmetrically to the right in a direction at an angle $\theta_p$ to the (notional) right of due front (5). In FIGS. 1*b* to 1*e*, all loudspeakers are placed at equal distances from the ideal listener position (4) and face towards the position of the listener (4).

Figure 1F:
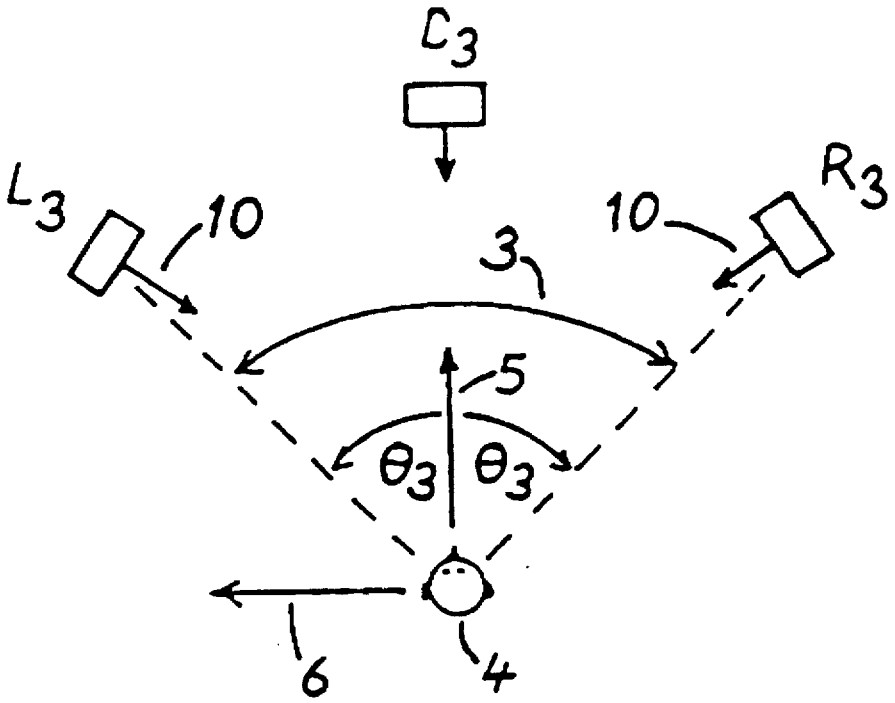
Figure 1G:
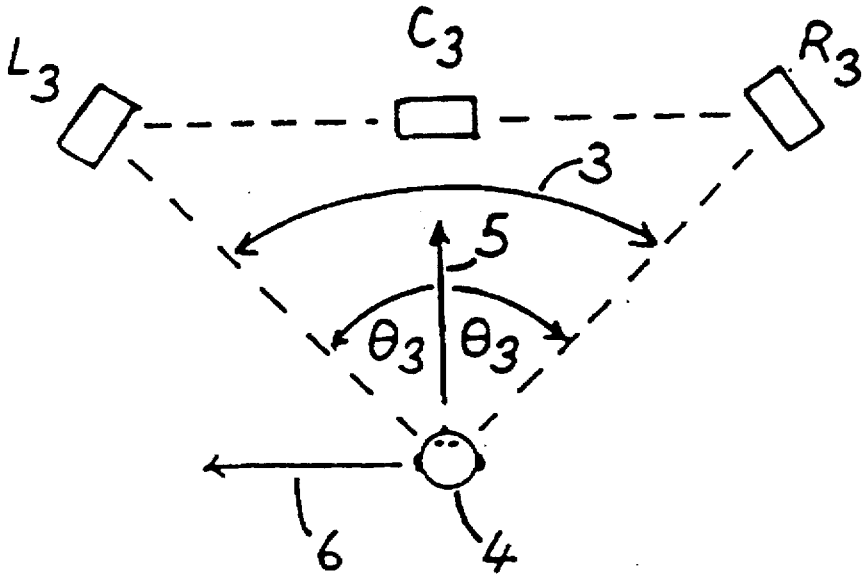

However, other arrangements are possible, and by way of example, FIG. 1*f* shows an alternative preferred three-speaker arrangement with respective left, centre and right loudspeakers $L_3$, $C_3$ and $R_3$ in which the three loudspeakers are at an equal distance from the listener (4), but where the two outer loudspeakers are angled in such that their axes (10) cross in front of the listener (4) as shown. FIG. 1*g* shows another alternative three-speaker arrangement in which the outer loudspeakers $L_3$ and $R_3$ are angled in as before, but where the centre loudspeaker $C_3$ lies at the centre of a line joining $L_3$ and $R_3$, and so is closer to the listener (4).

The angles $\theta_p$ subtended by the loudspeakers may be chosen across a broad range of values according to convenience or the desired stage width of stereophonic presentation. However, it is generally found that if the angle subtended at the listener (4) between adjacent loudspeakers is too large, then the quality of phantom illusory images become poor. There is no sharp delineation between angular widths that give a totally satisfactory and a totally unsatisfactory image quality, but as an indication, it is found that for two-speaker stereo, $\theta_2$ greater than 35° (giving a total angular width of the reproduced sector (3) of directions of more than 70°) gives poor image quality. For three-speaker reproduction, preferably $\theta_3$ is not more than 45° (giving a reproduced sector (3) angle of 90°); whereas wider stage widths covering sectors (3) of 120° or more can be used with four or more loudspeakers with satisfactory results. Generally, the sector (3) of reproduced directions using four or more loudspeakers will not exceed 180°, although in some cases a slightly larger angular coverage, for example 210° or 225°, may be used. However, for such stereophonic arrangements slightly exceeding 180° of coverage, the included angle to the rear of the listener (4) between the outermost loudspeakers is so large that stable imaging to the rear of the listener is not possible. The invention is applicable only to stereophonic arrangements covering a sector (3) of directions not including stable imaging of excluded angular positions, and is not applicable to loudspeaker arrangements capable of covering a 360° surround-sound stage.

While the invention is not confined to any specific values of the angles $\theta_p$ shown in FIGS. 1*b* to 1*g*, the following values are convenient illustrative reference values that might be used in practical stereophonic arrangements: $\theta_2=35°$, $\theta_3=45°$, $\theta_4=50°$, $\theta_5=\frac{1}{3}\,\theta_4=16\frac{2}{3}°$, $\theta_6=54°$, and $\theta_7=\frac{1}{2}\,\theta_6=27°$. More generally, it is often convenient to choose loudspeaker arrangements for which the angle subtended at the predetermined ideal listener position (4) between adjacent pairs of loudspeakers is identical to that of all other adjacent pairs, such as is the case for the illustrative reference values given above.

Matrix Decoding Hearts

Using the practical skills and equipment available to recording or balance engineers, stereophonic signals capable of producing a desired directional illusion across the available sector (3) of directions via any specific stereophonic loudspeaker arrangement, such as those illustrated in FIGS. 1*b* to 1*f*, can be created, recorded, stored or transmitted. An object of this invention is to substantially retain or improve this desired stereophonic effect via an arrangement with a larger number of loudspeakers, such as one of those shown in FIGS. 1*c* to 1*e*.

Figure 2:
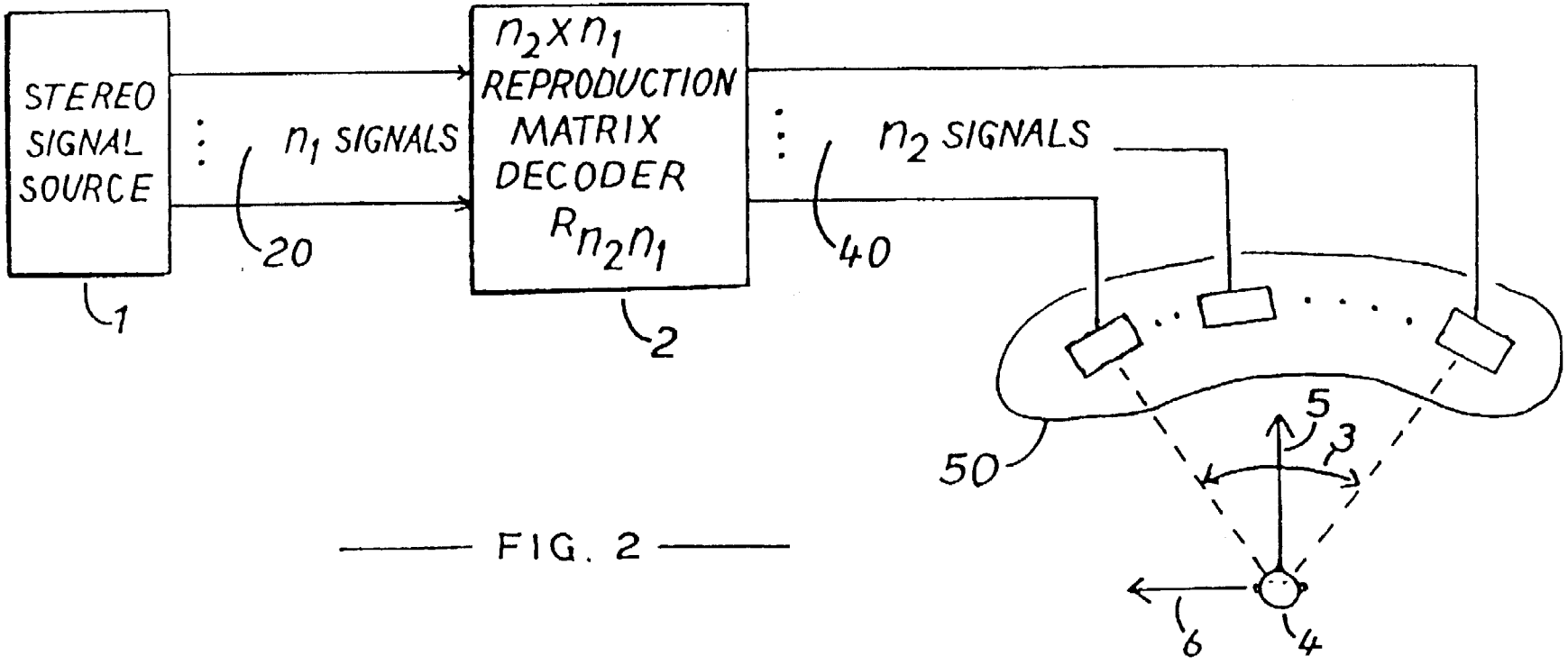
FIGS. 2 and 3 show schematic block diagrams of matrix reproduction decoding means in accordance with the invention.

The general method of doing this according to the invention is illustrated in FIG. 2, whereby an original first plurality (20) $n_1$ of signals from a stereophonic signal source (1), which may for example be a stereophonic microphone arrangement, the outputs from a mixing desk, the outputs from a tape or disc reproducer, a broadcast receiver or a telecommunications link, said signals representing loudspeaker feed signals suitable for a first stereophonic arrangement are fed into a reproduction matrix decoding means (2) to produce a second greater plurality (40) $n_2$ of signals representing loudspeaker feed signals suitable for a second stereophonic arrangement (50). Although in FIG. 2, this second plurality of signals is shown as being fed into loudspeakers (50) direct from the matrix means (2), it will be understood that generally such feeds to loudspeakers may involve necessary or desirable intermediate stages evident to those skilled in the art, such as amplification and gain adjustment stages, overall volume and tone control adjustments, equalisers for loudspeaker and room characteristics, time delays for adjusting the time of arrivals at a listener from individual loudspeakers, connecting means such as cables or infra-red links, and the like.

The $n_2 \times n_1$ reproduction matrix decoding means (2) causes each of the $n_2$ output signals to be linear combinations of the $n_1$ input signals (20). The $n_2 \times n_1$ coefficients of these linear combinations are referred to as "matrix coefficients". These linear combinations may be independent of frequency, or may alternatively be frequency-dependent. If the linear combinations are frequency-dependent, then the matrix coefficients will be complex gains that are a function of frequency. In preferred forms of the invention in the case when the matrix coefficients are frequency-dependent, the matrix coefficients will be approximately real and frequency-independent across two or three relatively broad audio frequency bands, and will vary significantly only in the transition frequency regions between these frequency bands.

Rather than describe input (20) or output (40) signals directly in terms of loudspeaker feed signals, it is sometimes convenient or useful to describe signals $L_p$ and $R_p$ intended to be fed to the loudspeakers indicated by the same symbols in what is often termed "MS" or "sum-and-difference" form. The "MS" or "sum-and-difference" signals $M_p$ and $S_p$ are respectively defined as the sum $$M_p=2^{-1/2}(L_p+R_p)$$

and the difference $$S_p=2^{-1/2}(L_p-R_p)$$

of $L_p$ and $R_p$ with the amplitude gain $2^{-1/2}=0.7071$, which is chosen as a matter of convenience. Other gains could be chosen at the expense of complicating the later description of the invention. A matrix means implementing this above-described MS or sum-and-difference process will be termed an "MS matrix" means.

The signals $M_p$ and $S_p$ in MS form can be reconverted to direct or "left/right" form by the application of a second identical MS matrix means, by the equations $$L_p=2^{-1/2}(M_p+S_p)$$

and $$R_p=2^{-1/2}(M_p-S_p)$$

Sum-and-difference techniques have been used in the stereo art since UK patent 394,325 in 1931, and are widely known, for example, in connection with the MS stereo microphone technique and the Zenith/GE system of FM stereo multiplex broadcasting.

In MS form, we shall regard signals of the form $M_p$ or $C_p$ as "sum" signals and of the form $S_p$ as "difference" signals. It is often convenient to represent two-speaker stereophonic signals $L_2$ and $R_2$ in MS form as $M_2$ and $S_2$: to represent three-speaker signals $L_3$, $C_3$ and $R_3$ in MS form as $M_3$, $C_3$ and $S_3$; to represent four-speaker signals $L_4$, $L_5$, $R_5$ and $R_4$ in MS form by $M_4$, $M_5$, $S_4$ and $S_5$; and to represent five-speaker signals $L_6$, $L_7$, $C_5$, $R_7$ and $R_6$ in MS form by $M_6$, $M_7$, $C_5$, $S_6$ and $S_7$.

It is sometimes convenient to describe the reproduction matrix decoding means (2) in terms of what it does to signals in MS form. By using the above MS matrix equations, such a description is easily converted into one describing the action of matrix means (2) on signals in left/right form. The invention is applicable to matrix means (2) that accept signals (20) in either or both left/right or MS forms, and that produce signals (40) in either or both left/right or MS forms.

If outputs (40) are produced in MS form, it will be understood that the connection of the output signals (40) to the reproduction loudspeakers (50) will involve a necessary further MS matrix stage.

According to the invention in one form, it is required that the reproduction matrix decoding means (2) should substantially preserve the total energy of the input signals (20) fed to the intended first stereophonic arrangement when the matrix means (2) output signals (40) are reproduced via the second stereophonic arrangement (50) of loudspeakers. For simplicity of description, and without limiting the invention, it is convenient to assume that all loudspeakers have identical characteristics and a flat frequency response, so that the signals fed to the loudspeakers are identical, to within a constant of gain, to the signals emitted by the loudspeakers into the room. In this case, the total energy emitted into the room at each moment is the sum of the squares of the separate loudspeaker feed signals, which also equals the total energy or sum of squares of the signals in MS form, since it can easily be shown that $L_p^2+R_p^2=M_p^2+S_p^2$.

It is generally desirable to preserve energy in order to retain the level-balance among different component sounds in the original stereo effect, both for aesthetic reasons and because it is thought that the ears' ability to hear sound-source distance effects depends in part on an accurate retention of the level-balance between direct sounds and associated early reflections.

It has hitherto not been appreciated that another reason for substantially preserving the total reproduced energy is that many different recording and mixing techniques may be used to prepare the original stereo effect, and that a reproduction matrix decoding means (2) that substantially departs from preserving total energy by giving some stereophonic signal components a gain differing by say more than 3 dB from the gain of others can cause accidental cancellations or reinforcements of some signal components of an unpleasantly audible kind. For example, if time-delays between different stereo components are used to help create the stereo effect, as is the case with either spaced microphone techniques or with time-delay stereo panning, such non-constancy of energy gain can cause position-dependent comb-filter colourations whereby some frequencies in a sound have markedly different gains to other nearby frequencies.

Therefore, to ensure usability with a wide range of recording or mixing techniques, it is desirable that a reproduction matrix decoding means (2) should be substantially energy preserving, although it will be understood that overall adjustments of gain or tonal quality affecting all component stereo signals equally are permissable for reasons of convenience or desired effect. It is preferred that the gain variations at any frequency produced by use of the reproduction matrix decoder means (2) between different components of the stereo signal should not exceed about 3 dB, and it is desirable that such variations of gain should be less than 2 dB, and ideally be less than 1 dB for high quality results.

The 2- into 3-Speaker Case

Figure 3:
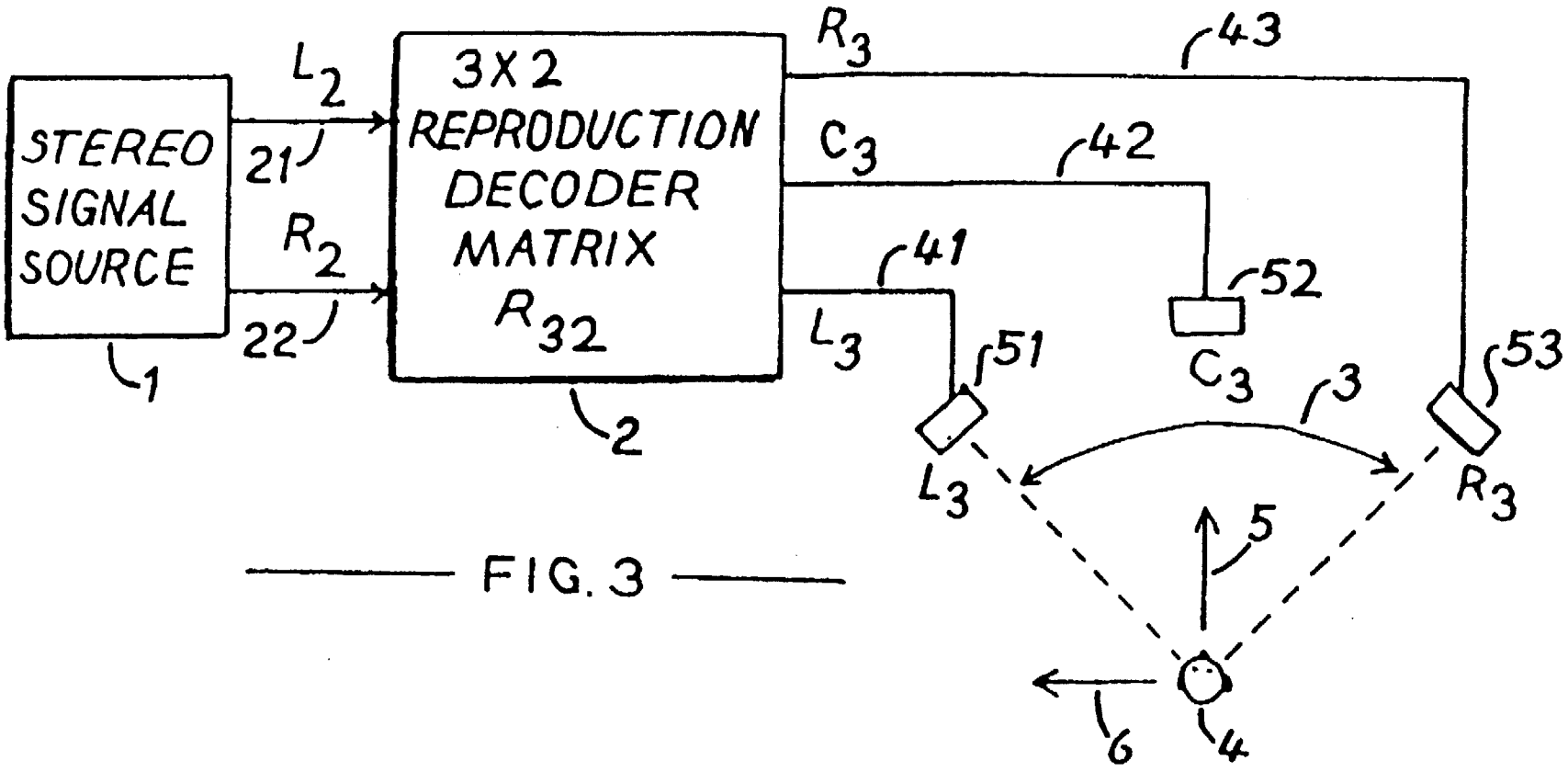

A first example of an implementation of the invention is now described with reference to FIGS. 3 and 4. In this case, it is desired to convert stereophonic signal $L_2$ and $R_2$ intended for two loudspeakers as in FIG. 1*b* into loudspeaker feed signals $L_3$, $C_3$ and $R_3$ for three loudspeakers such as in FIGS. 1*c* or 1*f*, as shown in the schematic of FIG. 3. The 3×2 reproduction matrix decoding means (2) produces output signals (40) of the form $$L_3=(\tfrac{1}{2}\sin\phi)(L_2+R_2)+\tfrac{1}{2}w(L_2-R_2)$$

$$R_3=(\tfrac{1}{2}\sin\phi)(L_2+R_2)-\tfrac{1}{2}w(L_2-R_2)$$

$$C_3=(2^{-1/2}\cos\phi)(L_2+R_2)$$

from the input signals (20) $L_2$ and $R_2$, where the predetermined angle parameter $\phi$ is preferably chosen in the range from 15° to 75° and the predetermined width parameter w is ideally chosen to be close to the value w=1, and in any case if fixed in value to be such that $L_2$ cross-talks onto the $R_3$ output with a polarity inversion, i.e. such that w is greater than $\sin\phi$, in order to give reproduction with a reasonably wide sound stage.

It may be verified, using simple algebra and trigonometry, that in the ideal preferred case w=1 one has $$L_3^2+C_3^2+R_3^2=L_2^2+R_2^2,$$

so that the reproduction matrix decoding means (2) is energy-preserving.

Figure 4:
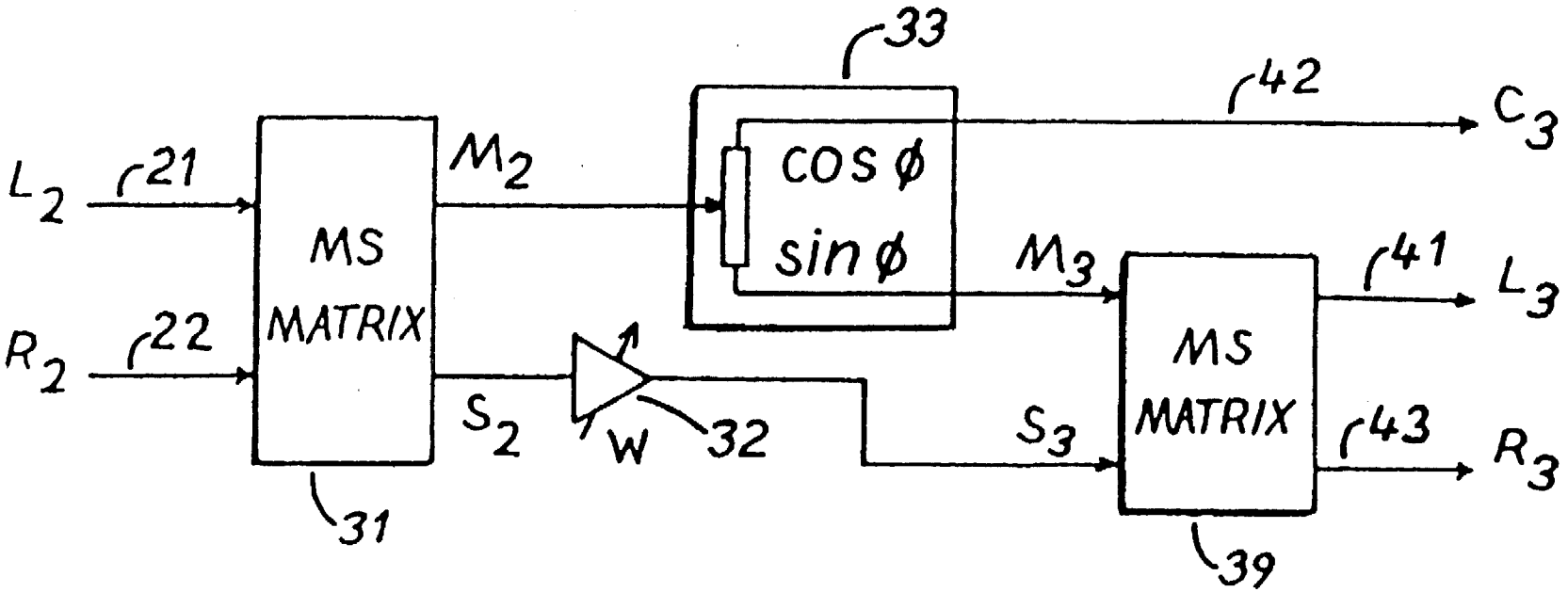
FIG. 4 shows a reproduction decoder producing three output signals from two input signals.

FIG. 4 shows a schematic of a 3×2 reproduction matrix decoding means (2) satisfying the above 3×2 matrix means decoding means equations. An initial MS matrix means (31) receives the input signals $L_2$ (21) and $R_2$ (22) to produce signals $M_2$ and $S_2$; the difference signal $S_2$ is given an optional width gain adjustment (32) w to provide any desired adjustment of reproduced stage width, producing a signal $S_3$; the sum signal $M_2$ is passed into a network (33) such as a constant-power pair of gain adjustments or a sine/cosine potentiometer or gain adjustment producing two outputs with respective gains $\cos\phi$ and $\sin\phi$ whose squares add up to one. This network (33) may consist of a fixed pair of gain adjustment stages or a fixed resistor network for a fixed value of the parameter $\phi$, or can comprise an adjustable network giving constant power output. The signal $C_3$ with gain $\cos\phi$ can be used as the centre loudspeaker feed signal (42), and the signal $M_3$ with gain $\sin\phi$ is fed with $S_3$ to a second MS matrix means (39) to provide signals $L_3$ (41) and $R_3$ (43) suitable for feeding the outer loudspeakers of a three-speaker stereophonic arrangement (50) such as shown in FIGS. 3, 1*c*, 1*f* or 1*g*.

There is no single value of the angle parameter $\phi$ that gives optimal subjective results in all cases; a small value of $\phi$ around say 20° gives good stability of centre stage illusory sound images but a poor and unreliable reproduction of stereo stage width, relying largely on acoustical matrixing for a listener (4) at an ideal stereo seat position and giving a high degree of image movement for edge-of-stage illusory phantom images at other listening positions. A large value of the parameter $\phi$ around 60° gives stable and wide reproduction of edge-of-stage phantom images at the expense of poor stability of central stage images. Values of $\phi$ typically between 32° and 55° give a compromise reproduction in which improved central-image stability is traded off against degraded edge-of-stage image stability. It is typically found that values of $\phi$ between 35° and 45° are generally preferred, but still give non-ideal width and edge-of-stage image stability.

However, it is found that values of $\phi$ within the range 15° to 75° give a generally satisfactory quality of reproduction at frequencies below around 700 Hz, and that values of $\phi$ around 35° give a reasonable stability of images and width at frequencies up to around 4 kHz. At frequencies above around 5 kHz, a good sense of stage width and central image stability is given for values of $\phi$ typically around 55°. For most stereophonic signals, the stability of central images is determined mainly by frequencies between around 300 Hz and 5 kHz, whereas the frequencies above 5 kHz are important for creating a sense of wide stage width.

We have found that the values $\phi$=35.26° or thereabouts at frequencies up to about 5 kHz and $\phi$=54.74° or thereabouts at frequencies above about 5 kHz give the most generally satisfactory results, both for listeners at an ideal stereo seat position (4) and for listeners across a broad listening area. Typically, as compared to two-speaker stereo covering the same sector (3) of reproduced directions, the degree of angular image movement with respect to loudspeaker directions with change of listener position is reduced by a factor of about three for central illusory images, and the degree of angular image movement with respect to the loudspeaker directions for edge-of-stage illusory images is broadly comparable with that for central illusory images. We have found that the exact value of the transition frequency around 5 kHz is uncritical, but that a transition frequency below 4 kHz gives poor results. It is found that the transition between the lower- and higher-frequency values of the parameter $\phi$ should be fairly gradual with frequency, and not sudden, since the ears are sensitive to sharp changes of auditory quality with frequency.

Figure 5:
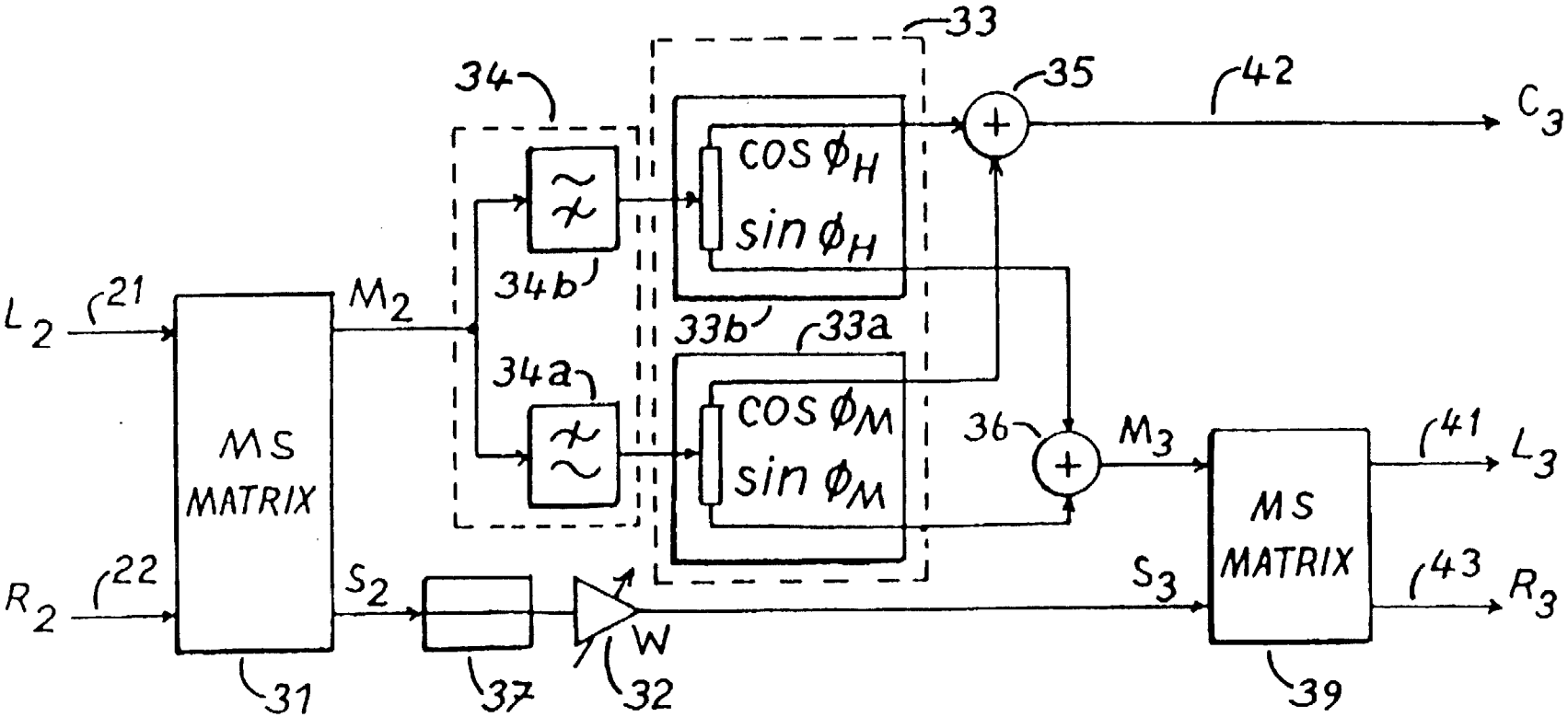
FIG. 5 shows a frequency-dependent version of the decoder of FIG. 4.

FIG. 5 shows one realisation of a frequency-dependent matrix version of the invention. MS versions $M_2$ and $S_2$ of the input signals $L_2$ (21) and $R_2$ (22) are produced by an MS matrix means (31), and the difference signal $S_2$ is passed via a direct connection (37) through an optional width gain adjustment (32) as before. The sum signal $M_2$ is passed through a bandsplit filter (34) that divides the signal into two sets of frequency components; typically this may consist of a low-pass filter (34*a*) and a high-pass filter (34*b*) whose outputs sum to their input $M_2$. Typically, these filters may be complementary first-order or RC filters with a cross-over frequency at around 5 or 6 kHz, although a sharper transition rate can be achieved by using second-order or higher-order filters.

The high-pass signal component of $M_2$ from bandsplit means (34*b*) is fed to a constant-power gain adjustment means (33*b*) to produce gains $\cos\phi_H$ and $\sin\phi_H$ as shown, where $\phi_H$ is the desired high-frequency value (typically around 55°) of the angle parameter $\phi$, and the low-pass signal component from the bandsplit filter means (34*a*) is fed to another constant-power gain adjustment means (33*a*) to produce gains $\cos\phi_M$ and $\sin\phi_M$ as shown, where $\phi_M$ is the desired mid and low frequency value (typically around 35°) of the parameter $\phi$. The $\sin\phi$ outputs of these gain adjustment means (33) are fed to summing means (36) to produce a signal $M_3$, and the $\cos\phi$ outputs of these gain adjustment means (33) are fed to another summing means (35) to produce a signal $C_3$. The signals $M_3$ and $S_3$ are fed to a second MS matrix means (39) to produce left and right signals $L_3$ and $R_3$. The three signals $L_3$ (41), $C_3$ (42) and $R_3$ (43) are loudspeaker feed signals suitable for use with the three-speaker arrangements of FIGS. 3, 1*c*, 1*f* or 1*g*.

Various variations of FIG. 5 will be evident to those skilled in the art. For example, the bandsplitting filters (34) may be implemented subsequently to the constant-power gain adjustment stages (33) rather than preceeding them. Bandsplitting filters (34) may be used whose outputs substantially sum to an all-pass response rather than to their input signal, in which case a parallel all-pass filter (37) with a substantially identical all-pass characteristic should be placed in series with the $S_2$ signal path, for example as shown in FIG. 5, in order that the phase relationships between the parallel signal paths remain substantially unaffected.

A particular desirable implementation uses filters (34*a*), (34*b*) and (37) that have identical phase characteristics in order that all interpath phase differences be eliminated. This may be achieved for example by using a first order all-pass network (37) with low-pass means (34*a*) comprising two cascaded first-order low-pass stages, and high-pass means (34*b*) comprising two cascaded first-order high-pass stages with a polarity inversion, all stages and filters having identical time constants.

The frequency-dependent version of the invention may be extended to the case where the bandsplit network (34) comprises filter means giving three or more outputs that substantially sum to its input or to an all-pass response, which feed a corresponding number three or more of constant-power gain adjustment stages (33) whose sine gain outputs are fed to summing means (36) to produce a signal $M_3$ and whose cosine gain outputs are fed to another summing means (35) to produce a signal $C_3$. Such a version of the invention may be used to choose one value $\phi_L$ of the parameter $\phi$ at low frequencies below say around 200 Hz, a second value $\phi_M$ of $\phi$ between around 200 Hz and around 5 kHz, and a third high frequency value $\phi_H$ of $\phi$ above around 5 kHz.

As before, it is found that values around $\phi_M$=35° and $\phi_H$=55° are found satisfactory, and it is found that the value of $\phi_L$ at very low frequencies is relatively uncritical as regards stereophonic effect. The value of $\phi_L$ may be adjusted in the range 0° to 90° to achieve a satisfactory result taking into account the performance of the three loudspeakers at bass frequencies.

In general, very small loudspeakers have poor bass response extension, and for reasons of convenience, cost, space, appearance or physical size, it may be desired to use only one or two out of the three loudspeakers shown in FIG. 3 with an extended bass response. If the centre loudspeaker $C_3$ has a poorer bass response than $L_3$ or $R_3$, then a value of $\phi_L$ near 90° may be used to minimise bass fed to the centre loudspeaker. If instead only the centre loudspeaker has an extended bass response, a value $\phi_L$ near 0° will minimise bass signals to the other two loudspeakers. Similarly, a system using three small loudspeakers plus a single "superwoofer" for bass frequencies will work best if used with $\phi_L$ near 0° and if the superwoofer feed is derived from the $C_3$ signal.

In the case that the three loudspeakers have substantially identical bass responses, one may have $\phi_L=\phi_M$ as shown in FIG. 5, or may alternatively use a value $\phi_L$ near 54.74°. The latter value has the advantage that central bass sounds, which are typically the most powerful bass sounds in most stereo programmes, are reproduced with identical energy from all three loudspeakers, which maximises the bass power handling capacity of the loudspeaker arrangement and maximises subjective bass response.

In applications where the loudspeakers have different bass response characteristics, it may be desired to incorporate phase-adjustment means at the outputs (41), (42) and (43) of the 3×2 reproduction matrix decoding means in order to compensate for phase response differences between the three loudspeakers.

In the case that $\phi_L=\phi_H$ (such as the case when both equal around 55°), the low-pass filter means (34*a*) in FIG. 5 may be replaced by a bandpass means for frequencies between around 200 Hz and 5 kHz, and the high-pass filter means (34*b*) may be replaced by a complementary bandstop filter means.

It will be understood that the transition frequency 200 Hz mentioned above is by way of example, and that the transition between $\phi=\phi_L$ and $\phi=\phi_M$ may be lower or higher depending on the bass properties of the stereophonic arrangement of loudspeakers used for reproduction.

In any of the above 3×2 matrix decoders according to the invention, it is possible to make the gain w frequency-dependent if desired. This may be particularly advantageous at frequencies below 600 Hz, where an increased width, say by a factor 1.4, at lower frequencies is sometimes found to enhance the quality of spaciousness of a recording.

Hierarchical 3-Channel Transmission System

Figure 6:
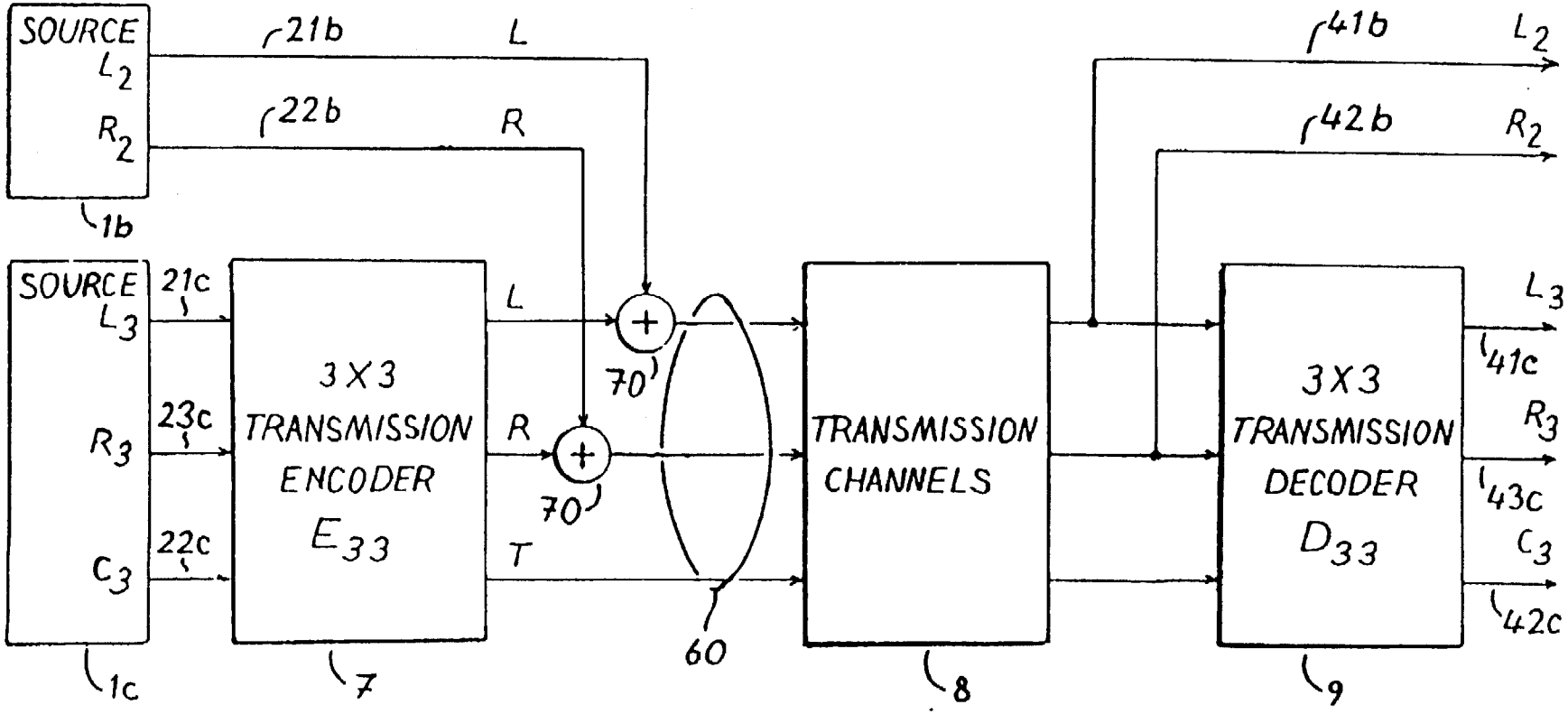
FIGS. 6 and 7 show block schematics of systems of encoding and decoding transmission signals from and to two- and three-loudspeaker reproduction signals.
Figure 7:
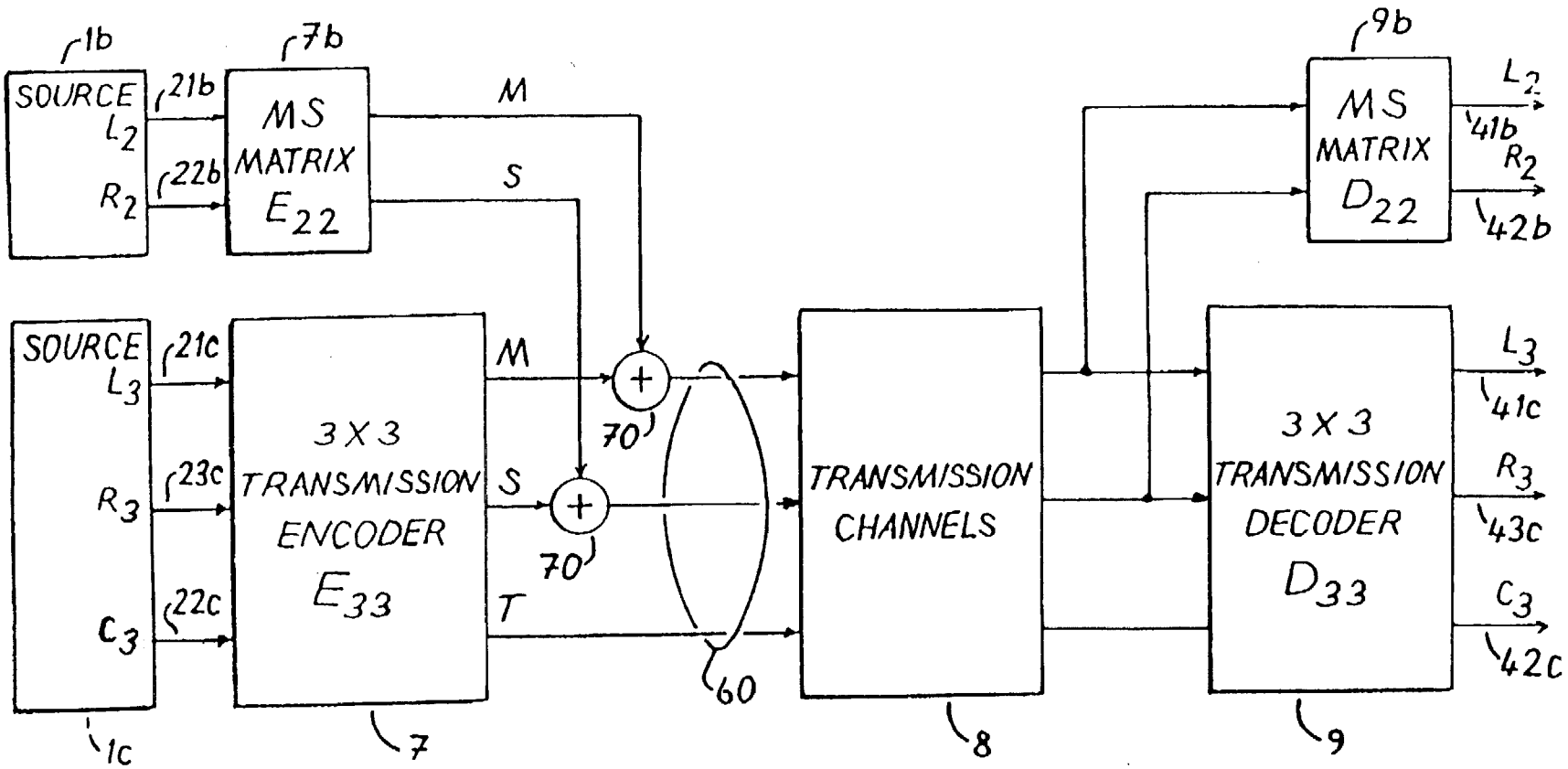

With reference to FIGS. 6 and 7, a hierarchical system based on the above-described 3×2 reproduction matrix decoding equations and means (2) will be described. This system encodes two (21*b*, 22*b*) or three (21*c*, 22*c*, 23*c*) signals from a respective two- or three-speaker stereo source (1*b* or 1*c* respectively) via transmission matrix encoding means (7 or 7*b*) to produce transmission channel signals (60), which are transmitted via transmission channels (8) which may for example consist of wire, broadcast or telecommunications channels, tape or disc recording and playback channels, digital storage channels or the like, and which are then decoded using transmission matrix decoding means (9 or 9*b*) to produce two-speaker signals (41*b* and 42*b*) or three-speaker feed signals (41*c*, 42*c* and 43*c*).

FIG. 6 shows a 3×3 transmission matrix encoding means (7) receiving three-speaker feed signals $L_3$, $C_3$ and $R_3$ and producing transmission channel signals L, R and T transmitted via transmission means (8) and 3×3 transmission matrix decoding means (9) producing reconstructed three-speaker feed signals $L_3$, $C_3$ and $R_3$. FIG. 6 also shows direct transmission of two-speaker left and right signals $L_2$ and $R_2$ as signals $L=L_2$ and $R=R_2$. When such two-speaker transmissions are received by the 3×3 transmission decoding means (9), it is required according to the invention in its third aspect that the resulting 3×2 reproduction matrix decoding means (2) should be a 3×2 decoder according to the 3×2 matrix decoding equations described above. It is also required according to the invention that the 3×3 transmission matrix decoding means (9) should be inverse to the 3×3 transmission matrix encoding means (7), so that three-speaker feed signals are recovered substantially unaltered after 3-channel transmission.

Suitable equations describing the transmission matrix decoding means (9) according to the invention are $$L_3=\tfrac{1}{2}(\sin\phi'+w')L+\tfrac{1}{2}(\sin\phi'-w')R+(2^{-1/2}\cos\phi'')kT$$

$$R_3=\tfrac{1}{2}(\sin\phi'-w')L+\tfrac{1}{2}(\sin\phi'+w')R+(2^{-1/2}\cos\phi'')kT$$

$$C_3=(2^{-1/2}\cos\phi')(L+R)-(\sin\phi'')kT,$$

where the angle parameters $\phi'$ and $\phi''$ are preferably between 15° and 75°, the width parameter w' is preferably equal to one and in any case greater than $\sin\phi'$, and the third channel gain parameter k' may equal 1 or any other predetermined non-zero value. It will be seen that if the third transmission channel is replaced by a zero signal and the L and R transmission channels are the respective two-speaker stereo signals $L_2$ and $R_2$, then the 3×3 transmission decoder (9) acts as a 3×2 reproduction matrix decoder means (2) of the form described earlier, for example with reference to FIGS. 3 and 4.

The inverse 3×3 transmission encoding matrix means (7) must then, according to the invention, satisfy the inverse of the above equations, which have the form $$L=1/2\left(\frac{\sin\phi''}{\cos(\phi'-\phi'')}+w'^{-1}\right)L_3+1/2\left(\frac{\sin\phi''}{\cos(\phi'-\phi'')}-w'^{-1}\right)R_3+\left(2^{-1/2}\frac{\cos\phi''}{\cos(\phi'-\phi'')}\right)C_3$$

-continued $$R=1/2\left(\frac{\sin\phi''}{\cos(\phi'-\phi'')}-w'^{-1}\right)L_3+1/2\left(\frac{\sin\phi''}{\cos(\phi'-\phi'')}+w'^{-1}\right)R_3+\left(2^{-1/2}\frac{\cos\phi''}{\cos(\phi'-\phi'')}\right)C_3$$

$$T=\frac{k'^{-1}}{\cos(\phi'-\phi'')}\{(2^{-1/2}\cos\phi')(L_3+R_3)-(\sin\phi')C_3\}.$$

It will be seen that the form of the 3×3 transmission encoding matrix (7) equations are largely determined by the requirements of the invention on the 3×2 reproduction decoding matrix.

It is preferred that the angle parameters $\phi'$ (which determines the 3×2 reproduction decoding matrix results) and $\phi''$ should be equal. It is preferred that the values of $\phi'$ and $\phi''$ in the above 3×3 transmission decoding and encoding equations are between 32° and 55°, with 45° a highly preferred choice. The preferred value of w' is close to or equal to one. When $\phi'=\phi''$, and $w'=k'=1$, the forms of the 3×3 transmission decoding and encoding equations are identical, so that the same matrix means can be used for both encoding (7) and decoding (9).

In the prior art, it is known that two signals $L_2$ and $R_2$ intended for two-speaker stereophonic reproduction may be transmitted either in left/right form as respective left and right transmission signals $$L=L_2,\ R=R_2,$$

or in MS form as respective sum and difference signals $$M=M_2=2^{-1/2}(L+R)$$

and $$S=S_2=2^{-1/2}(L-R)$$

by use of an MS transmission encoding matrix (7*a*) as shown in FIG. 7, and that reproduced two-speaker feed signals $L_2$ and $R_2$ may be recovered by an inverse MS matrix means (9*a*), although −S may be transmitted as an alternative to S. In a similar manner, signals for the 3-channel hierarchical transmission system described above may alternatively be transmitted in MS form as the signals M, S and T where $M=2^{-1/2}(L+R)$ and $S=2^{-1/2}(L-R)$, where L,R and T are the previously defined signals encoded from $L_3$, $C_3$ and $R_3$. FIG. 7 shows the schematic of the hierarchical transmission system according to the invention when MS transmission channel signals are used.

The MS form of the above 3×3 transmission decoding and encoding equations are respectively $$M_3=(\sin\phi')M+(\cos\phi'')kT$$

$$C_3=(\cos\phi')M-(\sin\phi'')kT$$

$$S_3=w'S,$$

and $$M=(\cos(\phi'-\phi''))^{-1}[(\sin\phi'')M_3+(\cos\phi'')C_3]$$

$$T=\frac{k'^{-1}}{\cos(\phi'-\phi'')}[(\cos\phi')M_3-(\sin\phi')C_3]$$

$$S=w'^{-1}S_3,$$

which illustrates the fact that encoding and decoding equations of hierarchical left/right symmetric transmission signals generally have the simplest appearance in MS form.

By using the above transmission 3×3 decoding and 3×3 encoding equations, a three-speaker stereophonic reproduction apparatus will receive the originally intended three-speaker effect for three-speaker transmitted signals, and will receive a transmitted two-speaker stereo signal in a manner decoded according to the 3×2 reproduction matrix decoder of the invention. This allows material originated from two- and three-speaker stereophonic sources to be mixed together freely in programme creation, such as is shown via the adder means (70) in FIGS. 6 and 7, without any need for listeners to change decoding apparatus (9).

A two-speaker stereo listener receiving just the two-channel signals L and R or M and S from material originating from three-speaker stereo sources (1*c*) will obtain a satisfactory two-speaker presentation for earlier-described preferred values of the parameters $\phi'$, $\phi''$ and w'. Central images remain central, and provided that, as is preferred, w' is less than $$\frac{\cos(\phi'-\phi'')}{\sin\phi''},$$

extreme left and right source images are reproduced at positions marginally wider than the extreme left and right positions of the two-speaker stereo stage.

A disadvantage of using a fixed predetermined value of the angle parameter $\phi'$ for the above 3×3 transmission encoding and decoding equations is that the decoding of two channels via three loudspeakers does not have an optimum frequency-dependent form. While it is possible to use frequency-dependent encoding parameters, this has two disadvantages: (i) that the two-channel transmitted signal L and R is frequency-dependent and so not of optimum compatibility with two-speaker reproduction, and (ii) a standardisation of the frequency-dependence does not allow of any future modification that may improve subjective results further.

For reception of only two transmission channels, the transmission decoding matrix may be switched or adjustable to provide a decoder with a frequency-dependent value of the decoder parameter $\phi$.

Alternatively, if stereo source material originating from a mixture of two and three channels is to be mixed together, the two-speaker stereo signals $L_2$ and $R_2$ may first converted to three-speaker form by means of a 3×2 matrix reproduction decoding means such as shown in FIG. 5, and then fed into the 3×3 encoding matrix (7) to produce three transmission signals. By this means, the decoded signals $L_3$, $C_3$ and $R_3$ obtained after transmission matrix decoding (9) will be the same as if a frequency-dependent matrix reproduction decoder such as that of FIG. 5 had been used by the final listener.

The use of a frequency-dependent 3×2 reproduction decoder before a transmission encoder (7) results in frequency-dependent transmission signals L, R, And T, which may be disadvantageous to listeners receiving two-speaker stereo. However, in preferred versions of the transmission encoding and decoding, this disadvantage turns out to be very small as will now be shown.

Let the transmission parameters be such that $\phi'=\phi''$ and w'=k=1. Then for a frequency-dependent 3×2 reproduction matrix decoder such as that of FIG. 5, $$L_3=\tfrac{1}{2}(\sin\phi+1)L_2+\tfrac{1}{2}(\sin\phi-1)R_2$$

$$R_3=\tfrac{1}{2}(\sin\phi-1)L_2+\tfrac{1}{2}(\sin\phi+1)R_2$$

$$C_3=(2^{-1/2}\cos\phi)(L_2+R_2),$$

where $\phi$ typically varies between 35° and 55° with frequency. After transmission matrix encoding (7), the transmission channel signals L, R and T are found to be $$L=\tfrac{1}{2}(\cos(\phi-\phi'))(L_2+R_2)+\tfrac{1}{2}(L_2-R_2)$$

$$R=\tfrac{1}{2}(\cos(\phi-\phi'))(L_2+R_2)-\tfrac{1}{2}(L_2-R_2)$$

$$T=(2^{-1/2}\sin(\phi-\phi'))(L_2+R_2),$$

so that if $|\phi-\phi'|$ is small, say less than 25°, then L and R approximately equal $L_2$ and $R_2$ respectively, as is required for compatibility with two-speaker reproduction. If $\phi'=\phi''=45°$ and $\phi$ varies between 35° and 55° with frequency, $|\phi-\phi'|\leqq 10°$, so that $\cos 10°=0.9848\leqq\cos(\phi-\phi')\leqq 1$. This has little effect on the transmitted L and R signals, causing less than −42 dB left/right cross-talk.

Figure 8:
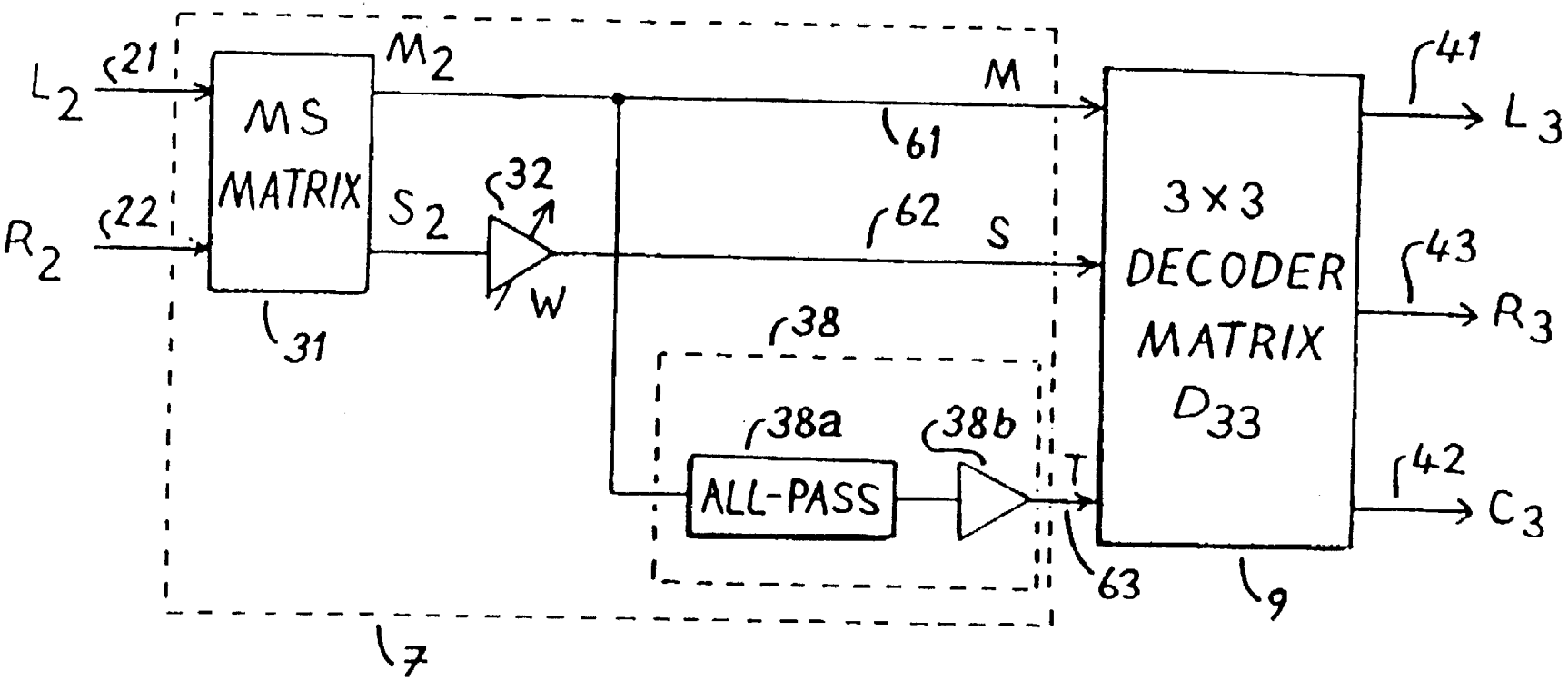
FIG. 8 shows a frequency-dependent means for encoding two signals into three transmission channels and for decoding two signals into three loudspeaker signals.

Since $\cos(\phi-\phi')$ is so close to one, in practice with essentially unchanged results one can transmit $L=L_2$ and $R=R_2$ at all frequencies, and transmit a third channel signal T equal to $M_2$ passed through a frequency-dependent gain equal to $\tan(\phi-\phi')$. Referring to FIG. 8, in practice one can derive T by deriving $M_2$ via an MS matrix (31) responsive to $L_2$ and $R_2$, and then passing it through a filter (38) to derive T. In the case $\phi'=45°$ and $\phi=35°$ at low frequencies and $\phi=55°$ at high frequencies, the filter (38) may comprise a gain (38*b*) equal to $\tan 10°=0.176$ and an all-pass network (38*a*) with gain −1 at low frequencies and gain +1 at high frequencies, with a typical transition frequency at around 5 kHz, so that $\phi=45°-10°=35°$ at low frequencies and $\phi=45°+10°=55°$ at high frequencies.

In FIG. 8, input stereo signals $L_2$ and $R_2$ (21,22) are passed into an MS matrix (31) and the difference signal $S_2$ is (optionally) passed through an optional width gain control (32) to provide an (optionally) modified difference signal S (62). The sum signal $M_2$ from the MS matrix (31) is used to provide a signal M (61) and also passed to the filter means (38) discussed above to provide a third signal T (63). The three signals M, S, T are three-channel transmission signals in MS form which may be used to feed a transmission system in accordance with the invention with signals derived from a two-speaker stereo source when psycho-acoustic frequency-dependence and (optional) width control is desired. The part (7) of FIG. 8 described so far constitutes a 3×2 transmission encoding matrix in accordance with the invention. Where required to ensure phase matching of the three channels, all-pass filters may be placed in the M and S (or L and R) signal paths (61,62) to provide a desired phase difference with the output of the T-channel filter means (38).

If, in addition, a three-speaker transmission matrix decoding means (9) is provided for the M, S and T signals (61–63) to provide three-speaker stereo signals (41–43) suitable for feeding $L_3$, $R_3$ and $C_3$ loudspeakers such as shown in FIGS. 1*c*, 1*f* and 1*g*, then FIG. 8 constitutes an alternative frequency-dependent 3×2 reproduction matrix decoding means to that shown in FIG. 5 according to the invention.

The means shown in FIG. 8 may also incorporate switching (not shown) in the signal paths (61–63) to accept as inputs two- and 3-channel transmissions in MS form as an alternative to inputs (21,22) in $L_2$,$R_2$ form. Also, the T signal path (63) only may be switchable to accept a third channel signal T from a three-channel transmission source L,R,T as an alternative to the synthesised third channel signal at the output of the filter (38) derived from a two-channel input.

A frequency-dependent n×2 reproduction matrix decoding means producing loudspeaker feeds for n greater than 3 loudspeakers according to the invention may be achieved by substituting in FIG. 8 an n×3 transmission matrix decoder means of the type described subsequently for the 3×3 decoder means (9) shown in FIG. 8.

Series Connection of Matrices

Figure 9:
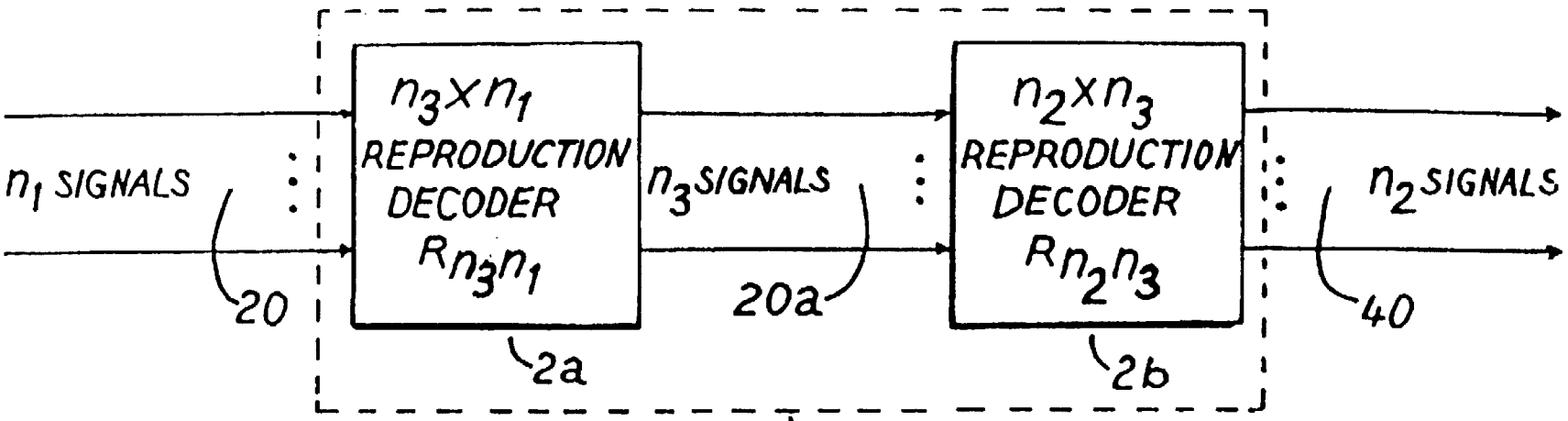
FIG. 9 shows a matrix reproduction decoding means that comprises two other matrix reproduction decoding means connected in series.

There are many possible $n_2 \times n_1$ reproduction matrix decoders in accordance with the invention, and explicitly describing every case one wishes to consider would be extremely laborious. It is therefore convenient and useful to consider "composite" decoders constructed by series connection of simpler ones. If one has three successively larger pluralities $n_1$, $n_3$ and $n_2$, and one has an $n_3 \times n_1$ reproduction matrix decoder (2*a*) in accordance with the invention, as shown in FIG. 9, and also an $n_2 \times n_3$ reproduction matrix decoder (2*b*) also in accordance with the invention, then the result of cascading the two decoders, so that $n_1$ input signals (20) from a stereo source (1) are converted into $n_3$ signals (20*a*) by $n_3 \times n_1$ matrix (2*a*) and then converted by $n_2 \times n_3$ matrix (2*b*) into $n_2$ signals (40), constitutes an $n_2 \times n_1$ reproduction matrix decoder (2) in accordance with the invention.

In particular, if each component decoder (2*a*) and (2*b*) preserves the total energy of the pluralities of signals passing through them, then so does the composite decoder (2). If each of the component decoders (2*a*) and (2*b*) substantially preserves or improves the intended stereo effect, so does the composite decoder (2), and if each of the component decoders (2*a*) and (2*b*) substantially preserve, to within constants of proportionality, the angular dispositions of reproduced velocity vectors or of sound intensity vectors at ideal listening position, then so does the composite decoder (2).

It will be understood that a composite decoder based on two known decoders according to the invention need not be implemented by physically implementing and connecting together the two known component decoders, but can alternatively be implemented as a single matrix circuit or means designed, by methods evident to those skilled in the art, to achieve the same end-result as a cascaded connection of the two known decoders. In particular, if the matrix coefficients of the $n_3 \times n_1$ matrix decoder (2*a*) are represented by an $n_3 \times n_1$ matrix $R_{n_3 n_1}$ and the matrix coefficients of the $n_2 \times n_3$ matrix decoder (2*b*) are represented by the $n_2 \times n_3$ matrix $R_{n_2 n_3}$ then the matrix coefficients of the composite decoder (2) are represented by the $n_2 \times n_1$ product matrix.

$$R_{n_2 n_1} = R_{n_2 n_3} R_{n_3 n_1}.$$

Figure 10:
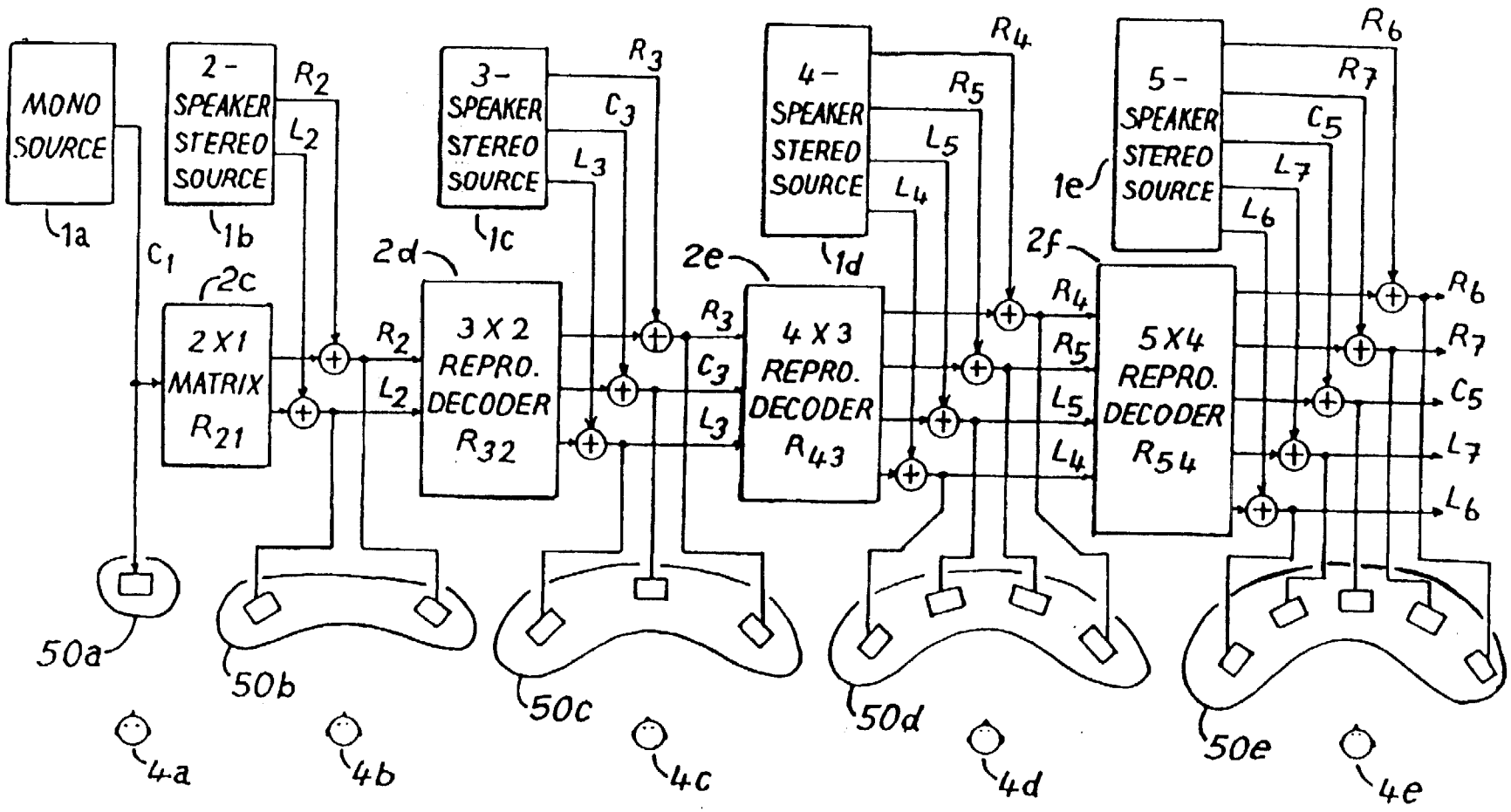
FIG. 10 is a schematic indicating how stereo signals for any plurality of loudspeakers may be mixed with and decoded for stereo reproduction via any larger number of loudspeakers.

Thus, for arbitrary pluralities $n_2$ greater than $n_1$, an $n_2 \times n_1$ reproduction matrix decoder according to the invention can be designed so long as one knows for each plurality n how to design an (n+1)×n reproduction matrix decoder according to the invention, by series connection for increasing n such as shown in the schematic of FIG. 10. This shows successive signals sources (1*a* to 1*e*) intended to feed the respective loudspeaker layouts shown in FIGS. 1*a* to 1*e*. (We have included the monophonic case for completeness). Successive (n+1)×n reproduction matrix decoding means (2*c* to 2*f*) for n=1 to 4, described by (n+1)×n matrices $R_{(n+1)n}$, produce from n input signals (n+1) output signals representing (n+1)-speaker stereo signal feeds, suitable for feeding (n+1) loudspeakers (50*a* to 50*e* for respective n+1's) as indicated schematically in FIG. 10. FIG. 10 also indicates schematically how mixing or adding means may be used to mix signals originated for different numbers of loudspeakers together, and shows how signals for one number of loudspeakers may be reproduced via a greater number according to the invention.

While FIG. 10 only shows up to five-speaker stereo, it is evident that further matrices, e.g. the 6×5 and 7×6 cases, may extend this schematic to any number of loudspeakers. In most practical reproduction matrix decoders, most or all parts of the schematic of FIG. 10 will not be explicitly implemented, but such a decoder may nevertheless have an overall effect equivalent to that of specific signal paths within FIG. 10.

General Hierarchical Transmission Systems

Before describing how specific (n+1)×n reproduction matrix decoders $R_{n+1\ n}$ according to the invention can be designed for n greater than 2. we shall indicate how a knowledge of such reproduction decoders can be used to design hierarchical systems of encoding into transmission signals and decoding from transmission signals according to the invention, based on the schematic of FIG. 10.

Figure 11:
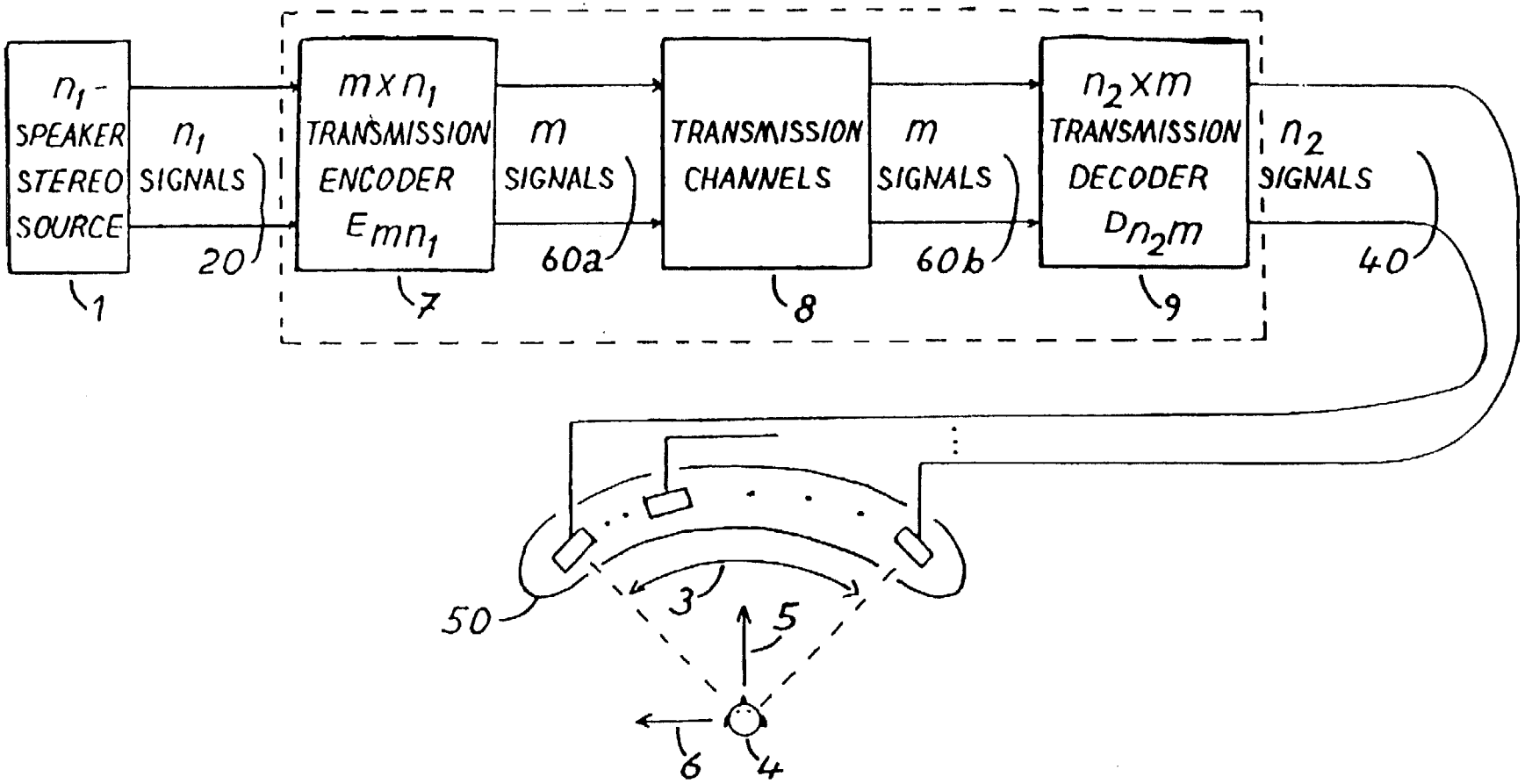
FIG. 11 is a schematic of a system of encoding and decoding stereo signals to and from transmission channel signals.

FIG. 11 shows the schematic of a general system for encoding $n_1$ signals (20) from an $n_1$-speaker stereo source (1) into m transmission channel signals (60*a*) by an $m \times n_1$ transmission matrix encoder means (7) described by an $m \times n_1$ matrix $E_{mn_1}$, which are then conveyed by a chosen transmission medium (8) to be received as m signals (60*b*) fed into a $n_2 \times m$ transmission matrix decoding means (9) described by an $n_2 \times m$ matrix $D_{n_2 m}$ to produce $n_2$ signals (40) representing feed signals for $n_2$ loudspeakers in a stereophonic arrangement (50) spread across a sector (3) of directions at a listener (4). The overall encoding/transmission/decoding signal path (2) constitutes an $n_2 \times n_1$ reproduction matrix decoding means for the source signals (20).

This overall reproduction matrix decoder (2) should be according to the invention in the case that the second plurality $n_2$ of loudspeaker feed signals is greater than the first plurality $n_1$, and the third plurality m of transmission channel signals is not less than $n_1$. Also, when the first and second pluralities are equal, i.e. $n_1 = n_2$, and the third plurality m is not smaller than these, the reproduced signals should be identical to those originally intended, apart from any overall gain and equalisation that may affect all signal paths equally.

In matrix notation, these requirements may be written $$D_{n_2 m} E_{mn_1} = R_{n_2 n_1}$$

whenever $n_2 > n_1$ and $m \geqq n_1$, where $R_{n_2 n_1}$ is the matrix description of an $n_2 \times n_1$ reproduction matrix decoder according to the invention, and $$D_{nm} E_{mn} = I_n = E_{nn} D_{nn}$$

for $m \geqq n$, where $I_n$ is the n×n identity matrix, where we conveniently exclude from our considerations any overall gain and equalisation changes, so that n×n encoding and decoding matrices are inverses of one another.

Figure 12:
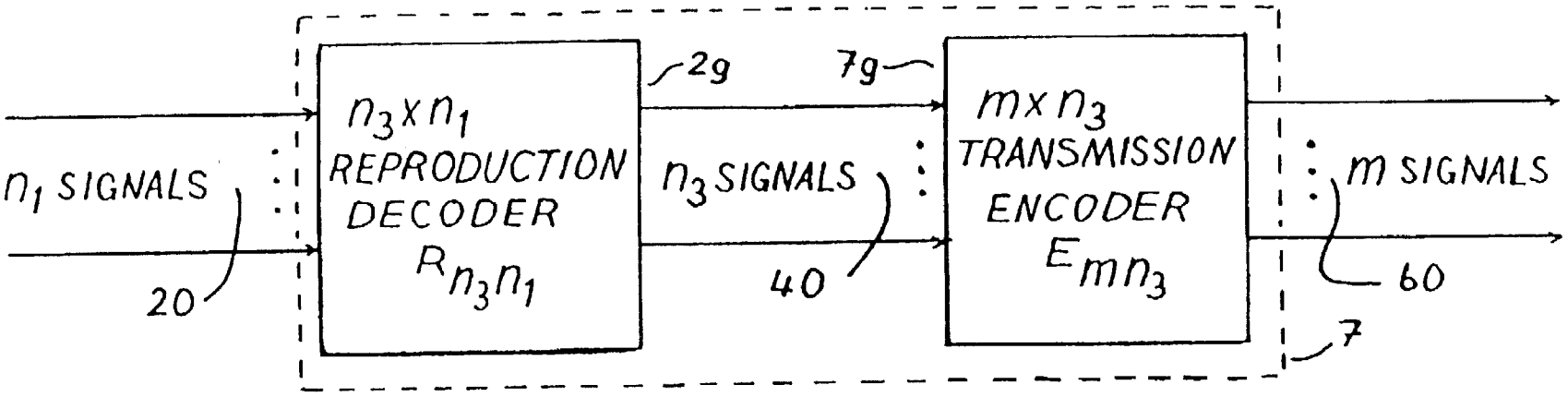
FIG. 12 shows a transmission encoder comprising the series connection of a reproduction decoder with another transmission encoder.

Also, as shown in FIG. 12, following an $n_3 \times n_1$ reproduction matrix decoder (2*g*) according to the invention described by an $n_3 \times n_1$ matrix $R_{n_3 n_1}$ by an $m \times n_3$ transmission matrix encoder (7*g*) described by an $m \times n_3$ matrix $E_{mn_3}$ according to the invention should, for $n_3$ greater than $n_1$ also constitute a transmission matrix encoder (7) according to the invention. In other words, FIG. 12 shows a composite transmission matrix encoder (7) described by an $m \times n_1$ matrix $E_{mn_1}$ consisting of the series connection of a reproduction matrix decoder (2*g*) and a transmission matrix encoder (7*b*) both in accordance with the invention, where $$E_{mn_1} = E_{mn_3} R_{n_3 n_1}.$$

Figure 13:
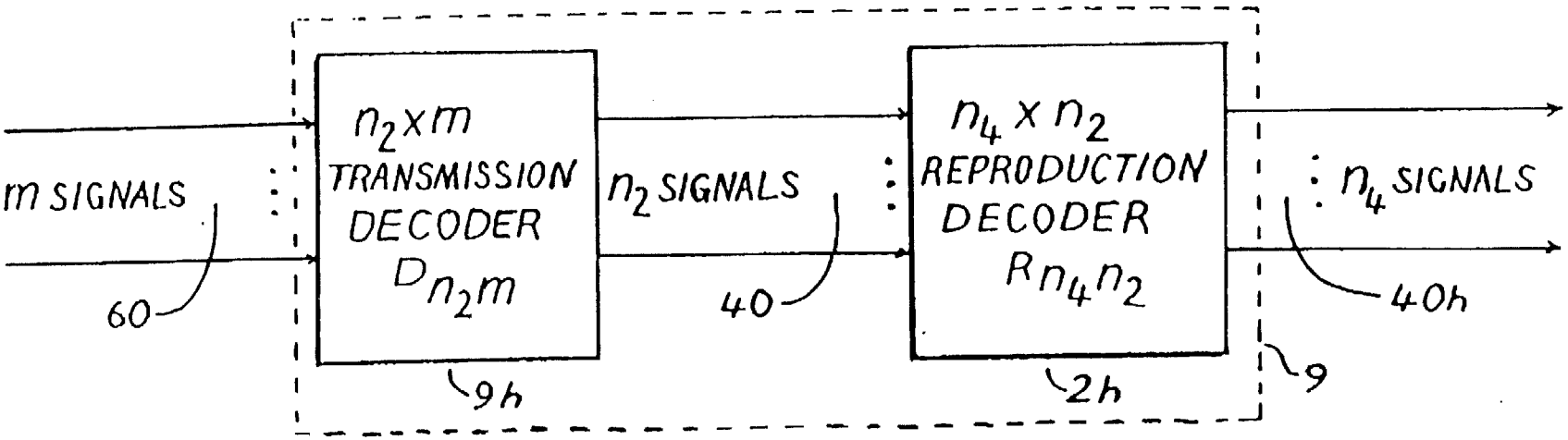

In a similar fashion, FIG. 13 shows how a composite transmission matrix decoder (9) in accordance with the invention may be constructed by a series connection of another transmission matrix decoder (9h) with a reproduction matrix decoder (2h) in accordance with the invention. An $n_1$×matrix transmission decoder (9h) described by an $n_1$×m matrix D is followed by an $n_4$×$n_1$ reproduction matrix decoder means (2h) described by an $n_4$×$n_2$ matrix $R_{n_4n_2}$ according to the invention, where $n_4$ is greater than $n_2$, and constitutes an $n_4$×m transmission matrix decoder (9) described by the $n_4$×m matrix $$D_{n_4m}=R_{n_4n_2}D_{n_2m}.$$

Figure 14:
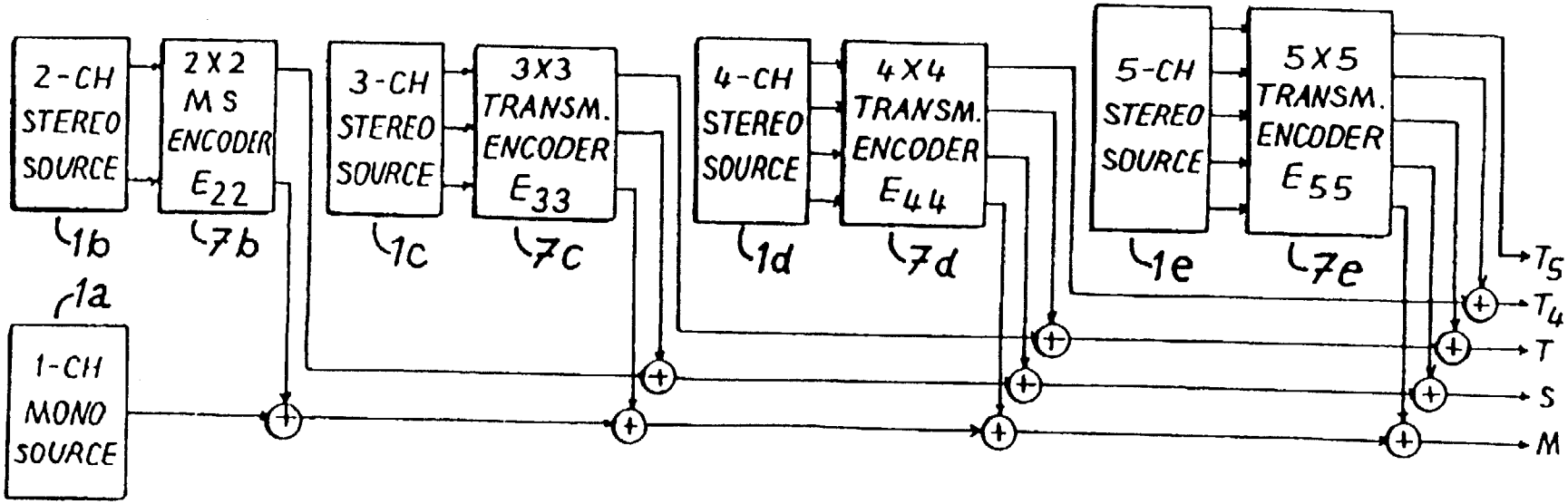
FIG. 14 is a schematic of a hierarchy of transmission encoders accepting signals intended for different pluralities of stereo loudspeakers.
Figure 15:
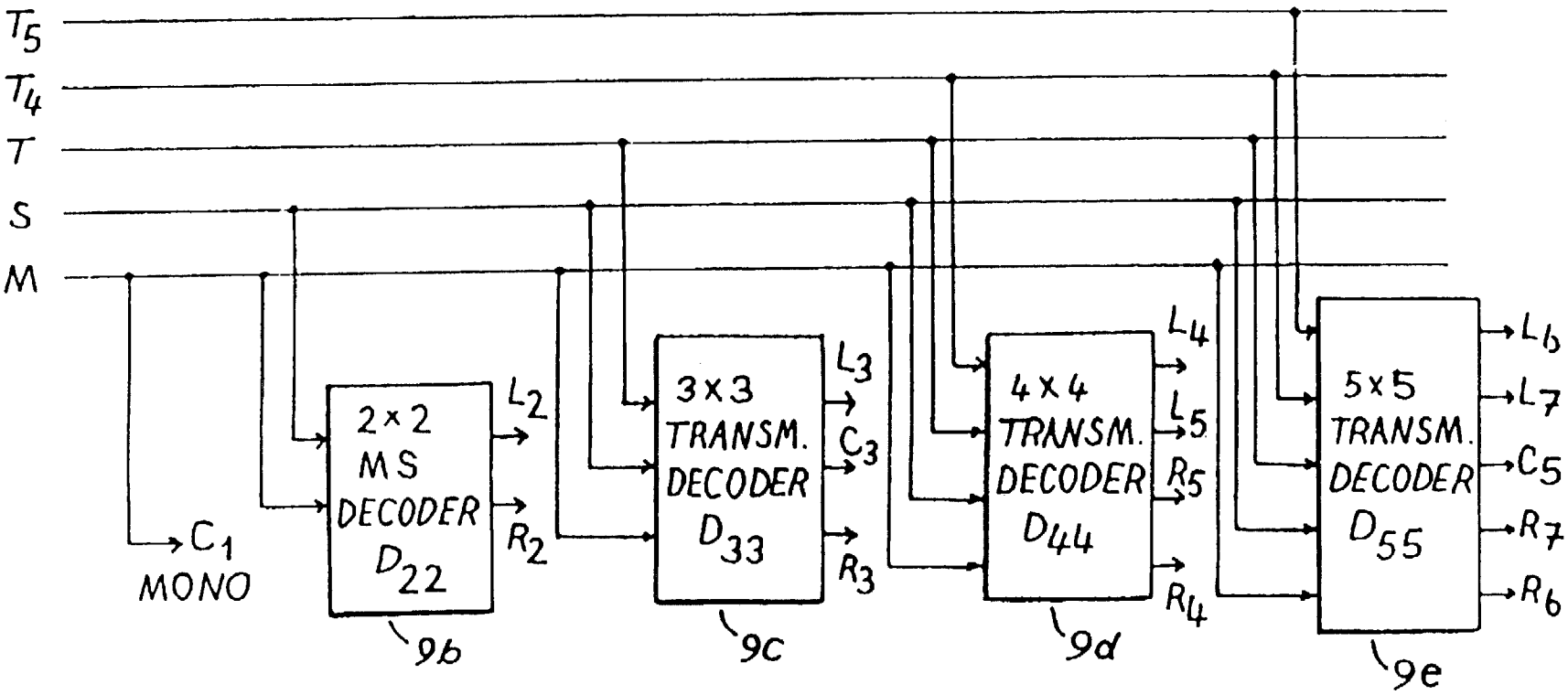
FIG. 15 is a schematic of the hierarchy inverse to that of FIG. 14 for decoding transmission signals into signals intended for any plurality of stereo loudspeakers.

Besides the above requirements on the transmission encoding and decoding matrices of a hierarchical system, a preferred form of the invention imposes the additional convenient requirement, illustrated in FIGS. 14 and 15, that n-channel loudpeaker signals may be encoded into n transmission channels for every first plurality n, and that the n+1 transmission channels required for (n+1)-speaker stereo transmission should be such that they constitute the n channels used for transmitting n-speaker stereo plus one additional transmission channel denoted $T_{n-1}$. FIG. 14 shows the schematic of such a hierarchical system of encoding transmission channel signals for n-speaker stereo sources (1a to 1e) including the monophonic n=1 case into transmission channels in MS form via respective encoder means (7b) to (7e) described by n×n matrices $E_{nn}$, where $T_1$=M, $T_2$=S and $T_3$=T for the transmission channel signals M, S and T defined earlier in this document with reference to 3-channel hierarchical encoding, and where $T_4$ and $T_5$ are used to convey additional signals for 4- and 5-speaker stereo respectively. FIG. 15 illustrates the corresponding inverse decoder hierarchy, where the respective n×n decoders (9b) to (9e) described by n×n matrices $D_{nn}$ derive n signals representative of loudspeaker feeds for n-speaker stereo from the transmission channel signals M, S, T, $T_4$ and $T_5$.

As in the case of FIG. 10, FIGS. 14 and 15 may be extended indefinitely to incorporate larger numbers n of channels. Versions of FIGS. 14 and 15 substituting the left/right signals $L=2^{-1/2}(M+S)$ and $R=2^{-1/2}(M-S)$ for signals in MS form are evident when transmission and reception compatible with 2-channel left/right signals are required.

If one has a knowledge of the (n+1)×n reproduction matrix decoder matrices $R_{n+1\ n}$ according to the invention, such as used in connection with FIG. 10 to construct $R_{n_2n_1}$ for arbitrary $n_2$ greater than $n_1$, then it is possible to undertake a systematic design procedure to construct a hierarchical system of encoding and decoding transmission channel signals of the preferred form described above, satisfying all matrix equations given and having the form shown in FIGS. 14 and 15. This design procedure will be described, and is summarised in the flow diagram of FIG. 16.

In general, the form of $E_{22}$ and $D_{22}$ is given by the conventional left/right or MS matrix encoding and decoding methods used in the prior art to transmit two-speaker stereo. Suppose, at any given stage of the design procedure, one has determined for every plurality n' up to and including a plurality n the form of the n'×n' decoding matrix $D_{n'n'}$ and the inverse n'×n' encoding matrices $E_{n'n'}=(D_{n'n'})^{-1}$. Given a known (n+1)×n reproduction matrix $R_{n+1\ n}$ for converting n-speaker stereo signals to (n+1)-speaker stereo signals according to the invention, the (n+1)×(n+1) decoder matrix $D_{n+1\ n'1}$ may be devised as follows. The first n columns of $D_{n+1\ n+1}$, representing the response to the first n transmission channels $T_1$ to $T_n$ form the (n+1)×n matrix $R_{n+1\ n}D_{nn}$, and the last column is chosen to be any convenient nonzero column vector that is not a linear combination of the first n columns. $E_{n+1\ n+1}$ is then computed as the inverse $(D_{n+1\ n+1})^{-1}$ of the decoding matrix. One then proceeds with the design by increasing the value of n by 1 and repeating the above steps.

The choice of the last column of $D_{n+1\ n+1}$ in the above design procedure is largely arbitrary, but is conveniently restricted further in preferred implementations. For example, if the matrices all have real frequency-independent entries, as is generally preferred, one can use the fact that, because preferred reproduction decoder matrices $R_{n+1\ n}$ preserve total signal energy, their columns are unit-length orthogonal vectors, and one can ensure that the matrices $D_{nn}$ are orthogonal matrices at each stage simply by constructing the last column of $D_{n+1\ n+1}$ at each stage to be that unit-length vector orthogonal to the other n columns, e.g. using the process of Gram-Schmidt orthogonalisation found in textbooks on matrix algebra. It may be shown that this yields a hierarchical encoding and decoding system in which the decoding matrices $D_{nn}$ are orthogonal, and in which the inverse n×n encoding matrices $E_{nn}=D_{nn}^{-1}$ may conveniently be computed as the transpose of $D_{nn}$, i.e. the matrix with entries $(d_{ji})$ where $D_{nn}$ has entries $(d_{ij})$. The 3×3 encoding and decoding matrices described earlier with $\phi'=\phi''$ and w'=k'=1 were examples of orthogonal encoding and decoding matrices derived by this procedure.

More generally, the last column of $D_{n+1\ n+1}$ can be chosen to meet the requirements of left/right symmetry, by ensuring that $T_{n+1}$ for odd n is a linear combination of signals only of the form $S_p$ in MS form, and that $T_{n+1}$ for even n is a linear combination of signals only of the form $M_p$ or $C_p$ in MS form.

Energy-Preserving Decoders

The design of $n_2$×$n_1$ reproduction matrix decoders according to the invention falls into two main parts: first imposing an objective requirement that the decoder should substantially preserve the total energy of stereo signals passing through them, apart from a possible overall gain and equalisation change affecting all signal components equally, and a second more subjective or psychoacoustic requirement that requires a substantially preserved or improved stereo directional effect. It is convenient first to deal with the energy preservation requirement.

The $n_2$×$n_1$ matrix $R_{n_2n_1}$ describing the reproduction matrix decoder preserves energy if and only if its $n_1$ columns are of unit length (i.e. the sum of the squares of the absolute values of the matrix coefficients in that column equals one) and the columns are pairwise orthogonal (i.e. the sum of the products of entries of one column with the complex conjugate of the corresponding entries of another is zero). In matrix language, this means that $R_{n_2n_1}$ is the first $n_1$ columns of an $n_2$×$n_2$ unitary matrix, or, if all entries have real values, of an $n_2$×$n_2$ orthogonal matrix.

The general form of n×n orthogonal matrices is known to mathematicians, and there is a ½(n−1)n-parameter family of such n×n orthogonal matrices describing rotations in n-dimensional space; all other orthogonal n×n matrices are obtained from these by reversing the sign of the entries of the last column. The product of any two orthogonal matrices is also orthogonal. Thus, using known results available in textbooks, there is no difficulty finding examples of energy-preserving matrices of the type required for the invention.

Specifically, it may be shown that all 2×2 orthogonal matrices have the explicit form $$\begin{pmatrix} \cos\phi & -\sin\phi \\ \sin\phi & \cos\phi \end{pmatrix} \text{ or } \begin{pmatrix} \cos\phi & \sin\phi \\ \sin\phi & -\cos\phi \end{pmatrix}$$

for an angle parameter $\phi$, and that all 3×3 orthogonal matrices have the explicit form of the rotation matrix $$\begin{pmatrix} a^2+(1-a^2)\cos\phi & ab(1-\cos\phi)+c\sin\phi & ac(1-\cos\phi)-b\sin\phi \\ ab(1-\cos\phi)-c\sin\phi & b^2+(1-b^2)\cos\phi & bc(1-\cos\phi)+a\sin\phi \\ ac(1-\cos\phi)+b\sin\phi & bc(1-\cos\phi)-a\sin\phi & c^2+(1-c^2)\cos\phi \end{pmatrix}$$

where $a^2+b^2+c^2=1$ and $\phi$ is an angle parameter describing the angle of rotation about the axis (a,b,c), or else have the above form with the signs of the last column reversed.

If A is an n×n orthogonal matrix and B is an m×m orthogonal matrix, then the (n+m)×(n+m) matrix $$\begin{pmatrix} A & 0 \\ 0 & B \end{pmatrix}$$

is also orthogonal. In the case of left/right symmetric reproduction decoders for left/right symmetric stereo loudspeaker layouts, the energy preserving matrices have an especially simple form when expressed in MS form, since sum signals (i.e. those of the form $M_p$ or $C_p$) must be converted into sum signals and difference signals (i.e. those of the form $S_p$) must be converted into difference signals by the reproduction matrix.

Thus an energy-preserving left/right symmetric 3×2 reproduction decoder matrix must satisfy the equations $$\begin{pmatrix} M_3 \\ C_3 \end{pmatrix} = \begin{pmatrix} \sin\phi \\ \cos\phi \end{pmatrix} (M_2)$$

and $$S_3=S_2,$$

whereas an energy-preserving left/right symmetric 4×3 reproduction decoder must satisfy equations of the form $$\begin{pmatrix} M_4 \\ M_5 \end{pmatrix} = \begin{pmatrix} \cos\phi_3 & -\sin\phi_3 \\ \sin\phi_3 & \cos\phi_3 \end{pmatrix} \begin{pmatrix} M_3 \\ C_3 \end{pmatrix}$$

and $$\begin{pmatrix} S_4 \\ S_5 \end{pmatrix} = \begin{pmatrix} \cos\phi_D \\ \sin\phi_D \end{pmatrix} (S_3),$$

where $\phi_3$ and $\phi_D$ are angle parameters.

An energy-preserving left/right symmetric 4×2 reproduction decoder matrix must satisfy equations of the form $$\begin{pmatrix} M_4 \\ M_5 \end{pmatrix} = \begin{pmatrix} \sin\phi_{42} \\ \cos\phi_{42} \end{pmatrix} (M_2)$$

and

-continued $$\begin{pmatrix} S_4 \\ S_5 \end{pmatrix} = \begin{pmatrix} \cos\phi_D \\ \sin\phi_D \end{pmatrix} (S_2),$$

where $\phi_{42}$ and $\phi_D$ are angle parameters; this is a composite decoder (such as shown in FIG. 9) built up out of the series connection of the above 3×2 and 4×3 decoders if $\phi_{42}=\phi-\phi_3$.

Figure 17:
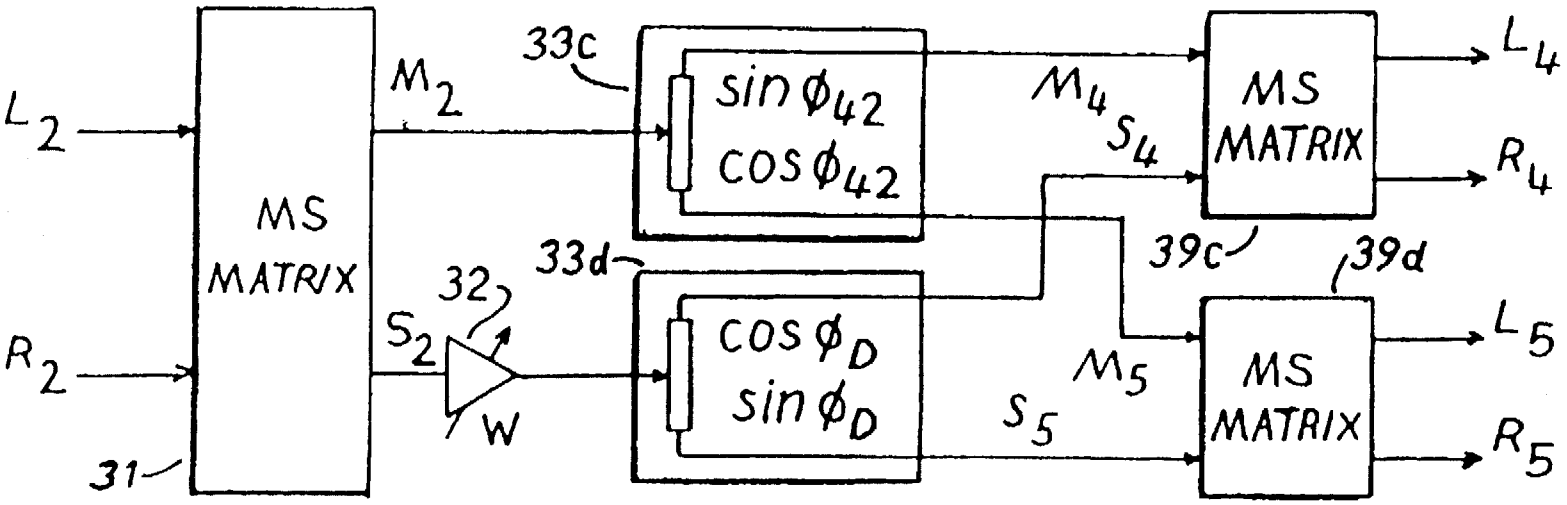
FIG. 17 shows a 4×2 matrix reproduction decoder according to the invention.

It will be recalled that FIG. 4 showed the form of an energy-preserving 3×2 reproduction decoder according to the equation given above. This form can be generalised to other pluralities of inputs and outputs. For example, FIG. 17 shows a 4×2 reproduction matrix decoding means in accordance with the invention and the above equations. Two-speaker stereo signals $L_2$ and $R_2$ are converted by input MS matrix means (31) into signals $M_2$ and $S_2$; $S_2$ may be passed through an optional width gain adjustment means (32); each of $M_2$ and $S_2$ is then passed into constant power or sine/cosine gain adjustment means, respectively (33*c*) and (33*d*). One output from each of these means (33) is passed to a first output MS matrix means (39*c*) to produce output signals $L_4$ and $R_4$, and the other outputs from each of the means (33) is passed to a second output MS matrix means (39*d*) to produce output signals $L_5$ and $R_5$. These output signals $L_4$, $L_5$, $R_5$, $R_4$ may be used to feed a four-speaker stereo loudspeaker arrangement such as that of FIG. 1*d*, via appropriate gain, equalisation, preamplification and amplification means. If desired, the angle parameters $\phi_{42}$ and $\phi_D$ associated with the respective sine/cosine gain adjustment means (33*c*) and (33*d*) may be made frequency-dependent by the methods already discussed in connection with means (33) of FIG. 5 in the 3×2 case.

Figure 18:
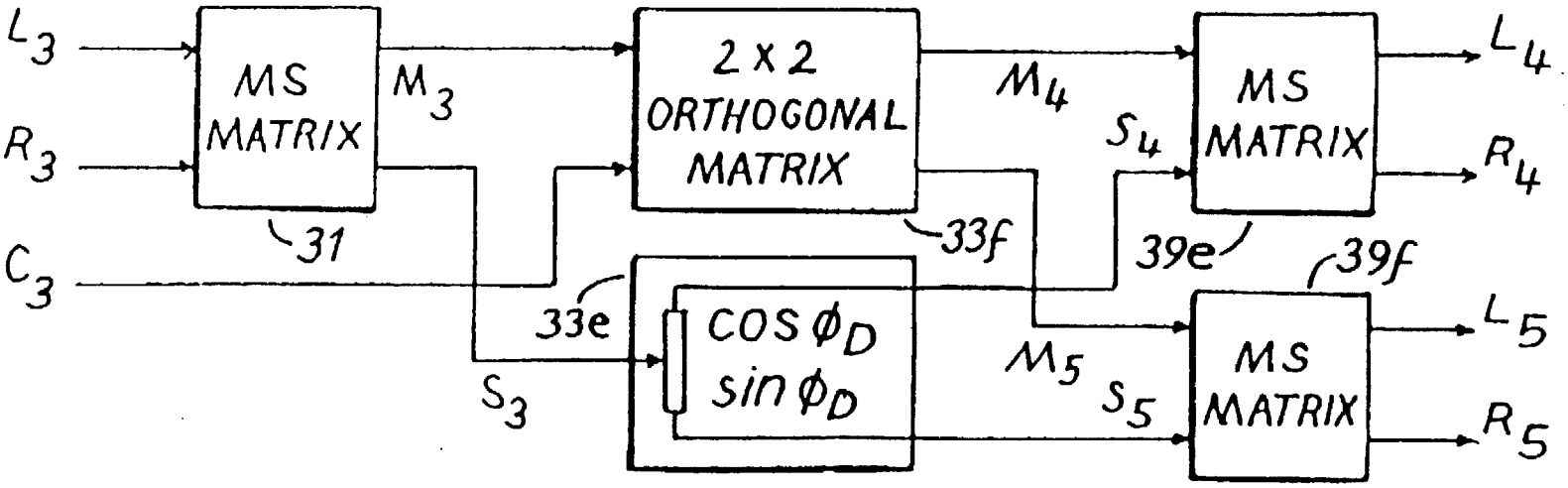
FIG. 18 shows a schematic of a 4×3 matrix reproduction decoder according to the invention.

FIG. 18 shows a 4×3 reproduction matrix decoding means in accordance with the above equations and the invention. Input signals $L_3$,$C_3$ and $R_3$ intended for three-speaker stereo reproduction are accepted as inputs; $L_3$ and $R_3$ are fed to an input MS matrix means (31) to derive signals $M_3$ and $S_3$; $S_3$ is passed into a constant-power or sine/cosine gain adjustment means (33*e*) to produce two output difference signals $S_4$ and $S_5$; $M_3$ and the input $C_3$ are passed into a 2×2 orthogonal rotation matrix means (33*f*) producing outputs $M_4$ and $M_5$; $M_4$ and $S_4$ are passed through a first output MS matrix means (39*e*) to produce signals $L_4$ and $R_4$, and $M_5$ and $S_5$ are passed through a second output MS matrix means (39*f*) to produce output signals $L_5$ and $R_5$. The signals $L_4$, $L_5$, $R_5$ and $R_4$ are suitable for providing feed signals for a four-speaker stereo arrangement such as that of FIG. 1*d*. As in connection with means (33) in FIG. 5, bandsplitting filter means can be used in association with means (33*e*) and (33*f*) to provide frequency-dependent values of the angle parameters $\phi_3$ and $\phi_D$ if these are desired.

Figure 19:
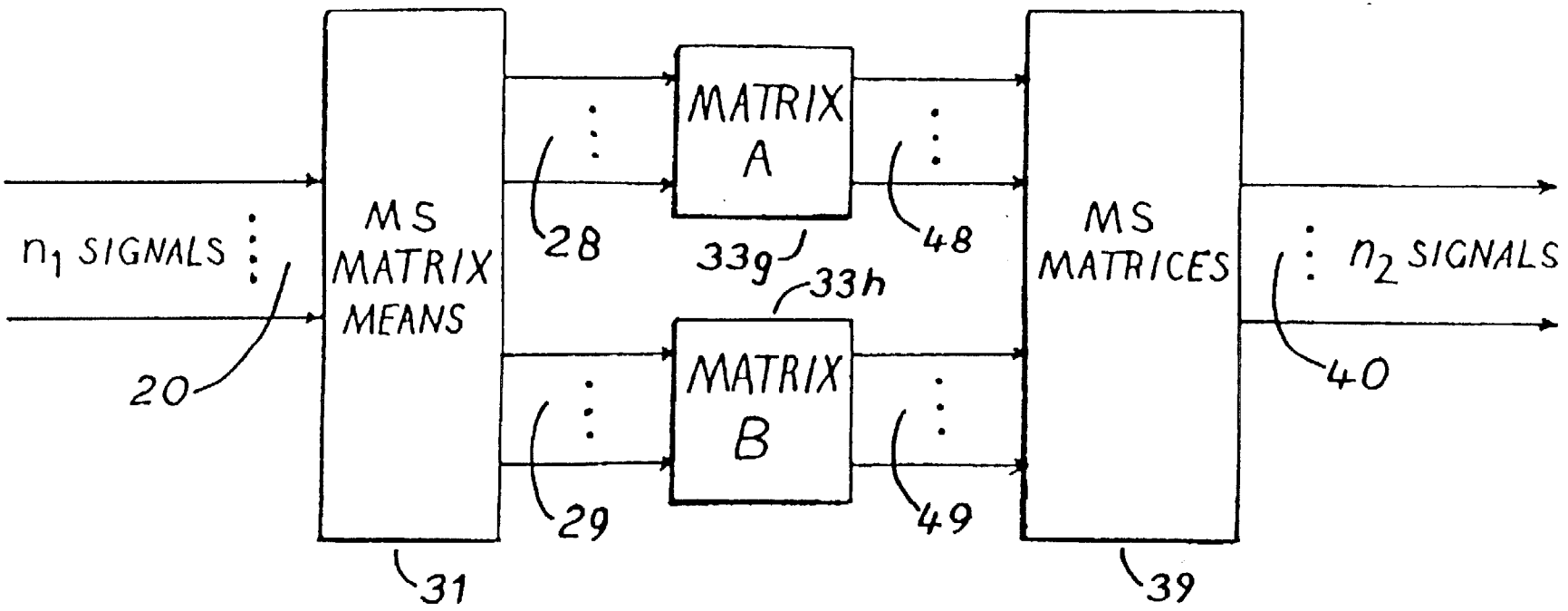
FIG. 19 shows a schematic of an $n_2 \times n_1$ matrix reproduction decoder according to the invention.

FIG. 19 shows one generic form of an energy-preserving left/right symmetric reproduction matrix decoding means according to the invention, generalising the special cases shown in FIGS. 4, 17 and 18. An input MS matrix means (31) converts a first plurality $n_1$ of loudspeaker feed signals (20) for $n_1$-speaker stereo into a number $n_{1'}$ equal to the integer part of ½$n_1$ of difference signals $S_p$ (29) and into another number $n_{1''}=n_1-n_{1'}$ of sum signals (28) of the form $M_p$ or $C_p$. The sum signals (28) are passed into a matrix A means (33*g*) giving a plurality $n_{2''}$ of output signals (48) whose total energy may substantially equal that of signals (28), and the difference signals (29) are passed into a matrix B means (33*h*) giving a number $n_{2'}$ (which equals $n_{2''}$ or $n_{2''}-1$) of output signals (49) whose total energy may substantially equal that of signals (29). The sum signals (48) and difference signals (49) are passed pairwise through output MS matrix means (39) to provide outputs (40) suitable for providing loudspeaker feed signals for $n_2$-speaker stereo, where $n_2=n_{2'}+n_{2''}$.

The matrix A and B means (33*g*) and (33*h*) may be frequency-dependent if desired by means similar to that used in connection with means (33) of FIG. 5 or by other means. Other implementations of energy-preserving left/right symmetric $n_2 \times n_1$ reproduction matrix decoders according to the invention not shown in FIG. 19 are possible, for example by separating and recombining the functions of the matrix means (31) (33*g*), (33*h*) and (39) in ways evident to those skilled in the art.

Other examples of $n_2 \times n_1$ reproduction matrix encoding equations in MS form can be given, which specify equations for the matrix A means (33*g*) and for the matrix B means (33*h*). By way of example, the 5×4 energy-preserving left/right symmetric equations have matrix A equations that can be parameterised in the form $$\begin{pmatrix} M_6 \\ M_7 \\ C_5 \end{pmatrix} = 2^{-1/2} \begin{pmatrix} a+\mu_1\cos\phi_4+\nu_1\sin\phi_4 & a-\mu_1\cos\phi_4-\nu_1\sin\phi_4 \\ b-\mu_2\cos\phi_4+\nu_2\sin\phi_4 & b+\mu_2\cos\phi_4-\nu_2\sin\phi_4 \\ c-\lambda\sin\phi_4 & c+\lambda\sin\phi_4 \end{pmatrix} \begin{pmatrix} M_4 \\ M_5 \end{pmatrix}$$

where a>0, b>0, c>0 and $a^2+b^2+c^2=1$ and $\phi_4$ is an angle parameter, and where $\mu_1=b(a^2+b^2)^{-1/2}$, $\mu_2=a(a^2+b^2)^{-1/2}$, $\nu_1=ac(a^2+b^2)^{-1/2}$, $\nu_2=bc(a^2+b^2)^{-1/2}$, and $\lambda=(a^2+b^2)^{1/2}$, and matrix B equations of the form $$\begin{pmatrix} S_6 \\ S_7 \end{pmatrix} = \begin{pmatrix} \cos\phi_5 & -\sin\phi_5 \\ \sin\phi_5 & \cos\phi_5 \end{pmatrix} \begin{pmatrix} S_4 \\ S_5 \end{pmatrix},$$

where $\phi_5$ is an angle parameter. If equal signals are fed to all four speakers of the 4-speaker arrangement, a, b, and c determine the relative energies reproduced via the 5-speaker arrangement.

In a similar way, the 6×5 energy-preserving left/right reproduction decoder matrix equations in MS form give 3×3 orthogonal-matrix "matrix A" equations and 3×2 "matrix B" equations using a matrix that is the first two columns of a 3×3 orthogonal matrix. These equations are characterised by a total of six free parameters.

Directional Psychoacoustics

The theoretical methods necessary to ensure the correct subjective stereo directional effect from the invention are now summarised, so that the methods of determining the optimum values of the free parameters in the equations for energy-preserving decoders can be given.

Figure 20:
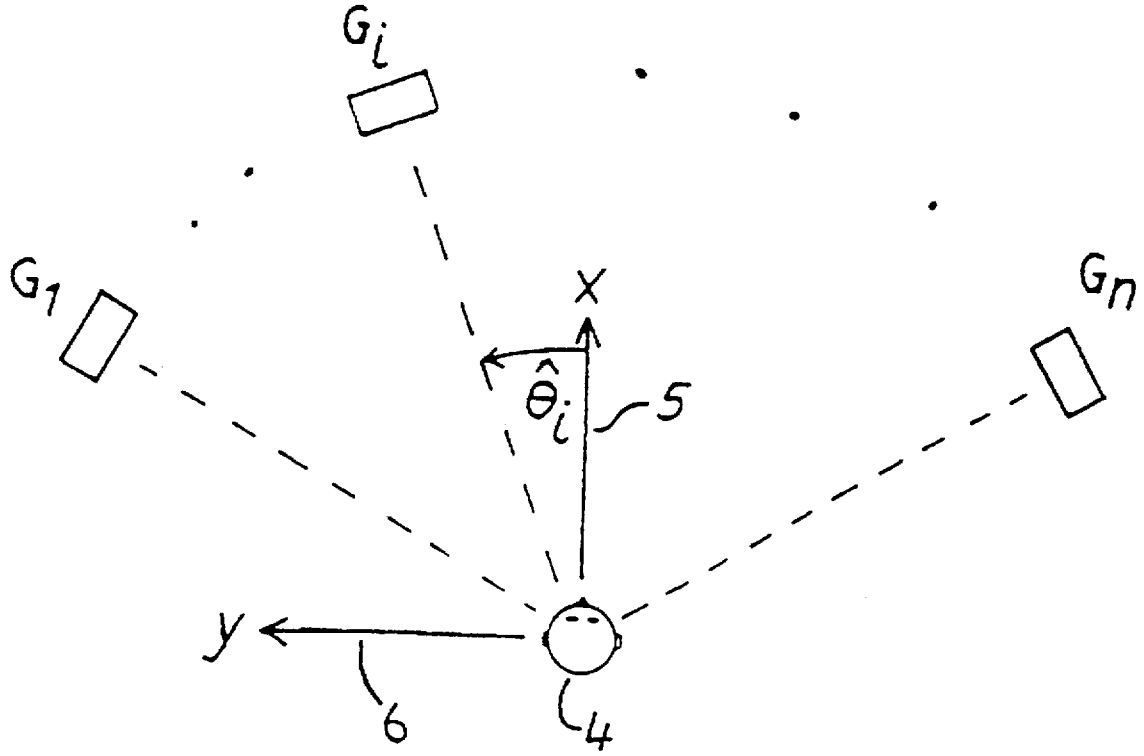
FIG. 20 shows rectangular and angular coordinates of loudspeakers with respect to a listener.

FIG. 20 shows an arrangement of loudspeakers all situated at an identical distance from a listener (4) situated at an ideal listening position. Let there be a plurality n of loudspeakers numbered by an index subscript i=1 to n, and let a given source sound be reproduced from the i'th loudspeaker with a gain $G_i$ that in general may be frequency-dependent and complex-valued. Denote the absolute value of a complex quantity Z by |Z|, its real part by ReZ, and the real coefficient of its imaginary part by ImZ.

Then for the stated sound source, the pressure gain at the listener (4) is proportional to $$P=\sum_{i=1}^{n} G_i$$

and the energy gain at the listener (4) is proportional to $$E=\sum_{i=1}^{n} |G_i|^2.$$

Let the (notional) forward direction (5) at the listener (4) be the x-axis and the (notional) left direction (6) be the y-axis of rectangular coordinates, and let directions around the listener (4) be measured as angles $\hat{\theta}$ measured anticlockwise (i.e. towards the y-axis) from the x-axis, as shown in FIG. 20. Then the velocity gain for the above sound source is defined as the vector quantity $v=(v_x, v_y)$ whose respective components along the x- and y-axes are $$v_x=\sum_{i=1}^{n} G_i\cos\theta_i$$

$$v_y=\sum_{i=1}^{n} G_i\sin\theta_i,$$

where $\hat{\theta}_i$ is the directional angle of the i'th loudspeaker as shown in FIG. 20. The sound intensity gain for the above sound source is the vector quantity $e=(e_x, e_y)$ whose respective components along the x- and y-axes are $$e_x=\sum_{i=1}^{n} |G_i|^2\cos\Theta_i$$

$$e_y=\sum_{i=1}^{n} |G_i|^2\sin\Theta_i.$$

According to energy-vector sound localisation theories, the quality and direction of sound localisation of the listener is largely determined by the magnitude $r_E$ and direction angle $\theta_E$ of the ratio $(e_x/E, e_y/E)$ of the sound-intensity gain vector to the energy gain; $r_E$ and $\theta_E$ may be computed from the equations $$r_E\cos\theta_E=e_x/E$$

$$r_E\sin\theta_E=e_y/E$$

where $r_E \geqq 0$, by rectangular-to-polar coordinate conversion. $\theta_E$ represents the apparent sound direction when a listener faces the apparent sound source, especially at frequencies between around 700 Hz and 5 kHz, where localisation is largely determined by interaural intensity ratios. This direction is the direction along which the sound intensity gain vector points. The quantity $r_E$, termed the energy vector magnitude, equals 1 for natural sound sources, but is less than 1 for sounds emerging from more than one loudspeaker, and is useful for describing the stability of the illusory sound image as a listener changes position.

It is desirable for stable and natural sound localisation quality that $r_E$ be as close to the ideal value 1 as possible. As an empirical rule of thumb, the degree of unwanted image movement as a listener moves from the ideal position is roughly proportional to $1-r_E$, so that $r_E=0.95$ gives about one-third of the degree of image movement given by $r_E=0.85$.

At low frequencies below around 700 Hz for central listeners (4), localisation is largely determined by the vector ratio $(v_x/P, v_y/P)$ of the velocity gain vector to the pressure gain. In general, this vector has complex entries, but the main localisation direction according to interaural phase sound localisation theories is determined by its real part $$(Re(v_x/P), Re(v_y/P)).$$

Similarly to the energy case above, we define the velocity vector magnitude $r_V \geqq 0$ and velocity direction angle $\theta_V$ for velocity-vector localisation by $$r_V \cos \theta_V = Re(v_x/P)$$

$$r_V \sin \theta_V = Re(v_y/P).$$

Ideally for natural sound localisation quality, the velocity vector magnitude $r_V$ should have a value close to one, with values much larger than or much smaller than one resulting in image instability when the listener's head is rotated. The direction $\theta_V$ is often known as the "Makita localisation" direction, named after an author who introduced this localisation parameter. The Makita direction $\theta_V$ describes the apparent localisation at low frequencies below around 700 Hz according to interaural phase localisation theories if the listener faces the apparent sound source. Ideally, the Makita direction $\theta_V$ should be similar to the energy vector direction $\theta_E$ for sharp images.

The imaginary part $(Im(v_x/P), Im(v_y/P))$ of the velocity ratio vector, termed the "phasiness vector" mainly affects the subjective quality of an image, rather than its apparent direction, imparting a generally unpleasant quality often termed "phasiness", which also manifests itself in image broadening. Ideally, the magnitude of the phasiness vector should be kept as small as possible, preferably having a length less than 0.2. In most preferred implementations of the present invention, the relative values of matrix coefficients normally depart from real values only by small amount, and such departures are largely confined to transition frequency bands, so that phasiness effects for an ideally situated listener are usually adequately small and may be ignored.

In the case that the phasiness magnitude is small, it is generally true that the Makita direction $\theta_V$ substantially coincides with the direction in which the velocity gain vector of a signal is pointing, so that these two directions may be used interchangeably.

For any known signal gains $G_i$ fed to the n loudspeakers, a computation of the four localisation parameters $r_V$, $r_E$, $\theta_V$ and $\theta_E$ can be performed using the above equations for any predetermined loudspeaker arrangement all equidistant from an ideal listening position (4) for any predetermined loudspeaker signal feeds, including those derived from a decoder matrix. These four parameters give a good indication of the quality, direction and stability of the associated images across a broad listening area.

According to the invention, a reproduction matrix decoding means accepting a first plurality $n_1$ of loudspeaker feed signals intended for a first stereophonic arrangement of $n_1$ loudspeakers across a sector of directions should give a larger plurality $n_2$ of output signals intended to feed $n_2$ loudspeakers in a second stereophonic arrangement across a second sector of directions in such a manner that the four localisation parameters are either substantially preserved in value or "improved", by, for example covering a different sector of directions (providing typically a wider image) or greater image stability in those directions for which image stability was poor in the original intended stereo reproduction. In order to determine whether a decoder meets these aims, it is necessary to compute the localisation parameters $r_V$, $r_E$, $\theta_V$ and $\theta_E$ both for sounds via the originally intended loudspeaker arrangement and via the finally intended arrangement after passage through the $n_2 \times n_1$ matrix decoder.

Ideally, the values of $r_V$ and $r_E$ should either be maintained or made closer to 1 by the matrix decoder reproduction, and the values of the reproduced image directions $\theta_V$ and $\theta_E$ should be substantially preserved. In practice, it is not always possible to maintain the values of $r_E$ and $r_V$ completely, and it is not always possible, and often not desirable, to accurately maintain the angular dispositions of $\theta_V$ and $\theta_E$.

In particular, it may be desired to reproduce a stereophonic recording originally intended to cover a first sector of directions of angular width $\theta_I$ via a second sector of directions covering a different angular width $\theta_O$ at the listener. Thus a simple proportional widening of the angular dispositions of stereo sound localisation directions is often desired or acceptable. In general, if the angular width is widened by a factor k, then the value of $1-r_E$ is typically increased by a factor $k^2$, and similarly for k less than one.

Since in the originally intended stereo reproduction, the angular dispositions of $\theta_V$ and $\theta_E$ may not accurately match, in general it is acceptable according to the invention if the final apparent directions $\theta_V$ and $\theta_E$ of velocity and sound intensity localisation are substantially proportional, possibly by different respective constants $k_V$ and $k_E$, to the original reproduced directions $\theta_V$ and $\theta_E$, i.e. if one substantially has $$\theta_V = k_V \theta_V$$

and $$\theta_E = k_E \theta_E.$$

In practice, small variations of the constants $k_V$ and $k_E$ for different directions across the stereo stage are acceptable providing that this does not produce significantly noticable angular distortion of sound images; for example this will generally be acceptable provided that the reproduced angular dispositions do not differ by more than 4° or 5° from those given by strict constants of proportionality.

Two-Channel Stereo Localisation

The application of the above localisation theory to the invention in the case of a 3×2 reproduction matrix decoder of the type described with reference to FIG. 4 will now be described. Consider a two-speaker stereo signal $L_2$ and $R_2$ where a sound is encoded into the two channels with respective gains $G_1=\cos(45°-\theta)$ and $G_2=\cos(45°+\theta)$, by the use, for example of a panpot positioning device or the use of spatially coincident directional microphones. The parameter $\theta$, which we term the "panpot angle" describes the intended stereo position of a sound, being at the left loudspeaker for $\theta=45°$, at the centre for $\theta=0°$, and at the right loudspeaker for $\theta=-45°$, with intermediate values corresponding to intermediate positions.

Figure 21:
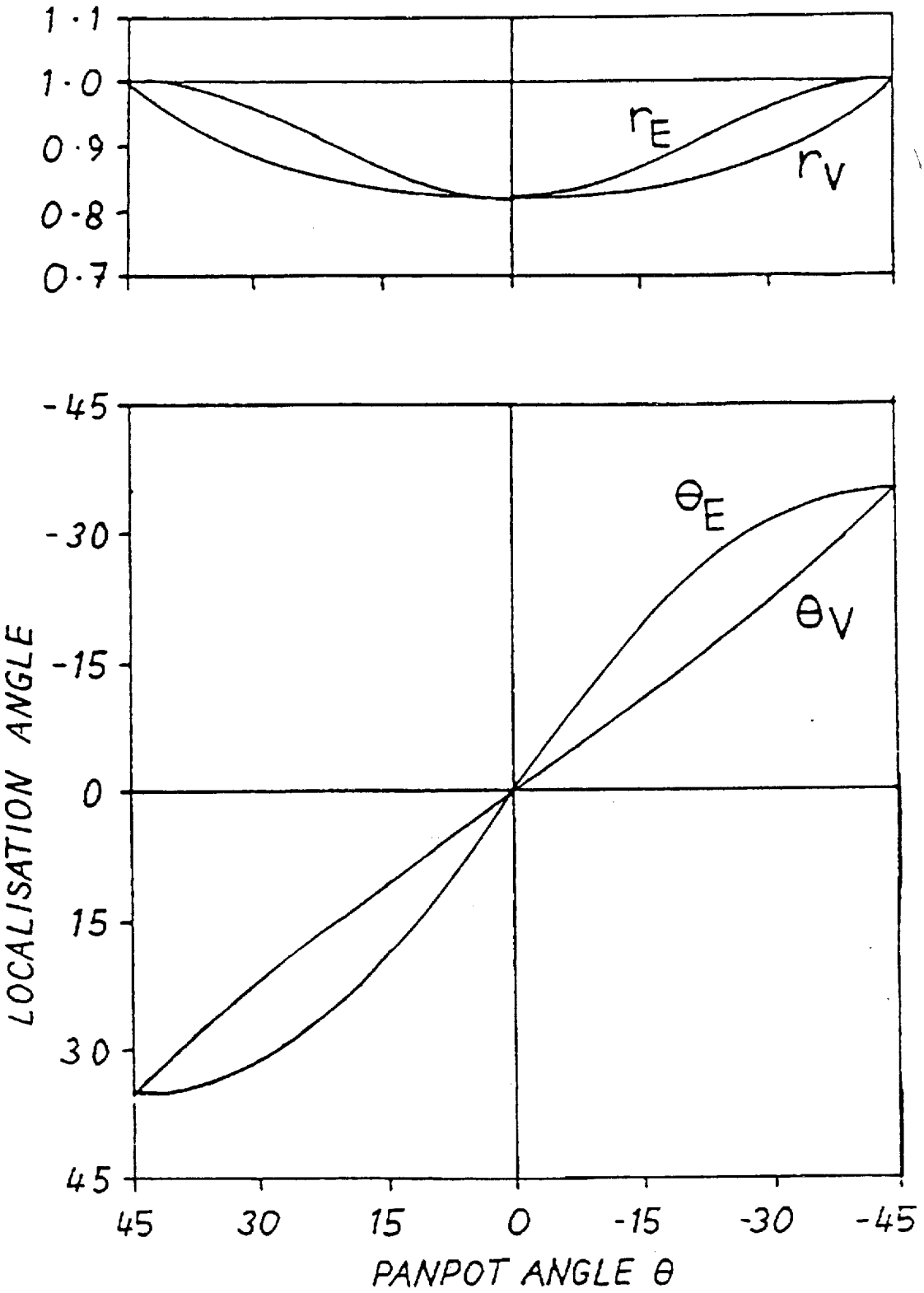
FIGS. 21 to 25 show graphs of parameters describing the localisation quality of stereo images for reproduction via two loudspeakers (FIGS. 21 and 22) and of two-channel stereo via 3×2 matrix reproduction decoders (FIGS. 23 to 25).

FIG. 21 shows graphically the values of the localisation parameters $r_V$, $r_E$, $\theta_V$ and $\theta_E$ plotted against the panpot angle $\theta$ when reproduction is via the two-speaker arrangement of FIG. 1*b* when $\theta_2=35°$, computed using the equations given above. It will be seen that generally $\theta_E$ does not equal $\theta_V$ except for centre and extreme left and right positions, being larger, and that $\theta_E$ is about twice $\theta_V$ for images near the centre: this angular discrepancy gives poor image quality for conventional two-speaker stereo. Additionally, near the centre of the stereo stage, $r_V$ and $r_E$ dip to values significantly less than one, resulting in poor image stability.

Figure 22:
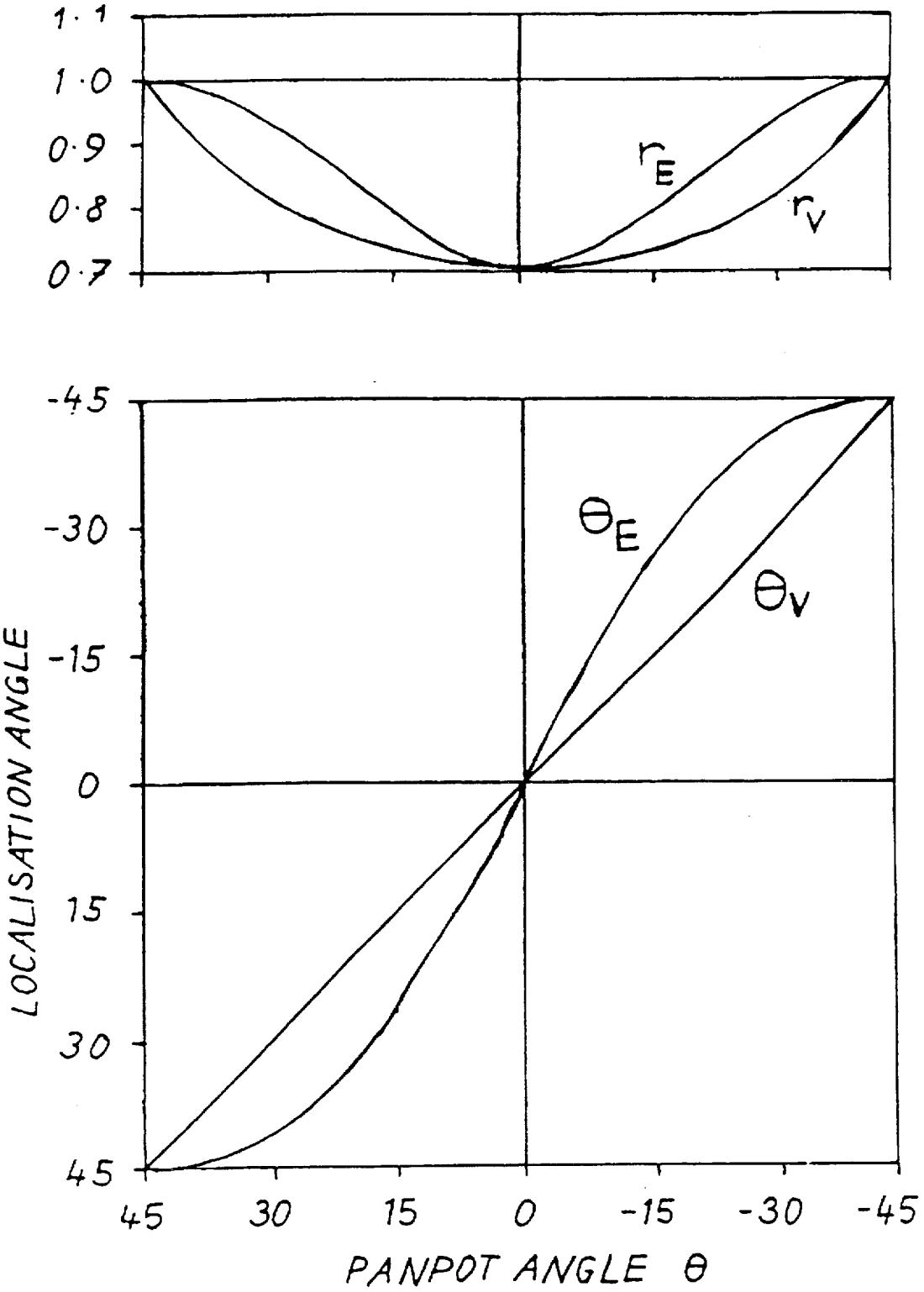
Figure 23:
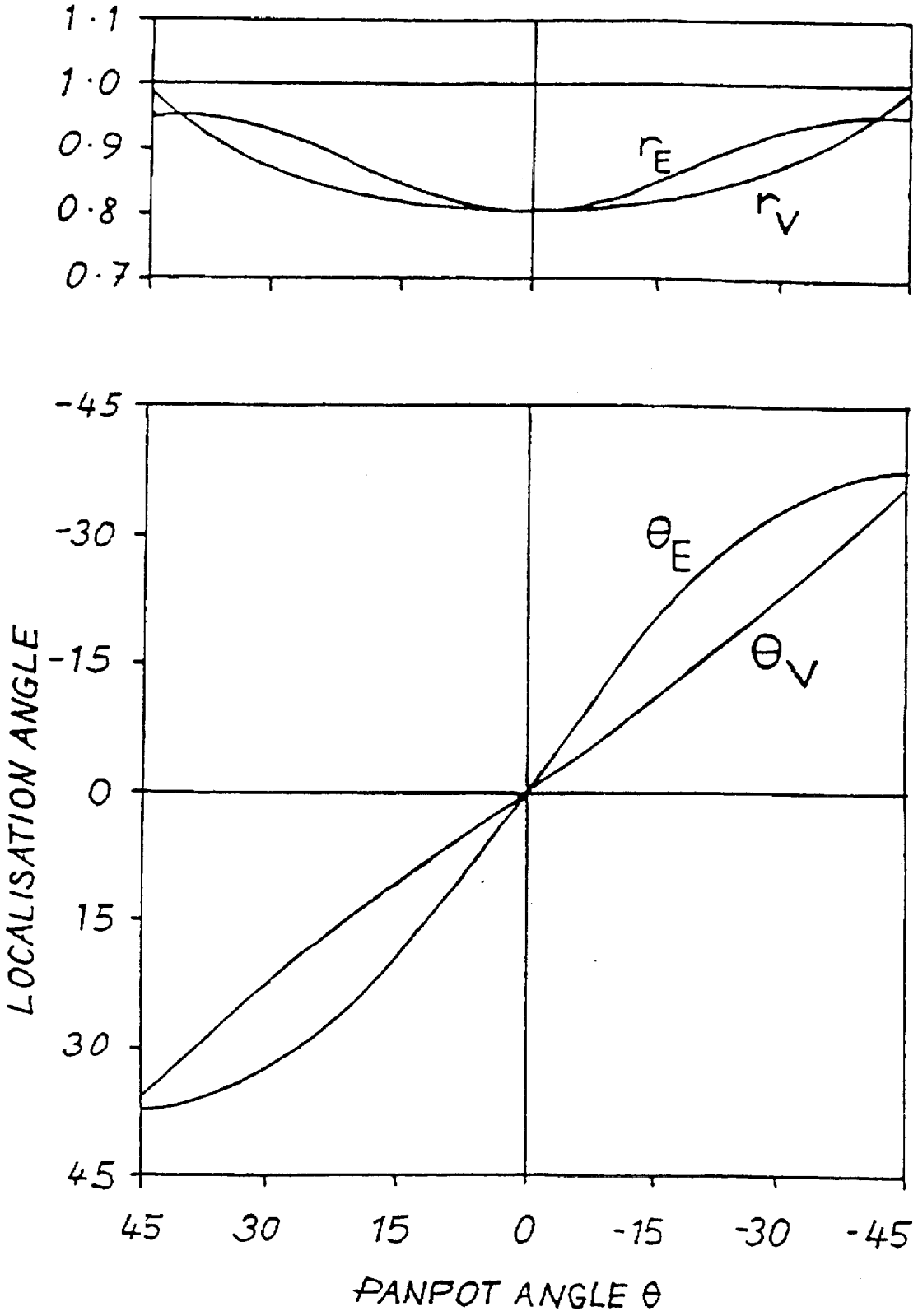
Figure 24:
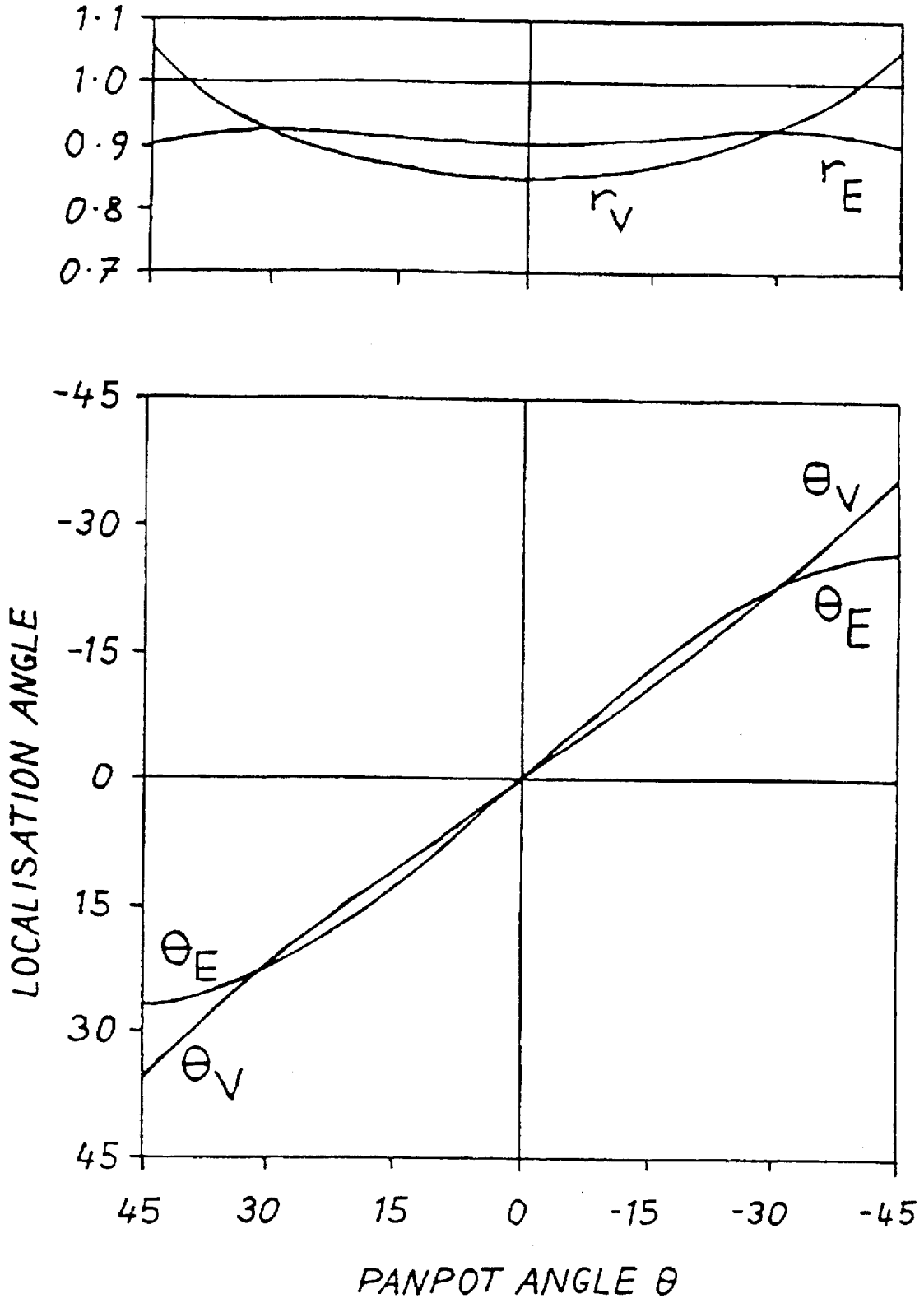
Figure 25:
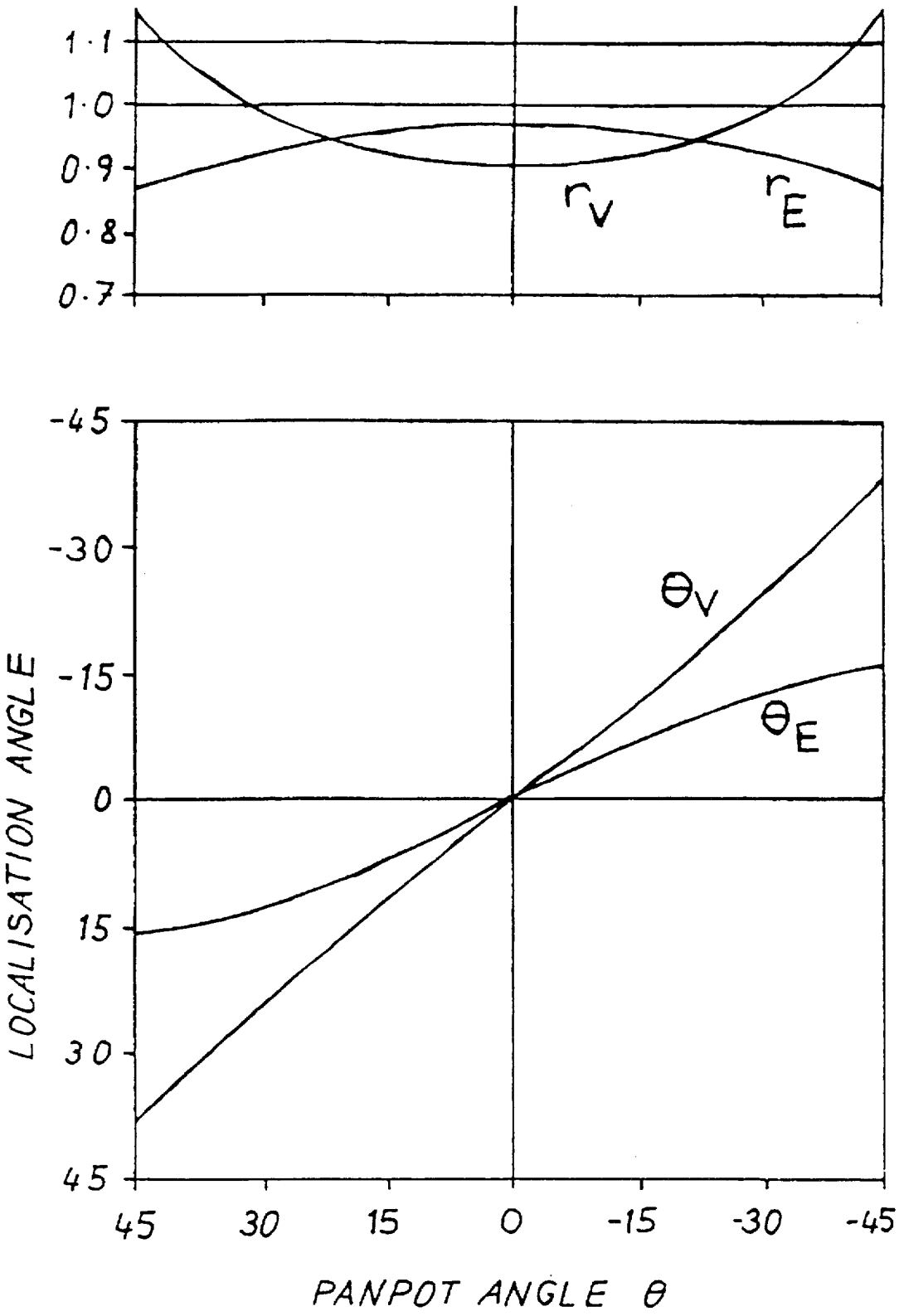

FIGS. 22 to 25 show the localisation parameters when the two-channel stereo signal is fed via a 3×2 reproduction matrix decoder for various angle parameters $\phi$ according to FIG. 4 (where the width is set to w=1) to the three-loudspeaker layout of FIG. 1c when $\theta_3=45°$. FIG. 22 shows 3-speaker reproduction for $\phi=90°$, i.e. when the centre-speaker feed is zero and so the reproduction is via two loudspeakers with $\theta_2=45°$. This gives similar results to FIG. 21 except that the angular width is larger and the deviations of $r_V$ and $r_E$ from one also larger. FIGS. 23 to 25 show reproduction for the respective values $\phi=54.74°$, $\phi=35.26°$ and $\phi=19.47°$. It will be noted that $\theta_E$ becomes progressively smaller as $\phi$ decreases, but that $\theta_V$ remains substantially similar.

However, comparison with FIG. 21 shows that the reproduced localisation angles remain substantially proportional to those given by two-speaker stereo for all values of the angle parameter $\phi$ between 0° and 90°, so that the decoder of FIG. 4 meets the requirements of the invention in its second aspect.

These computations reveal that the case $\phi=50.36°$ gives almost exactly the same localisation angles $\theta_V$ and $\theta_E$ as two-speaker stereo as shown in FIG. 21, and that $r_V$ is also almost unchanged, with $r_E$ being slightly smaller at the extreme left and right but otherwise also being broadly similar; thus a 3-speaker decoder with $\phi=50.36°$ substantially preserves the localisation qualities of 2-speaker stereo, including its defects.

As $\phi$ is reduced to 35.26°, as shown in FIG. 24, the values of $r_E$ and $r_V$ for central images become closer to one, giving improved image stability, and $r_E$ is almost constant across the whole sound stage, giving roughly the same degree of image stability at all panpot angle positions. Moreover, $\theta_V$ and $\theta_E$ become substantially equal across most of the stereo stage, giving improved image quality. Only near the extreme left and right positions does $\theta_E$ become too narrow. The localisation parameters shown in FIG. 24 explain why $\phi$ around 35° is generally preferred, but why it still has too narrow a reproduced stage.

Reducing $\phi$ to 19.47°, as shown in FIG. 25, results in $\theta_E$ being reproduced too narrowly even for near-centre images, although the central values of $r_V$ and $r_E$ become quite close to one, giving good centre-image stability. However, the poor edge-of-stage values of $r_E$ indicate poor edge-of-stage stability.

The fact that all values of $\phi$ retain noticably imperfect localisation parameters for some image positions explains why the use of a frequency-dependent decoder, such as those of FIGS. 5 or 8, is found particularly desirable for decoders operating from a two-channel stereo input.

Preservation Decoders

There are two main aims one can design an $n_2 \times n_1$ reproduction matrix decoder to satisfy from a stereo localisation point of view. On the one hand, one can aim to preserve the angular dispositions of the velocity and sound intensity vectors originally intended, to within a single overall constant of proportionality to take account of altered stage width. A decoder of this type will be termed a "preservation decoder", and will also tend to preserve other localisation qualities indicated by $r_V$ and $r_E$. As we have seen above, the $\phi=50.36°$ 3×2 decoder is a preservation decoder in this sense, and also preserves all the defects of two-speaker stereo.

The other, less well defined, aim is to improve the reproduced illusion. In general this may mean using different values of the constants $k_V$ and $k_E$ of proportionality so as to make the reproduced directions $\theta_V$ and $\theta_E$ substantially equal for the majority of reproduced directions, as did the $\phi=35.26°$ 3×2 decoder as shown in FIG. 24. Also, one might use a reproduction decoder that increases the value of $r_E$ for directions for which it is particularly different from one, perhaps at the expense of decreasing $r_E$ somewhat for other directions, as shown for example in FIG. 24; such an "improvement decoder" might, for example, be designed to ensure that $r_E$ is roughly constant for all directions.

While the intention behind "preservation decoders" is fairly well defined, that for "improvement decoders" generally involves a trade-off between conflicting psychoacoustic requirements, and so is somewhat less well defined. However, extensive computations of the reproduced localisation parameters of many different reproduction decoders has revealed that all reasonable improvement decoders have decoding parameters that do not differ very greatly from those for preservation decoders, so that once the problem of designing preservation decoders has been solved, only small adjustments of parameters are required for improvement decoders.

In principle, the design of preservation decoders is extremely laborious, since it involves calculating the localisation parameters for a large variety of $n_1$-speaker stereo feed signals, and then for each possible value of the energy-preserving $n_2 \times n_1$ decoder matrix parameters, to compute the localisation parameters of the resulting signals. One then needs to find which decoder parameters substantially preserve the desired localisation parameters. Such a search is not difficult for 3×2 decoders involving only the one free parameter $\phi$, but becomes difficult in more complicated cases, and the search needs to be done again for each possible first and second stereophonic arrangement of loudspeakers. The localisation parameters $r_V$, $r_E$, $\theta_V$ and $\theta_E$ are highly nonlinear functions of the decoder matrix, and there are also many possible speaker gains $G_i$ for the $n_1$-speaker stereo signals that might be used to create a stereo directional effect.

However, we have found various patterns that reduce this design procedure to manageable proportions. First we need only investigate cases where $n_2=n_1+1$, since other cases can be derived by cascading such decoders as noted earlier in connection with FIGS. 9 and 10. Secondly, we have found that the matrix equations of preservation decoders only varies slightly as the total angular width of a loudspeaker layout is varied, providing that the relative values of inter-speaker angles remain unaltered. Thirdly, we have also found that the preservation decoder matrices are relatively insensitive to small variations in the relative interspeaker angles within a stereophonic arrangement, so that we may assume for the purposes of designing decoding matrices that the angles between all adjacent pairs of loudspeakers within an arrangement are identical.

Thus, apart from a small 'fine tuning' of decoding matrix parameters, we may confine the investigations to the cases shown in FIGS. 1b to 1e and the illustrative reference values $\theta_2=35°$, $\theta_3=45°$, $\theta_4=50°$, $\theta_6=54°$, $\theta_7=27°$ and $\theta_5=16\frac{2}{3}°$. Another problem, as noted earlier, is that there are many possible stereophonic signals that may be fed to $n_1$ loudspeakers, derived according to many different recording and mixing techniques, and one has the difficulty of choosing broadly representative signals for performing the calculation of localisation parameters. The gain coefficients $G_i$ of a stereo sound via $n_1$ loudspeakers form a vector $(G_1, \ldots, G_{n_1})$ in an $n_1$-dimensional space, and the possible set of such gains representing stereo signals covers a region in this $n_1$-dimensional space. One wishes to calculate the values of the reproduced localisation parameters for a representative set of points that broadly cover this region.

In practice, we have found that the following choice is a good one: One chooses the following $n_1$-speaker stereo signal gains. Choose signals intended for reproduction from just one of the loudspeakers, i.e. isolated loudspeaker feed signals, for which $\theta_V=\theta_E=\hat{\theta}_i$ and $r_V=r_E=1$, and also choose signals intended for reproduction over pairs i and j of loudspeakers with equal polarity and gain, for which $\theta_V=\theta_E=\frac{1}{2}(\hat{\theta}_i+\hat{\theta}_j)$ and $r_V=r_E=\cos\frac{1}{2}(\hat{\theta}_i-\hat{\theta}_j)$. By substantially preserving the intended localisation parameters of these stereophonic signals, it is found that the localisation properties of other stereo signals is also substantially preserved These $\frac{1}{2}n_1(n_1+1)$ stereo test signals are also useful for assessing the localisation properties of "improvement decoders".

For these signals, the velocity and energy localization parameters are identical, and in particular $\theta_V=\theta_E$, because all gains $G_1$ are 0 or 1, so that $G_i=|G_i|^2$. One therefore seeks $(n_i+1)\times n_1$ energy-preserving reproduction matrices $R_{n_1+1\ n_1}$ such that the reproduced direction parameters $\theta_V$ and $\theta_E$ are equal for these specific signals. There are $\frac{1}{2}n_1(n_1+1)$ free parameters describing the energy-preserving $(n_1+1)\times n_1$ matrices, so that this system of nonlinear equations $\theta_V=\theta_E$ for the $\frac{1}{2}n_1(n_1+1)$ test signals should determine the decoder matrix. While these equations are highly nonlinear, they can be solved numerically on a computer by numerical hill-climbing methods of solving systems of nonlinear equations.

In the case of left/right symmetry, the size of the system of equations is reduced. For example, when $\hat{\theta}_i=0$, the corresponding $\theta_V$ and $\theta_E$ both equal 0, and for pair-of-speaker signals with $\hat{\theta}_i=-\hat{\theta}_j$, left/right symmetry also ensures that $\theta_V=\theta_E=0$, where by convention the axis of symmetry is in the 0° direction. Additionally, if $\theta_V=\theta_E$ for a test signal, this condition also holds for the mirror-image test signal.

For example, for $n_1=2$, one needs only to find that 3×2 decoder angle parameter $\phi$for which $\theta_V=\theta_E$ for the respective $L_2$ and $R_2$ gains 1 and 0. For $n_1=3$, we must find those values of the decoder parameters $\phi_3$ and $\phi_D$ for which $\theta_V=\theta_E$ for the respective ($L_3$, $C_3$, $R_3$) gains (1,0,0) and (1,1,0); for $n_1=4$ we must find those values of the 5×4 decoder matrix parameters a,b,c, $\phi_4$ and $\phi_5$, where $a^2+b^2+c^2=1$, for which for the respective ($L_4$,$L_5$,$R_5$,$R_4$) gains (1,0,0,0), (0,1,0,0), (1,1,0,0) and (1,0,1,0), and for $n_1=5$, one must find the values of the six free parameters of the energy-preserving left/right symmetric 6×5 decoder matrix for which $\theta_V=\theta_E$ for the respective ($L_6$,$L_7$,$C_5$,$R_7$,$R_6$) gains (1,0,0,0,0), (0,1,0,0,0), (1,1,0,0,0), (0,1,1,0,0), (1,0,1,0,0) and (1,0,0,1,0); and so on for larger values of $n_1$.

Using a numerical procedure for solving these equations for an $(n_1+1)\times n_1$ energy-preserving left/right symmetric decoders for $n_1$-speaker stereo layouts as shown in FIGS. 1*b* to 1*e* with the illustrative reference values of the angles $\theta_p$, the following decoder parameters have been found to achieve a "preservation decoder" in the above sense:

$$\phi=50.36°$$

for the 3×2 decoder, $$\phi_3=10.57° \text{ and } \phi_D=28.64°$$

for the 4×3 decoder, and $$a=0.6164,\ b=0.6558,\ c=0.4359,\ \phi_4=51.64° \text{ and } \phi_5=9.64°$$

for the 5×4 decoder,

In left/right form, these decoders satisfy the following matrix equations:

$$\begin{pmatrix} L_3 \\ C_3 \\ R_3 \end{pmatrix} = \begin{pmatrix} 0.8850 & -0.1150 \\ 0.4511 & 0.4511 \\ -0.1150 & 0.8850 \end{pmatrix} \begin{pmatrix} L_2 \\ R_2 \end{pmatrix}$$

for the 3×2 reproduction matrix decoder of a "preservation decoder" according to the invention, $$\begin{pmatrix} L_4 \\ L_5 \\ R_5 \\ R_4 \end{pmatrix} = \begin{pmatrix} 0.9303 & -0.1297 & 0.0527 \\ 0.3314 & 0.6951 & -0.1479 \\ -0.1479 & 0.6951 & 0.3314 \\ 0.0527 & -0.1297 & 0.9303 \end{pmatrix} \begin{pmatrix} L_3 \\ C_3 \\ R_3 \end{pmatrix}$$

for the 4×3 reproduction matrix decoder of a "preservation decoder" according to the invention, and $$\begin{pmatrix} L_6 \\ L_7 \\ C_5 \\ R_7 \\ R_6 \end{pmatrix} = \begin{pmatrix} 0.9535 & -0.1084 & 0.0590 & -0.0324 \\ 0.2533 & 0.7870 & -0.1989 & 0.0859 \\ -0.1349 & 0.5708 & 0.5708 & -0.1349 \\ 0.0859 & -0.1989 & 0.7870 & 0.2533 \\ -0.0324 & 0.0590 & -0.1084 & 0.9535 \end{pmatrix} \begin{pmatrix} L_4 \\ L_5 \\ R_5 \\ R_4 \end{pmatrix}$$

for the 5×4 reproduction matrix decoder of a "preservation decoder" according to the invention.

The 5×3 "preservation decoder" obtained by forming the composite decoder as in FIG. 9 from the above 4×3 and 5×4 "preservation decoder" matrices satisfies the matrix equations $$\begin{pmatrix} L_6 \\ L_7 \\ C_5 \\ R_7 \\ R_6 \end{pmatrix} = \begin{pmatrix} 0.8407 & -0.1538 & 0.0557 \\ 0.5304 & 0.3648 & -0.0891 \\ -0.0279 & 0.8285 & -0.0279 \\ -0.0891 & 0.3648 & 0.5304 \\ 0.0557 & -0.1538 & 0.8407 \end{pmatrix} \begin{pmatrix} L_3 \\ C_3 \\ R_3 \end{pmatrix},$$

and similar composite decoder equations can be formed from the above equations for the 4×2 and 5×2 cases by multiplying the appropriate matrices; however as we have seen, for 2-speaker stereo signal sources, preserving the original effect is rarely the most desirable thing to do in view of the substantial defects of 2-speaker stereo.

The effect of the above preservation decoders on the localisation parameters as computed by the above methods for the speaker layouts of FIGS. 1*b* to 1*e* with the illustrative reference values of $\theta_p$ is shown below in a series of tables. Table 1 shows the computed localisation parameters via the 3×2 preservation decoder as compared to the original 2-speaker values for various input signal gains.

TABLE 1

| gains | | 2-speaker parameters | | | | 3-speaker parameters | | | |
|---|---|---|---|---|---|---|---|---|---|
| $L_2$ | $R_2$ | $r_V$ | $\theta_V$ | $r_E$ | $\theta_E$ | $r_V$ | $\theta_V$ | $r_E$ | $\theta_E$ |
| 1 | 0 | 1.0000 | 35.00 | 1.0000 | 35.00 | 1.0000 | 35.38 | 0.9404 | 35.38 |
| 1 | 1 | 0.8192 | 0.00 | 0.8192 | 0.00 | 0.8153 | 0.00 | 0.8263 | 0.00 |

Table 2 shows the computed localisation parameters via the above 4×3 preservation decoder as compared to the original 3-speaker values for various input signal gains.

TABLE 2

| gains | | | 3-speaker parameters | | | | 4-speaker parameters | | | |
|---|---|---|---|---|---|---|---|---|---|---|
| $L_3$ | $C_3$ | $R_3$ | $r_V$ | $\theta_V$ | $r_E$ | $\theta_E$ | $r_V$ | $\theta_V$ | $r_E$ | $\theta_E$ |
| 1 | 0 | 0 | 1.0000 | 45.00 | 1.0000 | 45.00 | 0.9805 | 45.08 | 0.9690 | 45.08 |
| 1 | 1 | 0 | 0.9239 | 22.50 | 0.9239 | 22.50 | 0.9282 | 22.32 | 0.9254 | 22.32 |
| 1 | 0 | 1 | 0.7071 | 0.00 | 0.7071 | 0.00 | 0.6924 | 0.00 | 0.6534 | 0.00 |
| 0 | 1 | 0 | 1.0000 | 0.00 | 1.0000 | 0.00 | 1.0303 | 0.00 | 0.9474 | 0.00 |

Table 3 shows the computed localisation parameters via the above 5×4 preservation decoder as compared to the original 4-speaker values for various input signal gains.

TABLE 3

| gains | | | | 4-speaker parameters | | | | 5-speaker parameters | | | |
|---|---|---|---|---|---|---|---|---|---|---|---|
| $L_4$ | $L_5$ | $R_5$ | $R_4$ | $r_V$ | $\theta_V$ | $r_E$ | $\theta_E$ | $r_V$ | $\theta_V$ | $r_E$ | $\theta_E$ |
| 1 | 0 | 0 | 0 | 1.0000 | 50.00 | 1.0000 | 50.00 | 0.9996 | 50.95 | 0.9793 | 50.95 |
| 0 | 1 | 0 | 0 | 1.0000 | 16.67 | 1.0000 | 16.67 | 1.0009 | 16.32 | 0.9606 | 16.32 |
| 1 | 1 | 0 | 0 | 0.9580 | 33.33 | 0.9580 | 33.33 | 0.9549 | 33.75 | 0.9546 | 33.83 |
| 1 | 0 | 1 | 0 | 0.8355 | 16.67 | 0.8355 | 16.67 | 0.8328 | 17.56 | 0.7790 | 17.51 |
| 0 | 1 | 1 | 0 | 0.9580 | 0.00 | 0.9580 | 0.00 | 0.9606 | 0.00 | 0.9613 | 0.00 |
| 1 | 0 | 0 | 1 | 0.6428 | 0.00 | 0.6428 | 0.00 | 0.6298 | 0.00 | 0.6377 | 0.00 |

Table 4 shows the computed localization parameters via the above 5×3 preservation decoder as compared to the original 3-speaker values for various input signal gains.

TABLE 4

| gains | | | 3-speaker parameters | | | | 5-speaker parameters | | | |
|---|---|---|---|---|---|---|---|---|---|---|
| $L_3$ | $C_3$ | $R_3$ | $r_V$ | $\theta_V$ | $r_E$ | $\theta_E$ | $r_V$ | $\theta_V$ | $r_E$ | $\theta_E$ |
| 1 | 0 | 0 | 1.0000 | 45.00 | 1.0000 | 45.00 | 0.9764 | 45.76 | 0.9683 | 45.74 |
| 0 | 1 | 0 | 1.0000 | 0.00 | 1.0000 | 0.00 | 1.0378 | 0.00 | 0.9515 | 0.00 |
| 1 | 1 | 0 | 0.9239 | 22.50 | 0.9239 | 22.50 | 0.9272 | 22.70 | 0.9226 | 22.41 |
| 1 | 0 | 1 | 0.7071 | 0.00 | 0.7071 | 0.00 | 0.6812 | 0.00 | 0.6475 | 0.00 |

It will be seen from tables 1 to 4 that all these preservation decoders have constants of proportionality $k_V$ and $k_E$ for the angular dispositions of $\theta_V$ and $\theta_E$ that are substantially equal to one for the loudspeaker layouts used, and it is found that other input signal gains that might be used for achieving a desired stereophonic illusion also substantially preserve the original localisation angles to within about 2°. As can be seen from the above tables, the values of $r_V$ and $r_E$ are not exactly preserved, but also that they are generally quite similar at the output of the preservation decoders. In cases when $r_E$ is very close to one at the input, it is impossible to avoid some reduction in $r_E$ since $r_E$ can only be near 1 if the sound direction is near a loudspeaker direction. However, it will be noted that $r_E$ is actually increased for some input signals via some preservation decoders.

It will be understood that the numerical values given above are approximate, and will vary somewhat with the angular width of loudspeaker layouts. In practice, alterations of matrix coefficients by around 0.02 are unlikely to be very significant, and variations significantly larger than this, say by 0.05 or 0.1, may be acceptable in many applications.

In practice, angular rotations of the matrices (i.e. multiplication by an orthogonal matrix producing angular rotations) of up to 6° are likely not to substantially affect the "preservation decoder" property according to the invention. In particular, the decoder angle parameters may vary by up to 6° from the values given, and the direction of the (a,b,c) vector may also vary by 6° without substantial effect.

$(n_1+1)\times n_1$ reproduction preservation decoders can be designed by the above stereo test signal methods for other $(n_1+1)$-speaker arrangements. Table 5 lists the parameters $\phi_3$ and $\phi_D$ for 4×3 preservation decoders for various values of the angles $\theta_4$ and $\theta_5$ in FIG. 1*d*.

TABLE 5

| $\theta_4$ | $\theta_5$ | $\phi_3$ | $\phi_D$ |
|---|---|---|---|
| 45 | 9 | 9.07 | 33.39 |
| 45 | 15 | 10.40 | 28.32 |
| 50 | 10 | 9.08 | 32.72 |
| 50 | 16⅔ | 10.57 | 28.64 |
| 60 | 12 | 9.16 | 31.64 |
| 60 | 15 | 9.89 | 30.75 |
| 60 | 20 | 10.98 | 29.42 |
| 60 | 24 | 11.73 | 28.37 |
| 60 | 30 | 12.65 | 26.70 |
| 75 | 15 | 9.49 | 30.92 |
| 75 | 25 | 11.76 | 31.01 |

It will be seen that, as asserted earlier, the values of the decoder parameters do not vary greatly with the precise angular dispositions of the reproduction loudspeakers for a preservation decoder. Also, for all these decoders, the reproduced velocity and sound intensity vector directions $\theta_V$ and $\theta_E$ are substantially proportional to those intended via the original 3-speaker layout.

A preservation decoder according to the invention may, if desired, incorporate means of adjusting decoder parameters according to the angular disposition of the loudspeakers used, or may use fixed typical parameters.

Improvement Decoders

Especially in the case of 2-speaker stereo, and to a somewhat lesser extent with 3- or 4-speaker stereo, it may prove to be impossible to achieve a desired stereophonic illusion using the intended loudspeaker layout, particularly as regards image stability and consistency of velocity and sound-intensity directional localisation. In such situations, the decoder according to the invention may be used to improve the reproduction via more loudspeakers. This may be achieved by altering the decoder parameters from their preservation decoder values computed above.

For decoders with 2-speaker stereo inputs, the desired alterations may be quite large—for example the angle parameter $\phi$ may be reduced by 15° or 20° from its "preservation decoder" value of 50.36° as already seen. $n_2 \times 2$ improvement decoders may be achieved by forming a composite decoder, as in FIG. 9, comprising a 3×2 improvement decoder followed by an $n_2 \times 3$ preservation decoder, or by using a decoder having the same overall effect as such a composite decoder.

A 4×2 improvement decoder may have the angle parameter $\phi_D$ substantially as shown in table 5 for the 4-speaker arrangement shown in FIG. 1*d*, being typically around 28½°, and the angle parameter $\phi_{42}$ may substantially equal $35°-\phi_3$ (typically around 25°) at frequencies between around 400 Hz and around 5 kHz, and may substantially equal $55°-\phi_3$ (typically around 45°) at frequencies above about 5 kHz, where $\phi_3$ is as given in table 5.

A frequency-dependent 4×2 improvement decoder of this kind may be implemented as in FIG. 17, but making the $\phi_{42}$ sine/cosine gain adjustment means (33*c*) frequency-dependent using associated bandsplitting means (34) such as shown in FIG. 5. The $\phi_D$ sine/cosine means (33*d*) in FIG. 17 may similarly be made frequency-dependent if desired. In such decoders, bass energy may be preferentially fed to loudspeakers $L_4$ and $R_4$ by making $\phi_{42}$ near 90° and $\phi_D$ near 0° at low bass frequencies, and to loudspeakers $L_5$ and $R_5$ by making $\phi_{42}$ near 0° and $\phi_D$ near 90° at low bass frequencies.

A frequency-dependent 4×2 improvement decoder may also be implemented as in FIG. 8, substituting for the output matrix means (9) a 4×3 transmission matrix decoder means as described hereafter, with angle parameters $\phi'=45°$ and $\phi_3$ and $\phi_D$ substantially as shown in table 5.

Much smaller changes of the decoder parameters from the preservation decoder values are required for most "improvement decoders" with $n_1$=3- or more channel inputs. In general, acceptable small alterations of the decoder parameters are found to modify the values of the respective constants $k_V$ and $k_E$ of proportionality of the angular dispositions of velocity and sound intensity vectors, and improvement decoders will generally be designed to reduce the value of $k_E$ somewhat, for example to about $0.8k_V$ or $0.9k_V$ in the middle frequency range in order to increase $r_E$ somewhat, and to increase $k_E$ somewhat above 5 kHz while leaving $k_V$ largely unaltered. This strategy retains a maximum sense of width above 5 kHz, while improving image stability with listener movement at middle frequencies.

Numerical computations of the reproduced localisation parameters, especially $\theta_V$ and $\theta_E$, for the stereo input gains (i.e. single-speaker and pair-of-speaker signals) discussed above are thus a useful way of helping to optimise the values of the decoder parameters for improvement decoders. The alteration of the decoder parameters for 4×3 and 5×4 improvement decoders from their preservation decoder values is best determined by a combination of such theoretical computations of localisation parameters and subjective testing on a wide variety of programme material prepared by a variety of recording and mixing techniques. It is generally found that alterations from the preservation decoder parameters of only a few degrees are required in the 4×3 and 5×4 cases.

Composite improvement decoders can be implemented by cascading two improvement decoders, or by following an improvement decoder by a preservation decoder; such composite decoders may be implemented as a single decoder designed so as to achieve the same result as the cascaded decoders by methods known to those skilled in the art.

All subjectively desirable matrix reproduction decoders according to the invention have overall matrix coefficients expressed in left/right or direct loudspeaker-feed formats such that some matrix coefficients have substantially the opposite polarity to other larger predominant matrix coefficients, at least across several octaves which may include the middle frequency region from say 500 Hz to 3 kHz. Such opposite-polarity subsiduary matrix coefficients have the effect of helping to stabilise images and of rendering the results of different auditory localisation mechanisms more consistent. In preferred cases, the coefficients that have substantially opposite polarities will have a magnitude of under two-fifths of that of the predominant matrix coefficients.

For improvement decoders, the parameters $\phi$ and $\phi_{42}$ preferably lie within 25° and the parameters $\phi_3$, $\phi_D$, $\phi_4$, $\phi_5$ and the vector (a,b,c) preferably lie within 15° of their preservation decoder values given earlier.

Transmission Hierarchy

Figure 16:
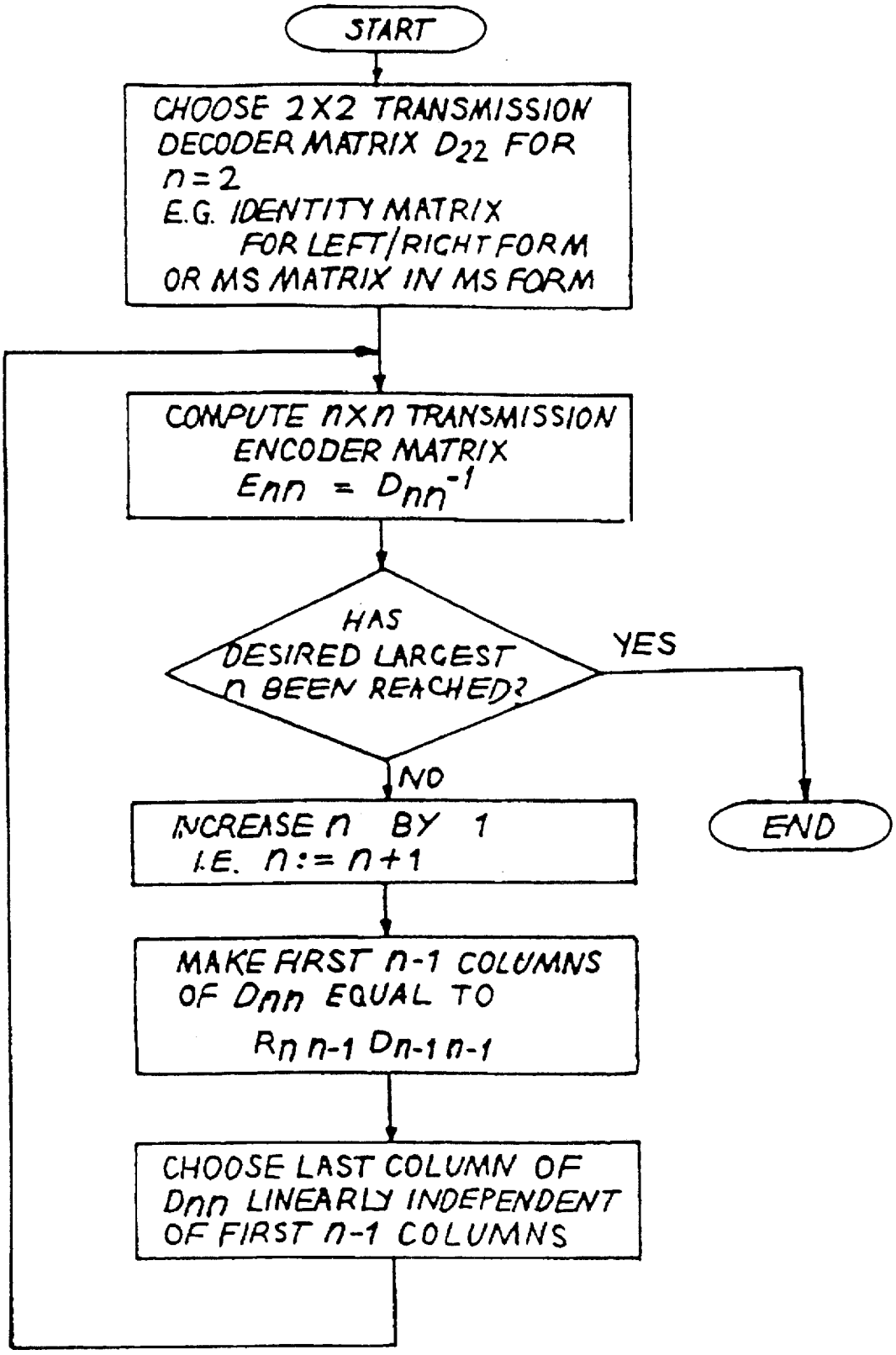
FIG. 16 is a flow diagram indicating the procedure for designing a hierarchical system of transmission encoders and decoders in accordance with FIGS. 14 and 15 and the invention.

Explicit equations are now given for transmission matrix encoders and transmission matrix decoders according to the invention constructed according to the flow diagram of FIG. 16 from energy-preserving reproduction matrix decoders parameterised previously in the 3×2, 4×3 and 5×4 cases, where the additional channel coefficients of $D_{n+1\ n+1}$ are chosen to be of unit length and orthogonal to the other n column of $D_{n+1\ n+1}$. This leads to the following orthogonal-matrix transmission decoding and encoding equations in MS form:

Mono $C_1 = M$, $M = C_1$.
2-speaker stereo $M_2 = M$, $S_2 = S$ (decode)
$M = M_2$, $S = S_2$ (encode)
3-speaker stereo $$\begin{pmatrix} M_3 \\ C_3 \end{pmatrix} = \begin{pmatrix} \sin\phi' & \cos\phi' \\ \cos\phi' & -\sin\phi' \end{pmatrix} \begin{pmatrix} M \\ T \end{pmatrix}$$

$S_3 = S$,
for decoding, and $$\begin{pmatrix} M \\ T \end{pmatrix} = \begin{pmatrix} \sin\phi' & \cos\phi' \\ \cos\phi' & -\sin\phi' \end{pmatrix} \begin{pmatrix} M_3 \\ C_3 \end{pmatrix}$$

$S = S_3$,
for encoding.

4-speaker stereo

-continued $$\begin{pmatrix} M_4 \\ M_5 \end{pmatrix} = \begin{pmatrix} \sin(\phi' - \phi_3) & \cos(\phi' - \phi_3) \\ \cos(\phi' - \phi_3) & -\sin(\phi' - \phi_3) \end{pmatrix} \begin{pmatrix} M \\ T \end{pmatrix}$$

$$\begin{pmatrix} S_4 \\ S_5 \end{pmatrix} = \begin{pmatrix} \cos\phi_D & \sin\phi_D \\ \sin\phi_D & -\cos\phi_D \end{pmatrix} \begin{pmatrix} S \\ T_4 \end{pmatrix}$$

for decoding, and $$\begin{pmatrix} M \\ T \end{pmatrix} = \begin{pmatrix} \sin(\phi' - \phi_3) & \cos(\phi' - \phi_3) \\ \cos(\phi' - \phi_3) & -\sin(\phi' - \phi_3) \end{pmatrix} \begin{pmatrix} M_4 \\ M_5 \end{pmatrix}$$

$$\begin{pmatrix} S \\ T_4 \end{pmatrix} = \begin{pmatrix} \cos\phi_D & \sin\phi_D \\ \sin\phi_D & -\cos\phi_D \end{pmatrix} \begin{pmatrix} S_4 \\ S_5 \end{pmatrix}$$

for encoding.

5-speaker stereo $$\begin{pmatrix} M_6 \\ M_7 \\ C_5 \end{pmatrix} = A \begin{pmatrix} \sin(\phi' - \phi_3) & \cos(\phi' - \phi_3) & 0 \\ \cos(\phi' - \phi_3) & -\sin(\phi' - \phi_3) & 0 \\ 0 & 0 & 1 \end{pmatrix} \begin{pmatrix} M \\ T \\ T_5 \end{pmatrix},$$

where the $3 \times 3$ matrix $A$ is given by $$A = 2^{-1/2} \begin{pmatrix} a + \mu_1\cos\phi_4 + \nu_1\sin\phi_4 & a - \mu_1\cos\phi_4 - \nu_1\sin\phi_4 & 2^{1/2}[\nu_1\cos\phi_4 - \mu_1\sin\phi_4] \\ b - \mu_2\cos\phi_4 + \nu_2\sin\phi_4 & b + \mu_2\cos\phi_4 - \nu_2\sin\phi_4 & 2^{1/2}[\nu_2\cos\phi_4 + \mu_2\sin\phi_4] \\ c - \lambda\sin\phi_4 & c + \lambda\sin\phi_4 & -2^{1/2}\lambda\cos\phi_4 \end{pmatrix}$$

where $\lambda = (a^2 + b^2)^{1/2}$, $\mu_1 = b/\lambda$, $\mu_2 = a/\lambda$, $\nu_1 = ac/\lambda$, $\nu_2 = bc/\lambda$, $a^2 + b^2 + c^2 = 1$, and $$\begin{pmatrix} S_6 \\ S_7 \end{pmatrix} = \begin{pmatrix} \cos(\phi_D + \phi_5) & \sin(\phi_D + \phi_5) \\ \sin(\phi_D + \phi_5) & -\cos(\phi_D + \phi_5) \end{pmatrix} \begin{pmatrix} S \\ T_4 \end{pmatrix}$$

for decoding, and $$\begin{pmatrix} M \\ T \\ T_5 \end{pmatrix} = \begin{pmatrix} \sin(\phi' - \phi_3) & \cos(\phi' - \phi_3) & 0 \\ \cos(\phi' - \phi_3) & -\sin(\phi' - \phi_3) & 0 \\ 0 & 0 & 1 \end{pmatrix} A^T \begin{pmatrix} M_6 \\ M_7 \\ C_5 \end{pmatrix},$$

where $A^T$ is the transpose $(a_{ji})$ of the matrix $A = (a_{ij})$ and $$\begin{pmatrix} S \\ T_4 \end{pmatrix} = \begin{pmatrix} \cos(\phi_D + \phi_5) & \sin(\phi_D + \phi_5) \\ \sin(\phi_D + \phi_5) & -\cos(\phi_D + \phi_5) \end{pmatrix} \begin{pmatrix} S_6 \\ S_7 \end{pmatrix}$$

for encoding.

Preferred values for these transmission encoding and decoding equations for the angle and (a,b,c) parameters are substantially the preservation decoder parameters for the 4×3 and 5×4 reproduction matrix decoders, and substantially around $\phi'=45°$ for the 3×2 reproduction matrix decoders. Thus, preferably:

$$32° \leq \phi' \leq 55°,$$

$$4° \leq \phi_3 \leq 17°,$$

$$22° \leq \phi_D \leq 35°,$$

$$45° \leq \phi_4 \leq 58°,$$

$$3° \leq \phi_5 \leq 16°,$$

and the vector (a,b,c) is of unit length and in a direction within 6° of (0.6164, 0.6558, 0.4359). Although values within these angular limits are preferred, wider angular limits within 15° or 25° of the central values given for these parameters fall within the scope of the invention.

Highly preferred values for these parameters are substantially $\phi'=45°$, $\phi_3=10.57°$, $\phi_D=28.64°$, $\phi_4=51.64°$, $\phi_5=9.64°$ and (a,b,c)=(0.6164, 0.6558, 0.4359).

It will be appreciated that in practical applications of this hierarchy of transmission encoding and decoding Matrix means according to FIGS. 14 and 15 and the invention, the transmission signals M, S, T, $T_4$ and $T_5$ may be given arbitrary predetermined respective nonzero amplitude gains $k_{1'}$, $k_{2'}$, $k_{3'}$, $k_{4'}$ and $k_{5'}$ in order that the amplitude levels of signals in each transmission channel should match the peak level and noise characteristics of that channel. Such additional amplitude gains may be applied at the encoding matrix stages, and the inverse gains $k_{i'}^{-1}$ applied to the respective channel signals at the decoding stage. The gains $k_{i'}$ may be positive or negative, or may have complex values, which may be frequency dependent in the case that equalisation is desired of a transmission channel. In general, it is usually found that the transmission channel signals M, S, T, $T_4$ and $T_5$ are of progressively decreasing average signal energy, so that the magnitudes of the associated channel gains $k_{i'}$ may be chosen to be progressively of increasing value.

For the above-stated highly preferred parameter values, the transmission encoding and decoding equations in left/right form have the following explicit values:

Mono $C_1 = 2^{-1/2}(L + R)$, $L = R = 2^{-1/2}C_1$.

2-speaker stereo $L_2 = L$, $R_2 = R$; $L = L_2$, $R = R_2$.

3-speaker stereo $$\begin{pmatrix} L_3 \\ R_3 \\ C_3 \end{pmatrix} = \begin{pmatrix} 0.8536 & -0.1464 & 0.5000 \\ -0.1464 & 0.8536 & 0.5000 \\ 0.5000 & 0.5000 & -0.7071 \end{pmatrix} \begin{pmatrix} L \\ R \\ T \end{pmatrix}$$

for transmission matrix decoding, and $$\begin{pmatrix} L \\ R \\ T \end{pmatrix} = \begin{pmatrix} 0.8536 & -0.1464 & 0.5000 \\ -0.1464 & 0.8536 & 0.5000 \\ 0.5000 & 0.5000 & -0.7071 \end{pmatrix} \begin{pmatrix} L_3 \\ R_3 \\ C_3 \end{pmatrix}$$

for transmission matrix encoding.

4-speaker stereo $$\begin{pmatrix} L_4 \\ R_4 \\ L_5 \\ R_5 \end{pmatrix} = \begin{pmatrix} 0.7215 & -0.1561 & 0.5832 & 0.3389 \\ -0.1561 & 0.7215 & 0.5832 & -0.3389 \\ 0.6521 & 0.1728 & -0.3998 & -0.6206 \\ 0.1728 & 0.6521 & -0.3998 & 0.6206 \end{pmatrix} \begin{pmatrix} L \\ R \\ T \\ T_4 \end{pmatrix}$$

for transmission matrix decoding, and $$\begin{pmatrix} L \\ R \\ T \\ T_4 \end{pmatrix} = \begin{pmatrix} 0.7215 & -0.1561 & 0.6521 & 0.1728 \\ -0.1561 & 0.7215 & 0.1728 & 0.6521 \\ 0.5832 & 0.5832 & -0.3998 & -0.3998 \\ 0.3389 & -0.3389 & -0.6206 & 0.6206 \end{pmatrix} \begin{pmatrix} L_4 \\ R_4 \\ L_5 \\ R_5 \end{pmatrix}$$

for transmission matrix encoding.

5-speaker stereo

-continued $$\begin{pmatrix} L_6 \\ R_6 \\ L_7 \\ R_7 \\ C_5 \end{pmatrix} = \begin{pmatrix} 0.6325 & -0.1525 & 0.5570 & 0.4381 & -0.2730 \\ -0.1525 & 0.6325 & 0.5570 & -0.4381 & -0.2730 \\ 0.6482 & 0.0287 & -0.0373 & -0.5551 & 0.5191 \\ 0.0287 & 0.6482 & -0.0373 & 0.5551 & 0.5191 \\ 0.3945 & 0.3945 & -0.6138 & 0.0000 & -0.5585 \end{pmatrix} \begin{pmatrix} L \\ R \\ T \\ T_4 \\ T_5 \end{pmatrix}$$

for transmission matrix decoding, and $$\begin{pmatrix} L \\ R \\ T \\ T_4 \\ T_5 \end{pmatrix} = \begin{pmatrix} 0.6325 & -0.1525 & 0.6482 & 0.0287 & 0.3945 \\ -0.1525 & 0.6325 & 0.0287 & 0.6482 & 0.3945 \\ 0.5570 & 0.5570 & -0.0373 & -0.0373 & -0.6138 \\ 0.4381 & -0.4381 & -0.5551 & 0.5551 & 0.0000 \\ -0.2730 & -0.2730 & 0.5191 & 0.5191 & -0.5585 \end{pmatrix} \begin{pmatrix} L_6 \\ R_6 \\ L_7 \\ R_7 \\ C_5 \end{pmatrix}$$

for transmission matrix encoding.

Using the above equations, encoding from a first plurality $n_1$ of loudspeaker feed signals, and decoding into a second plurality $n_2$ not less than $n_1$ gives the input signals for $n_1=n_2$, and gives a preservation decoder (if $n_1>2$) or an improvement decoder (if $n_1=2$) via the loudspeaker layouts of FIGS. 1*b* to 1*e* with the illustrative reference values of $\theta_p$ if the highly preferred values of the decoder parameters $\phi'$,$\phi_3$,$\phi_D$, $\phi_4$,$\phi_5$ and (a,b,c) are used as in the above numerical equations.

For other loudspeaker layouts, such as those with other values of $\theta_p$, these equations may not give precisely the optimum preservation or improvement decoder effect, but will still be very close. However, if it is desired to optimally match the decoded results to a specific loudspeaker arrangement, a transmission matrix decoder may be employed based on modified values of the parameters $\phi'$ (for 3-speaker reproduction), $\phi_3$ and $\phi_D$ (for 4-speaker reproduction), or $\phi_4$, $\phi_5$ and (a,b,c) (for 5-speaker reproduction) matched to the loudspeaker arrangement actually used rather than to the encoding parameters. Since such modified transmission decoding matrices are orthogonal, such decoders still give overall energy-preserving results. Such modified transmission matrix decoders matched to other loudspeaker arrangements remain within the scope of the invention, and because of their closeness to the originally intended transmission decoder matrices, still substantially preserve the original loudspeaker feed signals when $n_1=n_2$. Alternatively, the transmission matrix decoder with the same parameters as the encoder can be followed by a reproduction matrix preservation or improvement decoder according to the invention; the transmission matrix decoder and a following reproduction matrix decoder may be combined into a single matrix means in ways evident to those skilled in the art.

Other possibly non-orthogonal transmission matrix encoders and transmission matrix decoders for use in hierarchical systems can be constructed for the desired values of the preservation or improvement reproduction decoder parameters $\phi'$, $\phi_3$, $\phi_D$, $\phi_4$, $\phi_5$ and (a,b,c), and can be designed using the design procedures described in connection with the flow diagram of FIG. 16, and are within the scope of the invention.

The use of a transmission encoder using an n-speaker signal feed for transmission via m greater than n channels according to the equations produces added transmission signals $T_{n+1}, \ldots, T_m$ that are zero, but this does not preclude the use of a frequency-dependent matrixing of the n input channels to synthesise additional channel signals $T_{n+1}, \ldots, T_m$ providing that the basic signals $T_1, \ldots, T_n$ are substantially unaltered, in order to provide improved psychoacoustic results for listeners using more than m transmission channels. An example has already been described in connection with FIG. 8 for n=2. In more general cases, the frequency-independent m×m transmission matrix encoder may be fed with the outputs of a frequency-dependent m×n reproduction matrix improvement decoder, or equivalent signals may be provided by a frequency-dependent matrix encoding means achieving the effects of such a composite encoder.

The explicit 4×3 or 5×3 transmission matrix decoding equations obtained from the above 4×4 or 5×5 matrix equations when $T_4$ and $T_5$ are set to zero may be used for the output means (9) of the decoder shown in FIG. 8 when a 4×2 or 5×2 frequency-dependent improvement reproduction decoder is required.

Delay Compensation

The design theory given above assumed loudspeaker arrangements in which all loudspeakers are at the same distance from an ideally situated listener. The invention can be used with loudspeaker arrangements for which this equal-distance requirement does not hold, such as the arrangement of FIG. 1*g* or n -speaker arrangements lying, for example, along a straight line or along a non-circular path or along a circular path whose centre does not lie in the preferred listening area. The results in such a case are generally less satisfactory than with an equal distance loudspeaker arrangement, but still usually acceptable.

Figure 26:
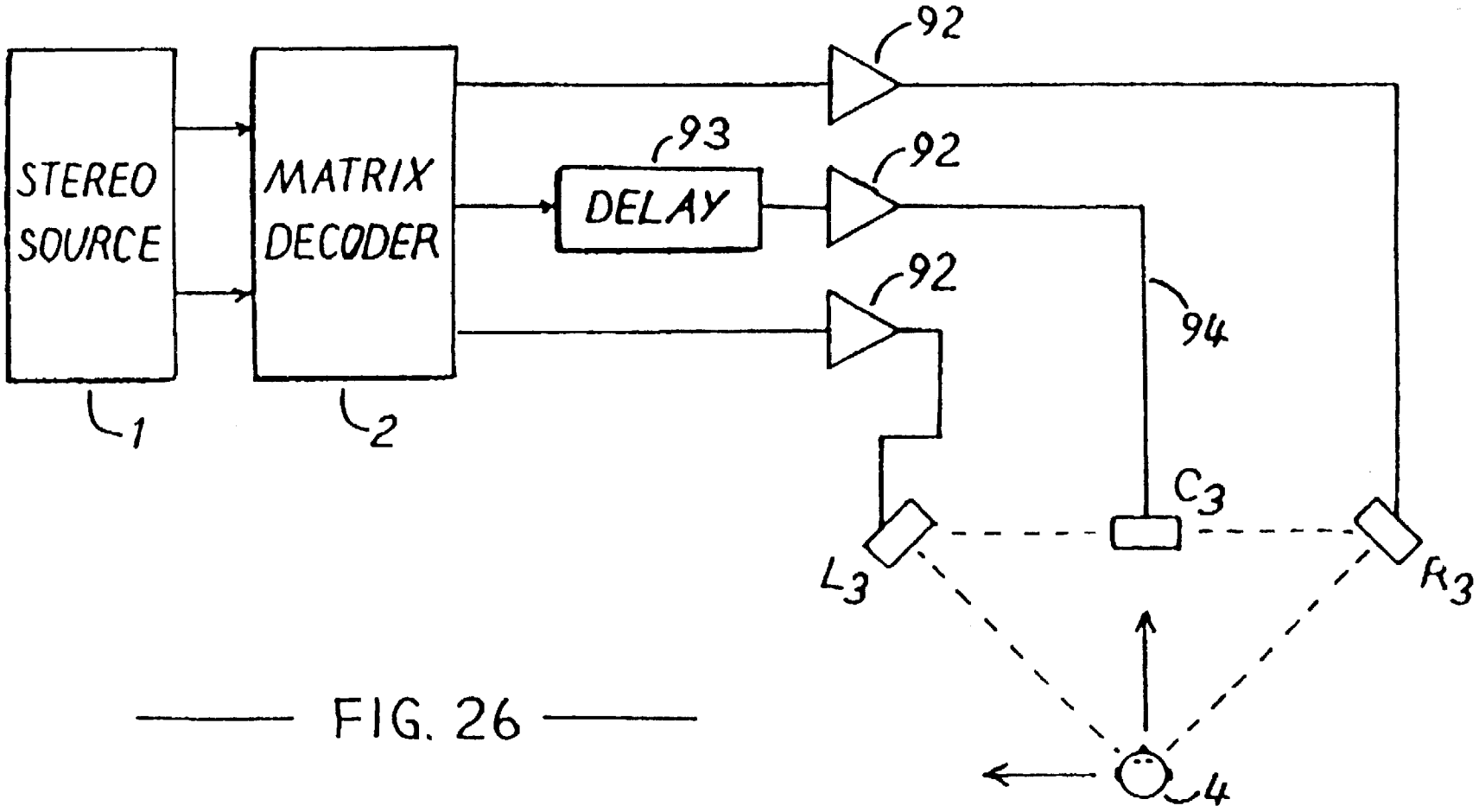
FIG. 26 shows the use of delay compensation means to compensate for different loudspeaker distances.

However, for the optimum results, it is preferred to provide those loudspeakers closest to a preferred listening position (4), such as $C_3$ in FIG. 26, a signal feed (94) obtained from the matrix decoder (2) via time delay means (93) whose time delay equals the time difference of sound arrivals from that loudspeaker relative to sound arrivals from the most distant loudspeaker, as shown in FIG. 26 for the layout of FIG. 1*g*.

In general, a matrix decoder may be provided with or incorporate or be used in association with time delay means for all loudspeakers or for all but those loudspeakers most distant from the preferred listening position, the time delays provided for all loudspeaker feed signals being such as to ensure that the time of arrival at the preferred listening position of an impulse passing through the decoder is substantially identical for all of the loudspeakers.

Such delay compensation means may be provided using any available time-delay technology, including analog charge-coupled delay lines and digital delay technology. The provision of digital delay compensation is particularly simple for matrix decoder means implemented using digital signal processing technology.

In preferred implementations of decoders with delay compensation according to the invention, the intended loudspeaker arrangement is substantially left/right symmetric and the preferred listening position is on the axis of symmetry. In this application, the delay compensation is not intended to provide compensation for listener positions away from the preferred position, but is purely intended as a compensation for the actual loudspeaker arrangement used and its general relationship to the broad listening area over which listeners may be placed.

Low-Frequency Modifications

The ears are less sensitive to localisation at low frequencies below about 200 Hz, and particularly below 100 Hz, than at higher frequencies. Thus matrix decoders according to the invention may depart from the strict requirements of the invention at such low frequencies.

When used with loudspeakers some of which have limited bass reproduction capabilities, decoders according to the invention may incorporate modified matrix decoding parameters such as $\phi'$ or $\phi$, $\phi_3$, $\phi_D$, $\phi_4$, $\phi_5$ and (a,b,c) at low frequencies in order to redistribute bass energy among the various loudspeakers, in the manner already described for 3×2 reproduction matrix decoders. Such decoders may also incorporate or be used in association with phase compensation means intended to compensate for differences in the bass phase responses of different loudspeakers, so that as much as possible of the remaining low-frequency localisation cues are retained.

Portable Multispeaker Stereo Apparatus

A popular form of stereophonic apparatus is one-piece portable apparatus incorporating signal sources (1) such as cassette tape reproducers,radio reception means and compact disc players, amplification and control means and loudspeakers within a single unit, termed colloquially a "ghetto blaster". Apparatus of this kind is sometimes equipped with a pair of demountable attached loudspeaker units, so that the apparatus may be used for reproduction either with the loudspeakers attached or with the loudspeakers separated from the main housing unit and from each other in order to provide a wider stereo effect.

According to one aspect of the invention, there is provided a portable or transportable system for stereophonic reproduction using at least three loudspeaker systems each covering an audio frequency range including the range 400 Hz to 5 kHz, said system being capable of carried as a single unit, responsive to stereophonic source signals and incorporating a matrix decoding means for said source signals and providing feed signals for said loudspeaker systems, whereby at least one of said loudspeaker systems is securely attached to or integrated into the main housing unit of said portable or transportable system, and whereby two of the additional said loudspeaker systems provided are attachable in close proximity to said main housing unit and are also movable or demountable with respect to said main housing unit so as to capable of being used spaced apart from each other and from said main housing unit. It is preferred if the system is so arranged that it may also be used for stereophonic reproduction when said two of the additional said loudspeaker systems are attached to said main housing unit. It is also preferred that said matrix decoder means be in accordance with the invention as described previously.

Apparatus of this kind preferably incorporates a 3×2 or 4×2 matrix decoding means of the type described earlier, with optional width adjustment means, responsive to 2-channel stereo source signals, which may be provided by a signal source or reception means incorporated into said main housing unit.

Figure 27:
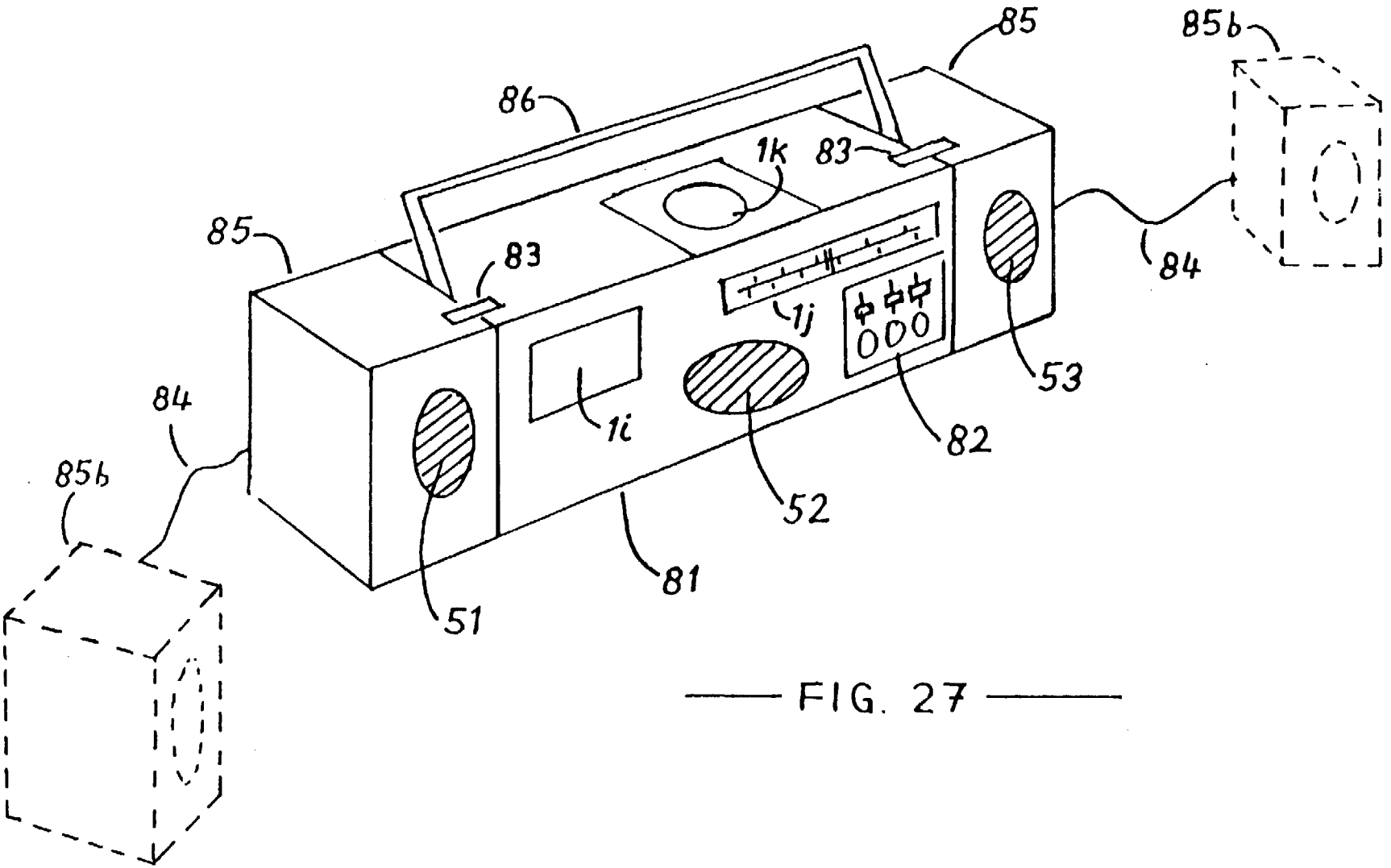
FIG. 27 shows a multispeaker stereophonic portable reproduction apparatus in accordance with the invention.

FIG. 27 shows, by way of example, a portable apparatus for multispeaker stereo reproduction of the above kind. A main housing unit (81) incorporates a signal source such as a cassette player (1*i*, radio receiver (1*j*) and/or a compact disc player (1*k*), control means (82) such as volume, equalisation, width and source selection controls, and a centre loudspeaker (52) preferably placed at the front centre of said housing unit (81), and also incorporates within the main housing unit (81) 3×2 or 3×3 matrix decoder means (2) or (9) (not shown) responsive to stereo signal sources which feeds via amplification means (not shown) incorporated within said main housing unit (81) or within loudspeaker enclosures (85) the centre loudspeaker (52) and left (51) and right (53) loudspeakers all of which cover a frequency range including the primary frequency range 400 Hz to 5 kHz. The loudspeaker enclosures (85) for left (51) and right (53) loudspeakers are shown attached to said main housing unit (81), but may be removed and spaced apart (85*b*) from said main housing unit (81) and each other, while remaining connected by audio signal cables (84) or by other audio signal communications means such as audio infra-red links.

The left and right loudspeaker enclosures (85) may be attachable to and removable from said main housing unit (81) by means of catches (83), clips, hooks, Velcro or other fastening or attachment means. Alternatively or in addition, the enclosures (85) may be attached to the main housing unit (81) by means of movable arms or links (not shown) that slide or are otherwise movable (for example by a rotation or pantograph action) that allow the left and right loudspeaker enclosures (85) to be moved away from immediate proximity to said main housing unit (81) while still being physically connected to it by means of said arms or links.

An advantage of using a movable arm or link means of removing attachable loudspeaker enclosures (85) from immediate proximity to the main housing unit (81) is that this means provides exact control of the relative positions of the loudspeaker units (51–53) to ensure the best stereophonic effect, whereas unskilled users might place entirely removable loudspeaker enclosures (85*b*) in undesirable locations. Moving arms or links also permit the entire unit to be carried by means of a single carrying handle (86) or shoulder strap attached to the main housing unit (81) while the loudspeaker enclosures (85) are removed from immediate proximity to said main housing unit (81).

Instead of providing three loudspeaker systems covering the primary frequency range, four such systems may be provided for use in conjunction with 4×2, 4×3 or 4×4 matrix decoding means, with the outer pair in the movable loudspeaker enclosures (85) and the inner pair enclosed within the main housing unit (81).

Detailed variations will be evident to those skilled in the art, such as the provision of other or alternative stereo sources, demountability of central loudspeaker units, or the replacement or supplementing of the control means (82) by a remote control unit means.

In general, the different loudspeaker systems (51,53) removable from the main housing unit (81) may have different frequency and/or phase response characteristics to those incorporated into the main housing unit (81), and equaliser compensation means may be incorporated into the apparatus for use in connection with said matrix decoding means to compensate for said differences of loudspeaker characteristics. In particular, said matrix decoder means may use frequency-dependent matrix parameters so as to minimise the bass energy fed to those loudspeaker systems with limited bass capability. For example, the centre loudspeaker system (52) may have more bass power output than the movable loudspeaker systems (51, 53), and a 3×2 matrix decoder according to the invention may use a decoder parameter $\phi$ that decreases to a value near 0° at low bass frequencies. Similarly, a 4×2 matrix decoder according to the invention may use a decoder parameter $\phi_{42}$ that decreases to a value near 0° at low bass frequencies.

Use with Associated Visual Images

A particular application of the invention is to reproduction with associated visual images where it is required to match the directions of sounds with those of associated visual images for listeners across a broad listening and viewing area. While applicable to situations where the visual image is that of physically present objects, such as in theatrical or live music performances, the invention is particularly applicable to reproduced images derived, for example, from Television broadcasts, video recordings, film projection or images generated by digital signal storage or processing means such as computer graphics or electronic games machines.

In a preferred form of the invention for use with visual reproduction means in which the directions of visual images and associated directional sounds are substantially matched, there is provided a visual reproduction means such as a display screen or projection means in a main housing unit, said housing unit also incorporating or being securely attached to at least one loudspeaker system covering at least a primary audio frequency range of 400 Hz to 5 kHz, and used with at least two loudspeaker systems each covering at least said primary frequency range capable of being moved so as to be spaced apart from and disposed to the two sides of said main housing unit, and a matrix decoding means according to earlier descriptions of the invention responsive to stereophonic source signals associated with the visual image and providing signals intended for reproduction via said loudspeaker systems.

Said movable loudspeakers may, if desired be attachable to and removable from said main housing unit by attachment or fastening means, and/or may be connected physically to said main housing unit by means of arm or link means, which may by sliding, rotation, pantograph or other action allow movement of said movable loudspeaker systems such that they may be used either in close proximity to said main housing unit or spaced apart and disposed to either side of said main housing unit.

Figure 28:
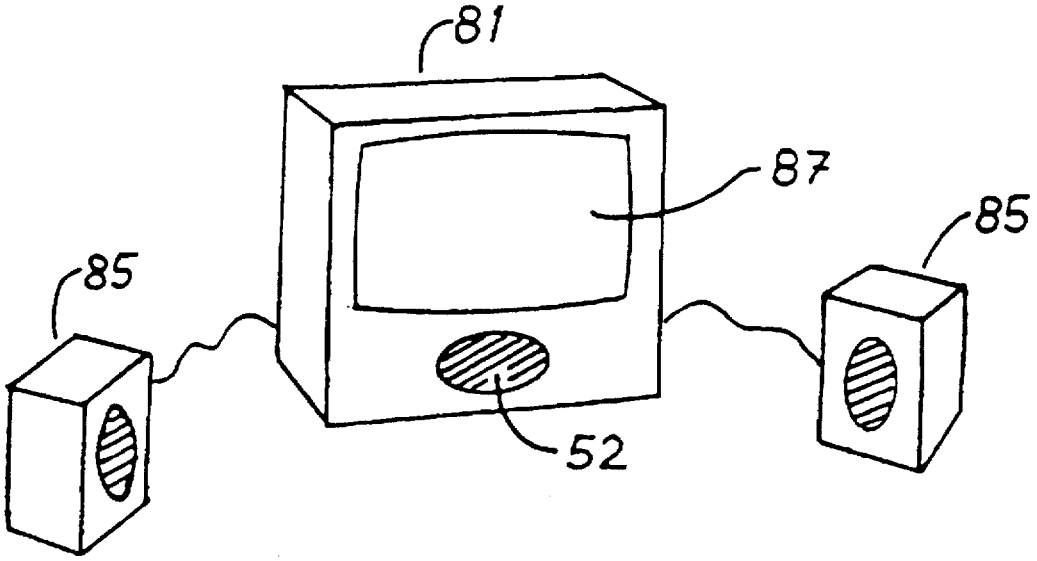
FIGS. 28 and 29 show audiovisual multispeaker stereophonic apparatus for use with the invention.
Figure 29:
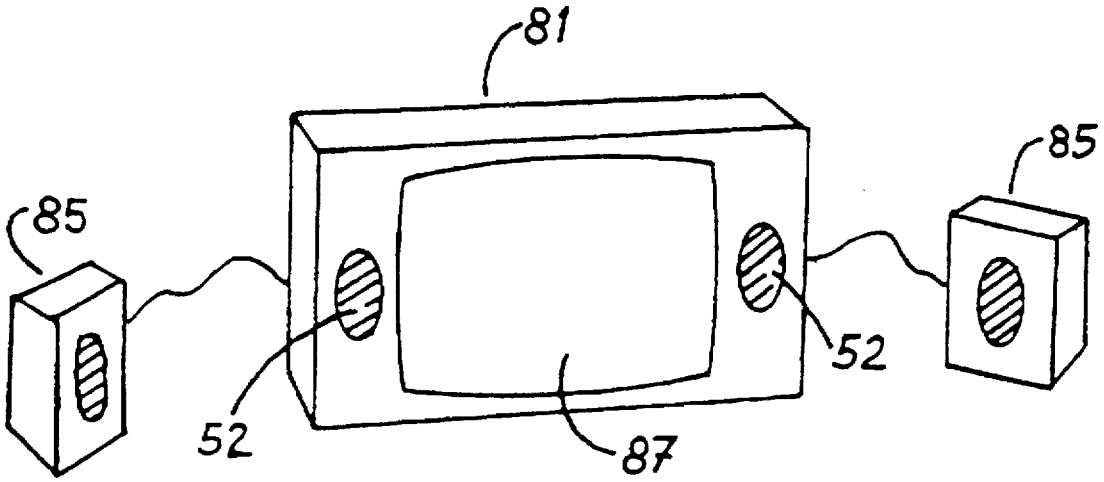

FIGS. 28 and 29 show two examples of audiovisual apparatus according to this aspect of the invention. A main housing unit (81) incorporates a display screen (87) or other visual display or projection means, and is used with two loudspeaker enclosures (85), one placed to either side of the main housing (81) and spaced apart from it, each containing loudspeaker means covering at least said primary frequency range, said main housing unit (81) also containing one or two loudspeaker systems (52) covering at least said primary frequency range. The main housing unit incorporates, or is used in association with, matrix decoding means (not shown) responsive to stereo signals and providing signals suitable, after such processing and amplification means as may be necessary or desirable, for feeding said loudspeaker systems (52) and (85), according to descriptions of the invention given earlier. FIG. 28 shows the case where a single centre loudspeaker (52) is used, in association with a 3×2 or 3×3 matrix decoder means (not shown); said loudspeaker is preferably placed centrally below or above said display screen (87) or display means in order to ensure correct localisation of central sound images with respect to the visual image.

FIG. 29 shows the case where two loudspeaker systems (52) are incorporated into or immediately attached to said main housing unit (81) to either side of said display screen (87), for use with a 4×2, 4×3 or 4×4 matrix decoder means (not shown). When used with matrix decoders according to the invention, the quality of stereophonic images is largely independent of the ratio of the spacing between the outer loudspeaker systems (85) to the spacing between the inner loudspeaker systems (52), over a range of values of said ratio between about 2 and 5. Other than affecting the overall width of the reproduced sound stage, a wider or narrower spacing of the outer loudspeaker enclosures (85) little effect on the acceptability of stereophonic imaging over a wide range of placements. The matrix decoder means may, if desired, incorporate electronic width adjustment means in order to provide a desired width of stereophonic sound stage with any given placement of said outer loudspeaker enclosures (85).

The audiovisual apparatus may incorporate equalisation means for compensating for any differences in frequency or phase response between inner (52) and outer (85) loudspeaker systems, and said matrix decoder means may additionally or instead have modified decoding matrix parameters at low frequencies so as to redistribute bass energy among the loudspeakers so as to take account of any differences in their bass reproduction capability.

High-Fidelity Apparatus

The invention is also well suited for use with high quality high-fidelity sound reproduction systems used for example for music reproduction not necessarily associated with visual images. In such high quality applications, loudspeaker units will generally be physically separate from each other and from preamplifier control means, which may incorporate matrix decoder means according to the invention or which may be used in association with physically separate matrix decoder means apparatus.

Figure 30:
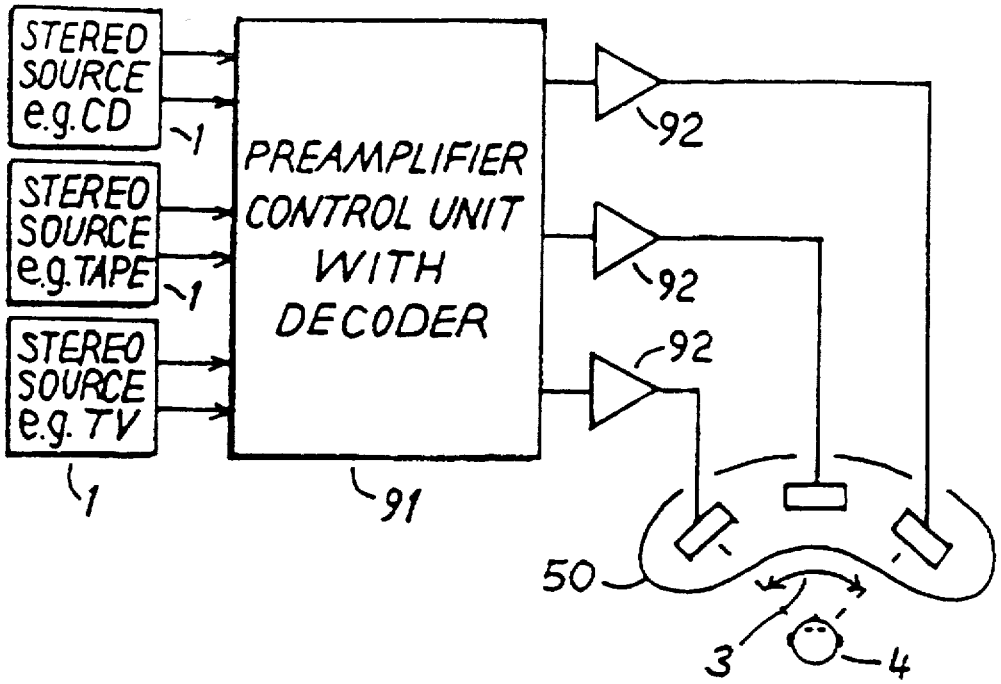
FIG. 30 is a schematic of a multispeaker stereophonic system using a preamplifier control unit incorporating a matrix decoder.

Referring to FIG. 30, according to another form of the invention, there is provided a preamplifier control means apparatus (91) responsive to stereo source signals (1) incorporating matrix decoder means as earlier described according to the invention, said apparatus providing output signals intended, after subsequent amplification means (92) which may, if desired, be integrated with said apparatus for feeding to a stereophonic loudspeaker arrangement (50) comprising at least three loudspeaker systems disposed across a sector (3) of directions in front of a preferred listening position (4).

In a preferred form of this implementation of the invention, said preamplifier control means apparatus (91) also incorporates visual signal control means for receiving, selecting and/or modifying associated visual images intended to match reproduced sound images in direction.

Figure 31:
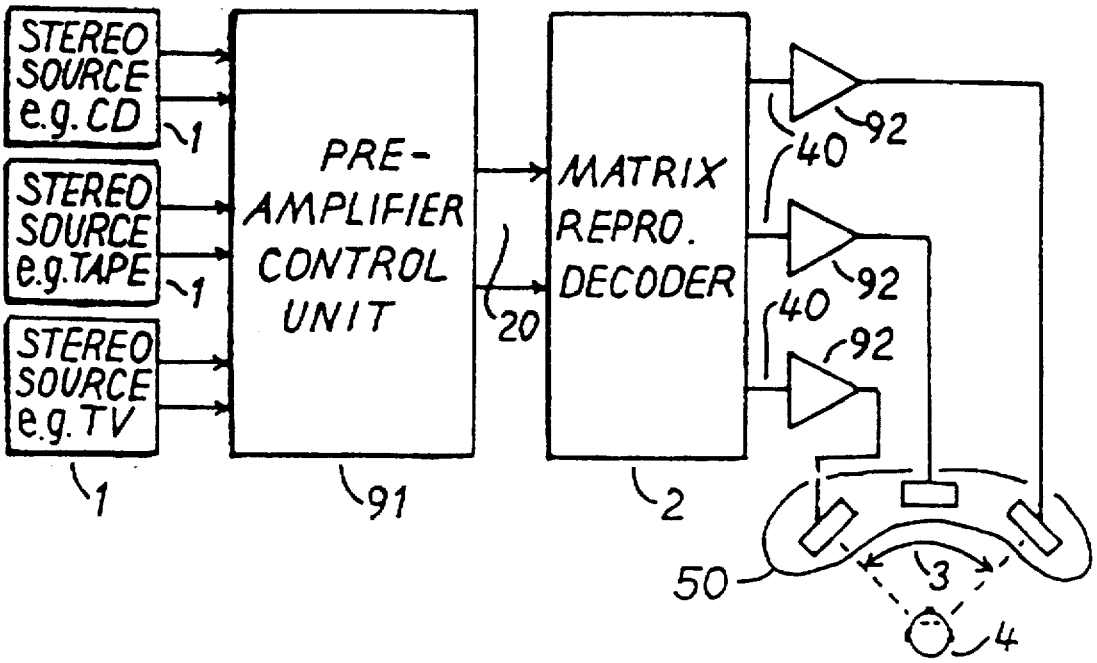
FIG. 31 is a schematic of a multispeaker stereophonic system in which a preamplifier control unit feeds a matrix decoder.

Referring to FIG. 31, another form of the invention provides a matrix decoder means apparatus (2) according to the invention responsive to signal outputs (20) of a preamplifier control means apparatus (91) and providing outputs (40) for feeding to amplification means (92) feeding a stereophonic loudspeaker arrangement (50) comprising at least three loudspeaker systems or units disposed across a sector (3) of directions in front of a preferred listening position (4).

Public Address Apparatus

The invention is also suitable for use with public address (PA) apparatus intended to provide stereophonic reproduction with improved image stability for an audience of larger size than normally encountered in domestic applications. PA apparatus may be used in cinema or film auditoria, for live amplified music, and in audiovisual and theatrical applications, among other applications.

In PA applications, it is common that clusters of loudspeakers in relatively close physical proximity be used instead of single loudspeaker systems sharing a single enclosure, in order to increase power output capability or to provide broader directional coverage of an audience area. It will be understood that such clusters constitute single "loudspeakers" as far as applications of the invention are concerned, and terms such as "loudspeaker" or "loudspeaker system" in this document may be interpreted to include such a cluster of loudspeakers. In many PA systems, different loudspeakers in a given cluster may handle different frequency ranges. Where the cluster of loudspeakers is mounted vertically on top of one another, such clusters are often termed "stacks" of loudspeakers.

Conventional stereophonic live music and theatrical PA apparatus usually uses a pair of stacks or clusters to either side of a stage or performance area, and occasionally a third central cluster is used placed over or behind the centre of the performance area. Such clusters or stacks are fed by amplification apparatus which in turn is fed with stereophonic signals derived from a stereophonic mixing desk or apparatus which allows control of the level and stereo position of a number of separate sound sources, such as prerecorded sounds, sounds from various performers or their instruments picked up by microphones or electrical means, and sounds derived from effects devices such as synthetic echo or reverberation units.

Figure 32:
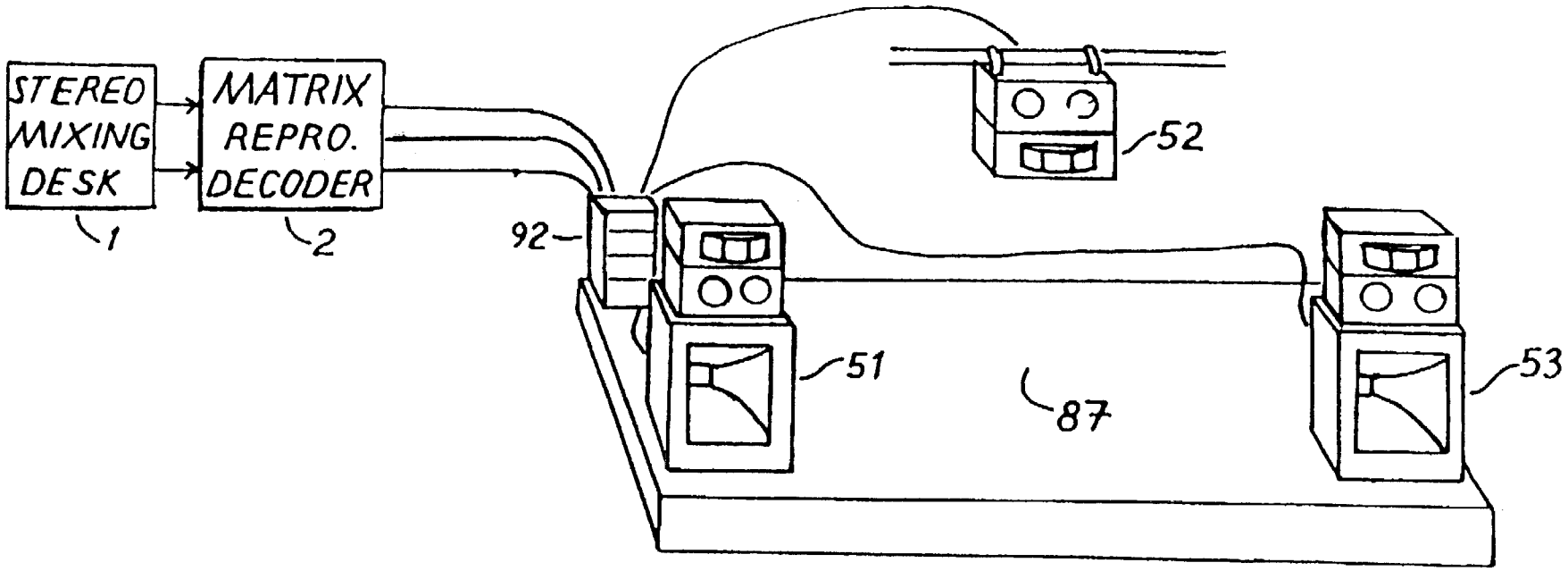
FIG. 32 shows the use of the invention in a multispeaker stereophonic public address system.

Referring by way of example to FIG. 32, such a stereophonic mixing apparatus (1) may incorporate or may feed a matrix decoding means (2) according to previous descriptions of the invention, and said matrix decoding means (2) may feed, via amplification means (92) three or more loudspeaker systems, clusters or stacks (50) in a stereophonic arrangement across, above or around the performance or visual display area (87) covering a sector of directions in front of a main audience area.

FIG. 32 illustrates an example in which two loudspeaker stacks (51) and (53) are disposed at the respective left and right sides of a performance area (87) and a central loudspeaker system or cluster (52) is suspended over the front of said performance area (87) in order to avoid visual obstruction of the performance area.

While broadly the same kind of matrix decoding apparatus (2) is used as in other applications of the invention, particular features are desirable for such PA applications. It is preferable that any input and output sockets or connection means should meet professional standards for heavy-duty use, for example by the use of XLR-type or quarter-inch (6.2 mm) jack connectors, and that adjustment means be provided to cope with typical operational problems.

For example, the matrix decoder means should preferably incorporate or be used in association with delay compensation means to compensate for the positioning in distance of central or inner loudspeaker systems or clusters. Also, in general, suspended central loudspeaker systems or clusters may have more limited bass capability than the outer stacks or clusters, since large bass units are too heavy or large for suspension without visual obstruction of the performance area.

The matrix decoder means (2) should thus preferably incorporate means of adjusting the low-frequency decoder matrix parameters so as to minimise the bass fed to such central loudspeakers, for example by putting $\phi$ or $\phi_{42}$ close to 90° at low frequencies. Preferably, the bass transition frequency at which such parameter modifications take effect should be adjustable to match different bass deficiencies. Such a matrix decoder may also provide user preset adjustment of the values of the matrix decoder parameters within one or more frequency range, so that the decoded effect may be optimised for each PA installation.

Also, a different plurality $n_2$ of loudspeaker systems or clusters may be used for each frequency range for which distinct loudspeaker types are provided, with a separate decoder provided for each plurality $n_2$ used. For example, one might have $n_2=5$ for treble loudspeaker systems, $n_2=3$ or 4 for mid-frequency loudspeaker units, and $n_2=2$ for bass loudspeaker units, using a direct feed from two channels for bass loudspeakers, a 3×2 or 4×2 decoder for the middle-frequency loudspeakers and a 5×2 decoder for the treble loudspeakers. The inputs of said separate decoders may be derived using electronic cross-over filter networks of the kind normally used to provide feed signals for PA loudspeaker units covering a partial frequency range.

In-Car Stereo

The invention provides a solution to particular problems associated with stereo systems used in vehicles, particularly cars, i.e. automobiles, and the like. In such vehicles, stereo reproduction conventionally gives a particularly poor directional illusion because of necessary limitations on the positioning both of loudspeakers and of listeners. For example, drivers are generally positioned to one side and towards the front of the listening area, and stereo loudspeakers have generally to be installed either to each side of the front of the interior of the vehicle or within the doors to either side of the front-seat area. Such arrangements are far from the ideal disposition for good stereo images.

Figure 33:
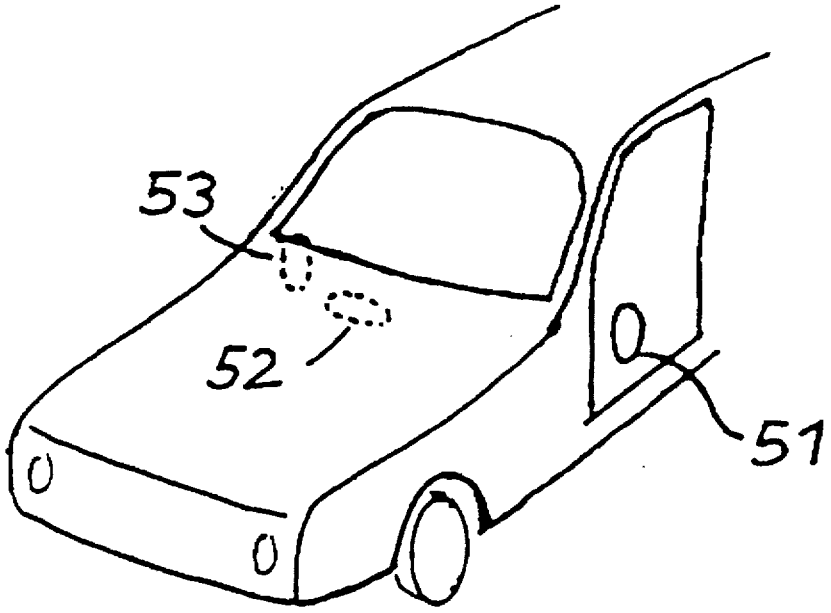
FIG. 33 shows a loudspeaker arrangement in a car for use with the invention.

The invention permits the provision of much better stereo image quality. Referring to FIG. 33, a third central loudspeaker (52) is provided supplementing the typical left and right loudspeakers (51) and (53) conventionally provided, said centre loudspeaker typically being mounted at, above or below the centre of the vehicle dashboard. Typically, the left (51) and right (53) loudspeakers may be mounted at the two sides of the dashboard or in the respective front doors of the vehicle.

It is found that when such loudspeakers are used with a 3×2 matrix decoder according to the invention, the stability of centre images is greatly improved even if the driver is very close to or within the loudspeaker arrangement, particularly if a frequency-dependent decoder is used with a larger decoder parameter $\phi$ or $\phi_{42}$ at frequencies above 5 kHz than at lower frequencies above 400 Hz.

The invention may also be used with two or three additional loudspeakers between the conventional pair, using an $n_2 \times n_1$ matrix decoder according to the invention.

Equalisation means associated with each of the loudspeaker systems may be incorporated or added to compensate both for different frequency responses of different loudspeaker systems and for typical absorption or diffraction characteristics to which the sound from each loudspeaker is subjected on its passage to the listener.

Generally, the invention may be used with any stereophonic arrangement of more than two loudspeakers disposed to the front and possibly sides of the front seating area of the vehicle, responsive to two or more stereo source signals, and delay compensation means may also be used in association with each or some of the loudspeaker feed signals for said stereophonic arrangement. A second stereophonic arrangement, disposed either to the front or the rear of a rear seating area, may also or additionally be provided according to the invention to serve listeners in said rear seating area.

Because of the proximity of listeners to the loudspeaker arrangement in an in-car system, some empirical adjustment of the decoder parameters $\phi$, $\phi_{42}$, $\phi_3$, $\phi_D$ and so on may be required for optimum results, but appropriate values are normally found to be within 15° or 25° of the previously described "preservation decoder" values.

Further Aspects

Numerous variations within the scope of the invention will be evident from the above descriptions to those skilled in the art. For example, any matrix means described may have component means rearranged, combined, split apart and recombined; gains and polarity inversions may be inserted and addition means replaced by subtraction means at different points while preserving the overall matrix means performance, and all-pass means affecting all parallel signal paths identically may be incorporated. Means responsive to signals in left/right form may be made responsive to signals in MS form by the addition or deletion, as appropriate, of MS matrix means, and conversely for means responsive to signals in MS form. Similarly, means producing signals in one of left/right or MS forms may produce signals in the other form by the addition or deletion, as appropriate, of MS matrix means. Any means satisfying known matrix equations may be replaced by any other means producing results satisfying the same matrix equations designed by methods known to those skilled in the art. In particular, any matrix means comprising two cascaded matrix means may be replaced by a single matrix means described by the matrix coefficients of the product of the matrices describing the input/output behaviour of the component matrix means.

Aspects and examples of the invention described in terms of electrical analogue signal processing means may equally well be implemented using substantially equivalent digital signal processing means and conversely in ways evident to those skilled in the art.

Where loudspeakers or loudspeaker systems are referred to, clusters of loudspeaker units or systems placed relatively close to one another so as substantially to act as a single loudspeaker may equally be used.

Where separate loudspeaker systems are used to cover different portions of the audio frequency range, different pluralities of loudspeakers may be used for reproduction of each component frequency range fed by an appropriate decoder according to the invention for that frequency range.

While the invention has been described in terms of a nominal front, left and right direction, the invention may equally be applied to stereophonic loudspeakers covering other sectors of directions, such as for example, a sector behind a listener, to one side of a listener or above or below a listener, or to a vertical sector.

The invention may also be applied to a stereophonic arrangement of loudspeakers covering a sector of directions used in conjuction with other loudspeakers in other directions, such as rear loudspeakers covering a rear sector of directions also in accordance with the invention, or fed with delayed or reverberated versions of the signals fed to the front loudspeakers. Provided that some stereophonic signals are processed in accordance with the invention to provide loudspeaker signals for a component stereophonic arrangement of a larger arrangement of loudspeakers, any additional loudspeakers or additional signals from other sources fed to the loudspeakers do not affect the scope of the invention. For example, in HDTV or cinema applications, additional "surround" signals may be transmitted and reproduced to supplement the front-stage stereo effect produced by the invention.

Transmission channel signals may be transmitted and received in either left/right or MS form; this may also include the possible use of a left/right form of transmission signals $T_{2n-1}$ and $T_{2n}$ of the form $2^{-1/2}(T_{2n-1}-T_{2n})$ and $2^{-1/2}(T_{2n-1}-T_{2n})$.

While specific implementations of the invention with left/right symmetry have been described, the invention may also be applied to reproduction using loudspeaker arrangements lacking left/right symmetry using the decoder design methods described herein.

The invention is also applicable to stereophonic arrangements of loudspeakers covering a sector of directions in front of a listener wherein different loudspeakers within the arrangement may lie at different heights or angles of elevation or declination.

Although the examples of matrix reproduction decoders according to the invention have mainly been such that they exactly preserve the total energy of signals passing through them (to within a constant of proportionality that may be dependent on frequency), a limited but not substantial degree of departure from such exact energy preservation is permissible. The permissible degree of departure that substantially retains the psychoacoustic advantages of the invention is such that, at any frequency, the gain of any two stereophonic signal components passing through a reproduction decoder according to the invention differs by not more than 3 dB, and preferably by less than 2 dB, and highly preferably by less than 1 dB, and such that, expressed in terms of the effect on direct loudspeaker feed signals, some matrix coefficients of said decoder are, across several octaves of the audio frequency range, substantially of opposite polarity to and of magnitude less than two fifths of the dominant or largest matrix coefficients.

Such small departures from exact energy preservation to within a constant of proportionality may typically be implemented by small departures from exact energy preservation of the matrix A means (33*g*) and the matrix B means (33*h*) of FIG. 19. The matrix A means and the matrix B means may be adjustable, for example for the purposes of electronic width control or other desired effects, such that, at each frequency, different signal components of the signals (28) or (29) passing through matrix A means (33*g*) or matrix B means (33*h*) to produce signals (48) or (49) have a difference in relative total energy gain of not more than 3 dB, and preferably less than 2 dB, and highly preferably less than 1 dB.

For example,the matrix A means (33*g*) may be energy preserving and the matrix B means (33*h*) may be energy preserving with an added overall gain of between −3 dB and +3 dB, or the signals (28) and (29) may be given possibly differing gains within 3 dB of one another, or the signals (48) and (49) may be given possibly differing gains within 3 dB of one another when matrix A means (33*g*) and matrix B means (33*h*) are energy preserving, providing that these gain modifications are such as to retain the substantially opposite polarity of some matrix coefficients relative to the dominant matrix coefficients of the overall matrix reproduction decoder of FIG. 19, and that said substantially opposite polarity coefficients have a magnitude of less than two-fifths of said dominant matrix coefficients. In such a case, the decoder will remain according to the invention.

It is found that much larger departures from the exact energy preserving case are such as to substantially degrade the desired subjective and psychoacoustic effects of the invention.

While above descriptions use the MS matrix convention $M_p=2^{-1/2}(L_p+R_p)$ and $S_p=2^{-1/2}(L_p-R_p)$ alternative MS matrix conventions such as $M_p=2^{-1/2}(L_p+R_p)$ and $S_p=2^{-1/2}(R_p-L_p)$ or $M_p=k(L_p+R_p)$ and $S_p=k_S(L_p-R_p)$ where k and $k_S$ are non-zero constants may be used in implementations of the invention.

The present invention can also be applied to the provision of, e.g., a 3-speaker stereo feed from an ambisonically encoded signal. Ambisonic techniques are described and claimed in patents GB2073556, GB1550627, GB1494752, GB1494751 all assigned to NRDC and in the present inventor's paper "Ambisonics in Multichannel Broadcasting and Video" pp 859–871, J. Audio Eng. soc. Vol 33 no. 11 (1985 November). This aspect is not limited to B format but may also apply to other ambisonic formats.

In the examples above with reference to FIG. 8, we described a decoder for the 2-channel stereo signals $M_2$ and $S_2$ in MS form in which signals M, S and T were derived such that $$M=M_2\cos(\phi-45°)$$

$$S=S_2$$

$$T=M_2\sin(\phi-45°) \qquad (21)$$

for a parameter $\phi$ that equals about 35.26° below 5 kHz and 54.70° above 5 kHz, where the 3 speaker feeds are given by the equations:

$$L_3=\tfrac{1}{2}M+\tfrac{1}{2}T+0.70711\,S$$

$$C_3=0.70711\,(M-T)$$

$$R_3=\tfrac{1}{2}M+\tfrac{1}{2}T-0.70711S \qquad (22)$$

The matrixing of equ. (21) is energy preserving as $\phi$ varies, and the matrixing of equ. (22) shown as (9) in FIG. 8 is orthogonal, and so also preserves total energy.

The same method can be extended to deriving optimal 3-speaker decoders for B-format signals W, X, Y with respective gains for sounds from an azimuthal angle $\theta$ measured anticlockwise from due front of 1, $2^{1/2}\cos\theta$ and $2^{1/2}\sin\theta$. If we impose a constraint that rear azimuth sounds be reproduced no louder than front azimuth sounds, then the signals M, S and T feeding the matrix (9) of equ. (22) that give the best computed localisation quality from B-format across a frontal stage of azimuths extending from −60° to +60° turn out to substantially be given by:

$$M=0.41421(W+X)$$

$$S=0.58579\,Y$$

$$T=0.41421(W-X) \qquad (23)$$

which not only has the property of having uniform energy gain as azimuth varies (since the matrix of equ. (23) is 0.58579 times an orthogonal matrix), but also of reproducing azimuth 0° sounds the same as the optimal 3×2 stereo decoder for central sounds below 5 kHz, and of reproducing azimuth ±60° sounds the same as left or right sounds are reproduced by the optimal 3×2 decoder above 5 kHz. Since the optimal 3×2 decoder was designed to handle central sounds best below 5 kHz and edge-of-stage sounds best above 5 kHz, the B-format 3-speaker decoder of equ. (23), which is frequency independent, manages to achieve both these optimum behaviours across the whole frequency range for front-stage azimuths, perhaps at the expense of rather unpleasant-sounding stereo effects for rear-azimuth sounds.

However, by introducing frequency dependence similar to that of equ. (21), it is possible to improve the subjective results of 3-speaker B-format reproduction further, by optimising central images below 5 kHz and edge of stage images above 5 kHz. Th is may be done, by subjecting the M and T signals of equ. (23) to a frequency-dependent rotation by an angle $\phi$–45°, giving modified, M, S and T signals $M_{dec}'$, $S_{dec}'$ and $T_{dec}'$ given by $$M_{dec}'=0.41421[(W+X)\cos(\phi-45°)-(W-X)\sin(\phi-45°)]$$

$$S_{dec}'=0.58579\,Y$$

$$T_{dec}'=0.41421[(W-X)\cos(\phi-45°)+(W+X)\sin(\phi-45°)], \qquad (24)$$

where, as before, typically varies from about 35° below 5 kHz to about 55° above 5 kHz; the precise variation of $\phi$ with frequency may be chosen by subjective tests on imaging quality.

The use of a frequency-dependent rotation as in FIG. 34*a* and equs. (24) will typically have the effect of giving sharper and more stable images near the centre of the stereo stage, as can be shown by computations for the matrix below 5 kHz of the values of $r_V$, $r_E$, $\theta_V$ and $\theta_E$ for different encoding azimuths $\theta$ near 0°, while giving an improved sense of stage width and sharpness of edge-of-stage images above 5 kHz. Because rotation matrices preserve energy, the resulting 3-speaker feeds retain a constant reproduced energy gain as azimuth varies.

Because sounds encoded with azimuths near 180° are reproduced with unpleasant stereo quality by the decoders of equs. (23) and (24), it is desirable to reduce the gain of such rear sounds by say 3 or 6 dB. This may be done either by attenuating the W-X signal (which somewhat degrades the quality of stereo localisation across the frontal stage), or, as illustrated in the Figure by preceding the 3-speaker decoder by a forward dominance B-format transformation to reduce the contribution of rear stage sounds, as described in equs. (25) below.

Obviously, the decoder algorithm shown in the Figure may be replaced by any frequency-dependent matrix algorithm whose matrix coefficients equal those given by the Figure.

The decoder described above for 3-speaker stereo can be generalised to an n-speaker decoder, as shown in FIG. 34*b*. In the limit, as the attenuator fades $T_{dec}$ to zero gain this becomes equivalent to the n×2 matrix converter described above. The final matrix $D_{n,3}$ is an n×3 transmission decoding matrix of the form also described above. Here signals emerging from the input matrix (equ. 23) are called $M_{dec}$, $S_{dec}$, $T_{dec}$ and signals entering the output matrix are denoted M, S, T. The matrix may be implemented by bandsplitting in a manner analoguous to FIG. 5.

The rotation matrix is implemented in a fashion analogous to that described with respect to FIG. 8 above. The matrix is shown in FIG. 34*c*. The function of the filter means 38 and all pass 38*a* and gain 38*b* is the same as in FIG. 8, and the element referenced 38 is identical to 38*e*, 38*c* is identical to 38*a* and 38*d* is identical to 38*b*. It can be shown that this is a close approximation to the ideal rotation matrix for values of phi near 45°, e.g. 35° or 55°.

As well as applying to formats with different numbers of speakers this aspect can also be used with any signals incorporating directionally encoded 360° surround sound signals that are linear combinations of an omnidirectional signal W, a signal X with gain proportional to cosine of direction and a signal Y with gain proportional to sine of direction. Furthermore, those elements may have been transformed by, e.g., a forward dominance transformation. One particular Lorentz transformation termed by the inventor the "forward dominance" transformation, and defined in detail below, has the effect of increasing front sound gain by a factor $\lambda$ while altering the rear sound gain by an inverse factor $1/\lambda$.

$$W' = \tfrac{1}{2}(\lambda + \lambda^{-1})W + 8^{-1/2}(\lambda - \lambda^{-1})X \tag{25}$$

$$X' = \tfrac{1}{2}(\lambda + \lambda^{-1})X + 2^{-1/2}(\lambda - \lambda^{-1})W$$

$$Y' = Y$$

This is a Lorentz transformation which produces transformed signal components W' X' Y' satisfying the above equation where $\lambda$ is a real parameter having any desired positive value. The transformed components still satisfy the characteristic relationships between B format signals W, X, Y, but with gains and azimuthal orientations different from those of the raw components.

It follows from the above relationship that a due-front B-format sound with W,X,Y gains of 1, $2^{1/2}$ and 0 respectively is transformed into one with a gain $\lambda$ times larger whereas a due-rear sound with original gains 1,$-2^{1/2}$ and 0 respectively is transformed into a rear sound with gain $\lambda^{-1}$ Thus this forward dominance transformation increases front sound gain by factor $\lambda$ whereas it alters rear sound gains by an inverse factor $1/\lambda$ and the relative gain of front to back sounds is altered by a factor $\lambda^2$ which allows the relative gain of reproduction of rear sounds to be modified to reduce (or increase) their relative contributions. The matrices specified in the relevant claims may be implemented by any functionally equivalent matrix or combination of matrices formed by combining or splitting the matrices set out in the claims and FIGS. 34*a* and 34*b*.

FIG. 16 shows a design process for a transmission hierarchy. In this process the last column of $D_{nn}$ can be chosen at will subject to linear independence of the other columns and this choice then determines the corresponding coefficients of the encoding matrix. Rather than using fixed values, the encoder values may vary moment by moment provided that the choice is transmitted to the decoder as a side chain signal so that decoder can perform the inverse of the encoding function at any given moment. Error noise artefacts, such as those introduced by data compression can be subjectively minimised by adaptively modifying the encoding equation to match the instantaneous distribution of signal energies among the speaker feed signals, and using an inverse equation for the decoder. A preferred strategy adjusts the coefficients so the transmission channels more nearly diagonalise the signal correlation matrix than would a fixed encoding function.

Although the process of FIG. 16 makes use of transmission channels, those channels may be used simply as an aid to the derivation of appropriate values for the converters and the channels themselves need not be present explicitly in a given implementation of the hierarchy.

The appendix below lists a cascadable hierarchy of conversion matrices between any numbers $n_1$ and $n_2$ speaker feed signals between 1 and 5 for multi-speaker stereo based on the results of encoding from $n_1$ speakers and decoding into $n_2$ speakers using the orthogonal transmission systems designed using the flow diagram of FIG. 16 with the earlier highly preferred values of $\phi'$, $\phi_3$, $\phi_D$, $\phi_4$, $\phi_5$ and the vector (a,b,c) parameters, whose transmission encoding and decoding matrices were given earlier. It will be noted that the conversion matrices from a smaller to a larger number of loudspeakers in the hierarchy listed in the appendix are preferred matrix reproduction decoders as described earlier, and that the conversion matrices from a larger number of loudspeakers to a smaller number of loudspeakers have matrices that are the matrix transposes of the matrices from the smaller to the larger number with any frequency-dependent all-pass component deleted. The following pages describe how a more general hierarchy may be constructed for conversion between formats having different numbers n of channels.

In a cascadable hierarchy transmission system constructed following the method of FIG. 16 when the input to a given conversion stage has a smaller number of channels than the output from the stage then an upconversion matrix as previously described for n-speaker stereo is used. Where a smaller number of channels are output then a downconversion matrix is used. In the special and preferred case where the transmission decoding and encoding matrices $D_{nn}$ and $E_{nn}$ in the construction of FIG. 16 are orthogonal it can be shown that the downconversion matrices are the matrix transpose of the upconversion matrices.

Generalisation to Other Systems

The above cascadable hierarchical approach to the reproduction of stereophonic sound across a sector can also be applied to more general multichannel directional sound encoding and reproduction systems. In the earlier sections of the description, the requirements for hierarchical transmission and reception systems of directional sound reproduction systems were described, and a method of constructing examples of such systems applying to stereophonic systems was given in connection with FIGS. 14 to 16.

The following describes a more general hierarchical approach applicable to systems of sound reproduction not only incorporating multispeaker stereo encoding and reproduction modes, but also various proposed surround-sound modes as well. It is convenient to describe this more general approach using mathematical notations, but the systems described earlier in this description, and other examples to be given later, are examples of this general approach.

Suppose that we have N desired modes of directional sound encoding denoted by the letters $A_i$ for i=1, 2, . . . , to N, where the system $A_i$ uses a number $n_i$ of audio channel signals, and further suppose that, for every i, j from 1 to N there is a preferred $n_j \times n_i$ conversion matrix $R_{ji}$ converting the $n_i$ audio signals encoded into the system $A_i$ into $n_j$ audio signals suitable for reproduction from the encoding system $A_j$. Call $R_{ji}$ an "upconversion" matrix, and write $A_i \leqq A_j$, if and only if $R_{ji}$ takes linearly independent signals in the system $A_i$ into linearly independent signals in the system $A_j$ (which requires that $n_i \leqq n_j$).

Then the collection of directional encoding systems $A_i$ with i=1 to N and the collection of conversion matrices $R_{ji}$ between each pair of systems is said to constitute a "cascadable hierarchy" of systems if the following mathematical conditions (1) to (5) are satisfied:

(1) For i=1 to N, $R_{ii}$ is the $n_i \times n_i$ identity matrix $I_{ii}$, i.e. conversion of a system to itself leaves signals unchanged.

(2) If i and j are such that $R_{ji}$ is an invertible matrix (which requires that $n_i=n_j$), then so is $R_{ij}$, and $R_{ij}$ is the matrix inverse of $R_{ji}$.

(3) Whenever i, j and k from 1 to N are such that $A_i \leqq A_j$ and $A_j \leqq A_k$, then the associated upconversion matrices satisfy the equation $$R_{ki}=R_{kj}R_{ji}.$$

(This is termed the "cascadability of upconversion matrices", and means that the cascade of two upconversion matrices is also an upconversion matrix).

(4) For any two systems $A_i$ and $A_j$, there exists one or more systems $A_k$ such that:

(i) $A_k \leqq A_i$ and $A_k \leqq A_j$, and (ii) whenever a system $A_h$ is such that $A_h \leqq A_i$ and $A_h \leqq A_j$, then $A_h \leqq A_k$.

(This condition says that there are "upconversions" relating any two systems via a third "smaller" system, and that there is one or more "maximum" systems of which they are both upconversions).

(5) For any three systems $A_i$, $A_j$ and $A_k$ such that whenever any system $A_h$ is such that $A_h \leqq A_i$ and $A_h \leqq A_k$, one has $A_h \leqq A_j$, then $R_{ki}=R_{kj}R_{ji}$.

This cascadability condition applies not just to upconversion matrices, but to any three systems such that the middle system is an upconversion of the "maximum" system of which the two outer systems are upconversions.

All of the conditions (1) to (5) hold for earlier described systems of upconversion and down-conversion between n-speaker stereophonic signals, but apply to other cases.

Cascadable hierarchies are desirable because not only do they allow sounds encoded for any one system $A_i$ to be converted by a matrix means $R_{ji}$ for reproduction from any other system $A_j$ in the hierarchy with satisfactory results, but also ensures that the results of repeated conversions between different systems, such as may take place in a long broadcast chain or when material intended for one systems is converted and then reconverted several times before reaching the final user, are satisfactory also, never sounding any worse than the results obtained by a single conversion down to the "maximum" system of which all the systems in the cascaded chain are upconversions, followed by a single upconversion to the final system. Noncascadable hierarchies, such as have been proposed in the prior art, lead to a continuing degradation of the reproduced directional effect as repeated conversions occur.

Thus use of a cascadable hierarchy of systems means that any user can convert a directionally encoded sound, no matter what its history and origins earlier in the sound chain, into any other directional sound encoding mode in the hierarchy, knowing that the results will not degrade excessively by doing so.

While the desirability of having a cascadable hierarchy is evident, it has not in the prior art been obvious how to design it. In general, one only knows the upconversion matrices that substantially preserve the originally intended directional effect via a more elaborate encoding system, satisfying the requirements (1) to (4) above. As in the stereophonic case described earlier, it is possible to design a cascadable hierarchy of directionally encoded systems starting only from a knowledge of the upconversion matrices, by methods generalising those described in connection with FIGS. 14 to 16.

The design method is based on encoding, for every i from 1 to n, the $n_i$ encoding system signals $A_i$ into a collection $Z_i$ of $n_i$ transmission signals via an invertible $n_i \times n_i$ transmission encoding matrix (7) $E_{ii}$, and decoding from the $n_i$ transmission signals (60) in $Z_i$ the $n_i$ encoding system signals $A_i$ via the inverse $n_i \times n_i$ transmission decoding matrix $D_{ii}$ (9), such that $E_{ii}=D_{ii}^{-1}$, as shown in FIG. X1.

Such transmission signals are required to be related to each other for different i and j as shown in FIG. X2, where for $A_i \leqq A_j$ with upconversion matrix $P_{ji}$, the matrix mapping $I_{ji}$ from the $n_i$ transmission signals $Z_i$ to the $n_j$ transmission signals $Z_j$ such that $$E_{jj}R_{ji}=I_{ji}E_{ii}$$

has the form of taking the $n_i$ individual transmission signals in $Z_i$ to $n_i$ of the $n_j$ transmission channel signals in $Z_j$. This is an extension of the idea expressed in connection with FIGS. 14 and 15 that the transmission channels of simpler systems form a subset of those for more elaborate systems.

Using $D_{ii}=E_{ii}^{-1}$, it then follows that $$R_{ji}D_{ii}=D_{jj}I_{ji},$$

from which it follows that the $n_i$ columns of the transmission decoding matrix $D_{jj}$ corresponding to transmission signals present in $Z_i$ has the form of the $n_j \times n_i$ matrix $R_{ji}D_{ii}$. The remaining $n_j-n_i$ columns of $D_{jj}$ must be linearly independent of each other and of the columns of $R_{ji}D_{ii}$ in order that $D_{jj}$ be invertible.

Thus, by analogy with the stereophonic hierarchy flow diagram of FIG. 16, the transmission decoding matrix $D_{jj}$ for a system $A_j$ should chosen such that for all systems $A_i \leqq A_j$, the $n_i$ columns of $D_{jj}$ corresponding to those transmission channels in $Z_i$ which are also transmission channels in $Z_j$ must be chosen to be equal to the $n_j \times n_i$ matrix $R_{ji}D_{ii}$, and the remaining columns chosen to be linearly independent of each other and of the other $n_i$ columns. If this is done, and if the encoding matrices $E_{ii}$ are set equal to $D_{ii}^{-1}$, then the resulting transmission system is such that if one codes any system $A_i$ via $E_{ii}$, and then uses a matrix $I_{ji}$ that takes any transmission channel in $Z_i$ also in $Z_j$ to itself and any transmission channel in $Z_i$ not in $Z_j$ into zero, the the conversion matrix $$R_{ji}=D_{jj}I_{ji}E_{ii}$$

from the system $A_i$ to the system $A_j$ is such that all $A_j$'s equipped with all such conversion matrices $R_{ji}$ can be shown to form a cascadable hierarchy.

Thus, in strict analogy with the construction of FIG. 16, a system of encoding and decoding into transmission channels satisfying $E_{jj}R_{ji}=I_{ji}E_{ii}$, or equivalently satisfying the above conditions for the columns of $D_{jj}$, for just the upconversion matrices $R_{ji}$ automatically results in the conversion matrices formed by encoding $A_i$, retaining only transmission channels lying in $Z_k$ and decoding into $A_k$ automatically define a cascadable hierarchy of directional sound encoding systems $A_i$ with conversion matrices $R_{ki}$.

Thus, whether or not the transmission signals in the collections $Z_i$ are actually used or not, such signals can be used to construct from the upconversion matrices $R_{ji}$ for $A_i \leqq A_j$ satisfying the above condition on the columns of $D_{jj}$ a cascadable hierarchy.

As already mentioned, the construction associated with FIG. 16 provided such a cascadable hierarchy in the special case of frontal stage stereo signals, where $A_i$ may be the signals intended to feed i-speaker stereo speakers.

However, other kinds of sound reproduction system may be added to the above frontal stage stereo hierarchies to form a more flexible cascadable hierarchy also allowing various forms of surround-sound and ambisonic sound reproduction, while allowing flexible conversion between all reproduction or directional encoding modes.

This is now illustrated by an example using five transmission channels denoted $M_T$, $S_T$, $T_T$, $B_T$ and $F_T$, described with reference to FIG. X3.

Consider the following directional encoding modes:

mono conveying a signal $C_1$ 2-speaker stereo conveying signals $L_2$ and $R_2$ 3-speaker stereo conveying signals $L_3$, $C_3$ and $R_3$, all as described earlier for a frontal stage, and in addition, 2:1 stereo conveying a frontal stage 2-channel stereo signal $L_{2F}$ and $R_{2F}$ and a rear-stage mono signal $C_{1B}$=B 3:1 stereo conveying frontal stage 3-channel stereo signals $L_{3F}$, $C_{3F}$ and $R_{3F}$ and a rear stage mono signal $C_{1B}$=B.

3:2 stereo conveying frontal stage 3-channel stereo signals $L_{3F}$, $C_{3F}$, $R_{3F}$ and rear stage 2-channel stereo signals $L_{2B}$ and $R_{2B}$.

These systems of encoding front and rear stage stereo directionality have been widely proposed for use with HDTV and cinema sound.

B-format ambisonic coding conveying three signals W, X and Y conveying 360° horizontal azimuthal sounds, encoding sounds from an azimuthal directional angle $\phi$with respective gains 1, $2^{1/2}\cos\phi$ and $2^{1/2}\sin\phi$.

BEF-format enhanced ambisonic coding conveying five signals W, X, Y, E, F conveying 360° horizontal azimuthal sounds, encoding sounds from an azimuthal directional angle $\phi$ with respective gains:

W: 1

X: $2^{1/2}\cos\phi$

Y: $2^{1/2}\sin\phi$

E: $k_E[1-k_G(1-\cos\phi)]$ for $|\phi|\leqq\phi_S$ 0 for $|\phi|>\phi_S$,

F: $2^{1/2}k_F\sin\phi$ for $|\phi|\leqq\phi_S$ $-2^{1/2}k_B\sin\phi$ for $|180°-\phi|\leqq\phi_B$ 0 otherwise, where $\phi_S$ is a predetermined frontal encoding stage half width typically between 60° and 70°, $\phi_B$ is a predetermined rear encoding stage half width typically between 60° and 70°, $k_G$ is a fixed gain chosen from a range of values between 3 and 3½ (a preferred value is 3.25), and the gains $k_E$, $k_F$ and $k_B$ may be chosen by the user to be greater than or equal to zero, and less than or equal to one, such that typically $k_E$ may equal one for azimuth 0° sounds and typically $k_B$ and $k_F$ may have roughly equal values around one half.

BE-format ambisonic, which uses the four signals W, X, Y, E defined above for BEF-format.

BF-format ambisonic which uses the four signals W, X, Y, F defined above for BEF-format.

The BEF-format signals provide additional information permitting sound reproduction with improved frontal-stage image stability and improved front/rear stage separation as compared to reproduction from B-format. The BE-format signals provide only improved frontal image stability, and the BF-format signals provide only improved front/rear stage separation.

For the purposes of a description related to the above description of cascadable hierarchies and associated transmission systems, we may label the above ten directional encoding systems $A_1$ to $A_{10}$ respectively for mono ($A_1$), 2-speaker stereo ($A_2$), 3-speaker stereo ($A_3$), 2:1 stereo ($A_4$), 3:1 stereo ($A_5$), 3:2 stereo ($A_6$), B-format ($A_7$), BE-format ($A_8$), BF-format ($A_9$) and BEF-format ($A_{10}$).

We have found that a cascadable hierarchy may be formed from the ten directional encoding systems just described using five transmission channels $M_T$, $S_T$, $T_T$, $B_T$, $F_T$ giving satisfactory subjective results when one encoding is reproduced via reproduction from any other, when a transmission system using encoding matrices $E_{ii}$ with matrix coefficients similar to those indicated below is constructed:

mono $E_{11}$ $$M_T = C_1$$

2-speaker stereo $E_{22}$ $$\begin{pmatrix} M_T \\ S_T \end{pmatrix} = \begin{pmatrix} 0.7071 & 0.7071 \\ 0.7071 & -0.7071 \end{pmatrix} \begin{pmatrix} L_2 \\ R_2 \end{pmatrix}$$

3-speaker stereo $E_{33}$ $$\begin{pmatrix} M_T \\ S_T \\ T_T \end{pmatrix} = \begin{pmatrix} 0.5000 & 0.7071 & 0.5000 \\ 0.7071 & 0.0000 & -0.7071 \\ 0.5000 & -0.7071 & 0.5000 \end{pmatrix} \begin{pmatrix} L_3 \\ C_3 \\ R_3 \end{pmatrix}$$

2:1 stereo $E_{44}$ $$\begin{pmatrix} M_T \\ S_T \\ B_T \end{pmatrix} = \begin{pmatrix} 0.7071 & 0.7071 & 0.6396 \\ 0.7071 & -0.7071 & 0.0000 \\ 0.0000 & 0.0000 & 0.9360 \end{pmatrix} \begin{pmatrix} L_{2F} \\ R_{2F} \\ B \end{pmatrix}$$

B-format ambisonic $E_{77}$ $$\begin{pmatrix} M_T \\ S_T \\ B_T \end{pmatrix} = \begin{pmatrix} 0.7500 & 0.1768 & 0.0000 \\ 0.0000 & 0.0000 & 0.6638 \\ 0.4500 & -0.3889 & 0.0000 \end{pmatrix} \begin{pmatrix} W \\ X \\ Y \end{pmatrix}$$

3:1 stereo $E_{55}$ $$\begin{pmatrix} M_T \\ S_T \\ B_T \\ T_T \end{pmatrix} = \begin{pmatrix} 0.5000 & 0.7071 & 0.5000 & 0.6396 \\ 0.7071 & 0.0000 & -0.7071 & 0.0000 \\ 0.0000 & 0.0000 & 0.0000 & 0.9360 \\ 0.5000 & -0.7071 & 0.5000 & 0.0000 \end{pmatrix} \begin{pmatrix} L_{3F} \\ C_{3F} \\ R_{3F} \\ B \end{pmatrix}$$

3:2 stereo $E_{66}$ $$\begin{pmatrix} M_T \\ S_T \\ B_T \\ T_T \\ F_T \end{pmatrix} = \begin{pmatrix} 0.5000 & 0.7071 & 0.5000 & 0.4523 & 0.4523 \\ 0.7071 & 0.0000 & -0.7071 & 0.7071 & -0.7071 \\ 0.0000 & 0.0000 & 0.0000 & 0.6619 & 0.6619 \\ 0.5000 & -0.7071 & 0.5000 & 0.0000 & 0.0000 \\ 0.7071 & 0.0000 & -0.7071 & -0.8839 & 0.8839 \end{pmatrix} \begin{pmatrix} L_{3F}' \\ C_{3F}' \\ R_{3F}' \\ L_{2B} \\ R_{2B} \end{pmatrix}$$

BEF-format ambisonics $E_{1010}$ $$\begin{pmatrix} M_T \\ S_T \\ B_T \\ T_T \\ F_T \end{pmatrix} =$$

-continued $$\begin{pmatrix} 0.7500 & 0.1768 & 0.0000 & 0.0000 & 0.0000 \\ 0.0000 & 0.0000 & 0.6638 & 0.0000 & 0.0000 \\ 0.4500 & -0.3889 & 0.0000 & 0.0000 & 0.0000 \\ 0.0000 & 0.0000 & 0.0000 & -1.0000 & 0.0000 \\ 0.0000 & 0.0000 & 0.0000 & 0.0000 & 0.6638 \end{pmatrix} \begin{pmatrix} W \\ X \\ Y \\ E \\ F \end{pmatrix}$$

*BE*-format ambisonics $E_{88}$ $$\begin{pmatrix} M_T \\ S_T \\ B_T \\ T_T \end{pmatrix} = \begin{pmatrix} 0.7500 & 0.1768 & 0.0000 & 0.0000 \\ 0.0000 & 0.0000 & 0.6638 & 0.0000 \\ 0.4500 & -0.3889 & 0.0000 & 0.0000 \\ 0.0000 & 0.0000 & 0.0000 & -1.0000 \end{pmatrix} \begin{pmatrix} W \\ X \\ Y \\ E \end{pmatrix}$$

*BF*-format ambisonics $E_{99}$ $$\begin{pmatrix} M_T \\ S_T \\ B_T \\ F_T \end{pmatrix} = \begin{pmatrix} 0.7500 & 0.1768 & 0.0000 & 0.0000 \\ 0.0000 & 0.0000 & 0.6638 & 0.0000 \\ 0.4500 & -0.3889 & 0.0000 & 0.0000 \\ 0.0000 & 0.0000 & 0.0000 & 0.6638 \end{pmatrix} \begin{pmatrix} W \\ X \\ Y \\ F \end{pmatrix}$$

It will be noted that for i=1 to 3, $E_{ii}$ are as given earlier as the preferred encoding matrices for the 3-speaker stereo hierarchy described in connection with FIGS. 6 and 7. Also note that the frontal stereo stage signals for 2:1, 3:1 and 3:2 stereo are also encoded into the $M_T$, $S_T$ and $T_T$ transmission channels in the same way as frontal-only stereo signals, but that rear-stage stereo signals are encoded into these three transmission channels at a reduced gain, because it has been found that frontal stereo reproduction of "surround sound" material sounds best if the rear stage sounds are reproduced around 3 to 6 dB down.

The $B_T$ transmission channel is intended to convey predominantly rear stage material, and $F_T$ corresponds to the difference signal across a frontal stage minus a difference signal across a rear stage. These transmission signals involving rear stage sounds did not exist in the frontal stage stereo hierarchy described in connection with FIG. 16.

The decoding matrices $D_{ii}$ of this transmission hierarchy are simply given by the matrix inverse $E_{ii}^{-1}$ of $E_{ii}$, which may be computed from the above matrices using any matrix inverse program on a computer or calculator.

The conversion matrices $R_{ji}$ from $A_i$ to $A_j$ for the above ten systems may then be computed by encoding the signals of $A_i$ into transmission signals via $E_{ii}$ given above, putting all transmission signals not used either by $A_i$ or $A_j$ equal to zero, and then decoding these transmission signals into $A_j$ via $D_{jj}=E_{jj}^{-1}$. The resulting conversion matrices on the ten systems create a cascadable hierarchy satisfying conditions (1) to (5) earlier, in which $R_{ji}$ is an upconversion matrix whenever the transmission signals of $A_i$ are also transmission signals for $A_j$, which can be determined by inspection of FIG. X3.

Moreover, the conversion matrices $R_{ij}$ thus obtained, which give satisfactory reproduction of signals intended or converted for system $A_i$ via reproduction for system $A_j$, may be used directly for conversion between different directional encoding modes, for example in a sound reproducer arranged for reproduction for one mode when receiving signals intended for another. Such direct conversion can also be used in a professional or studio environment for conversion of available programme sources in one mode for recording, reproduction or subsequent transmission in another, without fear of the possibility of excessive degradation of directional quality due to possible previous conversions.

Alternatively, such conversion can be achieved by using intermediate transmission channel signals via encoding and decoding matrices, which may be, but need not be, of the form of the signals $M_T$, $S_T$, $T_T$, $B_T$ and $F_T$ described above. For example, the transmission signals may be encoded with an additional nonzero gain, and decoded with the inverse of said gain, said gain possibly being different for each transmission signal, or desired independent linear combinations of $M_T$, $S_T$, $B_T$, $T_T$ and $F_T$ may be used as intermediate transmission signals.

It will be appreciated that further directional sound encoding systems may be added to the above cascadable hierarchy if desired. For example, 4- and 5-speaker frontal stage stereo systems $A_{11}$ and $A_{12}$ may be added, encoded using additional transmission signals $T_{4T}$ and $T_{5T}$ as described in earlier sections of the description in connection with FIGS. 14 to 16, and these signals may also incorporate the frontal stage transmission signals for 4:1, 4:2, 5:1 and 5:2 stereo systems with identical matrix coefficients. Alternatively or in addition, a 2:2 stereo system, using two front stage stereo signals $L_{2F}$ and $R_{2F}$ and two rear stage stereo signals $L_{2B}$ and $R_{2B}$ may be added as a system $A_{13}$, using the encoding matrix equations 2:2 stereo $E_{1313}$ $$\begin{pmatrix} M_T \\ S_T \\ B_T \\ F_T \end{pmatrix} = \begin{pmatrix} 0.7071 & 0.7071 & 0.4523 & 0.4523 \\ 0.7071 & -0.7071 & 0.7071 & -0.7071 \\ 0.0000 & 0.0000 & 0.6619 & 0.6619 \\ 0.7071 & -0.7071 & -0.8839 & 0.8839 \end{pmatrix} \begin{pmatrix} L_{2F}' \\ R_{2F}' \\ L_{2B} \\ R_{2B} \end{pmatrix}$$

The cascadable hierarchy may be extended to these systems as before by constructing $D_{ii}=E_{ii}^{-1}$ and $R_{ji}$ by encoding via $E_{ii}$ and decoding via $D_{jj}$.

It will also be appreciated that the construction of a useful and subjectively acceptable hierarchy involving these directional encoding systems is not confined to the precise values of the coefficients in the above encoding matrices $E_{ii}$, but that small changes in coefficients may be acceptable or preferred. Changes maintaining left/right symmetry which alter the gains of transmission channels, and/or which modify the gain with which rear sounds are incorporated into $M_T$ and $S_T$, and/or which modify the coefficients by a small amount which may be under 0.05, 0.1 or 0.2 may still give a cascadable hierarchy the subjective effects of whose conversion matrices $R_{ji}$ is still acceptable.

While the ambisonic directional encoding systems $A_i$ with i=7 to 10 above have been used for convenience of description, it will be appreciated that signals comprising linearly independent combinations of the signals W, X, Y, E, and F may equally be used as a directional coding system $A_i$, and that the encoding matrix will then be modified to $$(E_{ii})_{new}=(E_{ii})_{old}C_{ii},$$

where the matrix $C_{ii}$ is that matrix that converts the new linear combinations of BEF format signals into BEF-format (or B-format or BE-format or BF-format, depending on whether i=10 or 7 or 8 or 9), and where $(E_{ii})_{old\ d}$ is the encoding matrix given above and $(E_{ii})_{new}$ is the encoding matrix used with the modified $A_i$.

A specific modification of BEF-format and BF-format that is often desirable in professional applications is now described. Define depleted BEF-format to consist of the signals $$W' = W - E$$

$$X' = X - 2^{1/2}E$$

$$Y$$

$$E$$

$$F$$

where W, X, Y, E and F are as defined for BEF-format.

Depleted BEF-format has operational advantages as compared to BEF-format for professional signal handling applications, arising from the fact that, for the value one of the gain $k_E$ in E, the depleted signals W' and X' equal zero for front-centre sounds with $\phi=0°$. Thus a sound intended for sharp front centre localisation may be mixed in just with the E signal of depleted BEF-format, all other signals of depleted BEF-format being equal to zero at that sound position.

Depleted BE-format is similarly described as comprising the four signals W', X', Y and E from depleted BEF-format.

In recording or mixing applications, it may be desired to position monophonically recorded sounds to an azimuth $\phi$ in BE-, BF-, BEF-, depleted BE- or depleted BEF-format, and this may be done by subjecting the monophonic signal to an arrangement of four or five gains respectively equal to: 1 for W, $2^{1/2}\cos\phi$ for X, $2^{1/2}\sin\phi$ for Y, and to the values:

$K_E(1-k_G(1-\cos\phi))$ for $|\phi|\leqq\phi_S$ and 0 for $|\phi|>\phi_S$ for the signal E, $2^{1/2}k_F \sin\phi$ for $|\phi|\leqq\phi_X$ and $-2^{1/2}k_B \sin\phi$ for $|180°-\phi|\leqq\phi_B$ and 0 for other $\phi$ for the signal F, $1-k_E[1-k_G(1-\cos\phi)]$ for $|\phi|\leqq\phi_S$ and 1 for $|\phi|>\phi_S$ for the signal $W'$, and $2^{1/2}[\cos\phi-k_E(1-k_G(1-\cos\phi)]$ for $|\phi|\leqq\phi_S$ and $2^{1/2}\cos\phi$ for $|\phi|>\phi_S$ for $X'$, where the half-stage widths $\phi_S$ and $\phi_B$ and $k_G$ are as before and where $k_E$, $k_F$ and $k_B$ are optionally adjustable positive user gains$\leqq$1.

Such an arrangement of gains, with the value of $\phi$ operated by a user-adjustable control means, constitutes a "panpot" or positioning device for these ambisonic formats. It is also possible to create BE-, BEF- BF-, depleted BE- and depleted BEF-format signals from B-format ambisonic signals $W_0$, $X_0$ and $Y_0$ containing significant signals only across a limited sound stage by matrixing. For example, if sounds in B-format signals $W_F$, $X_F$ and $Y_F$ are confined to azimuths $\phi$ with $|\phi|>\phi_S$, then the signals $W=W_F$, $X=X_F$, $Y=Y_F$, $E=k_E(W_F-k_G(W_F-2^{-1/2}X_F))$, $F=k_FY_F$, $W'=W_F-k_E(W_F-k_G(W_F-2^{-1/2}X_F))$, $X'=X_F-2^{1/2}k_E(W_F-k_G(W_F-2^{-1/2}X_F))$ are encoded as signals for the 4- and 5-channel ambisonic formats, and for sounds in B-format signals confined to azimuths $\phi$ with $|180°-\phi|\leqq\phi_B$, $W=W_B$, $X=X_B$, $Y=Y_B$, $E=0$, $F=-k_BY_B$, $W'=W_B$, $X'=X_B$, where the B-format signals confined to the rear stage are $W_B$, $X_B$ and $Y_B$.

It will be understood in the above descriptions of panpot means and matrixing means to produce BE-, BF-, BEF-, depleted BE- and depleted BEF-formats, that any output signals may be subjected to predetermined nonzero gains, including possibly polarity inversion, so as to achieve output signals having levels and/or polarities suitable for use with available signal channels or recording or transmission channels.

Some of the prior art surround sound systems for directional encoding of 360° azimuthal sound, including all systems in the prior art UMX hierarchy and the B-format encoding, have mathematical rotational symmetry in the sense that, for every angle of rotation of the whole 360° sound stage, there exists a corresponding n×n matrix on the n channel signals of the directional encoding such that the application of this matrix to the original encoded signals produces signals encoded for the same encoding system, but with all encoded sound source positions rotated by said angle of rotation within the 360° stage.

Designing hierarchical systems for conversion between such encoding systems with mathematical rotational symmetry has been known in the prior art, for example in connection with the UMX hierarchy, but hitherto, there has been no known method in the prior art of designing cascadable hierarchies in which some of the directional encoding systems, especially those using three or more channels, lack rotational symmetry. While B-format has mathematical rotational symmetry, none of the other systems in the cascadable hierarchy described in connection with FIG. 37 has mathematical rotational symmetry.

AN ORTHOGONAL CONVERSION HIERARCHY

The following upconversion matrices are subjectively exceptionally good performers, giving substantially optimal preservation of the originally intended stereo effect via a larger number of speakers.

3×2 upconversion matrix $R_{32}$

This case involves, for best subjective results, the use of a frequency-dependent conversion matrix as follows:

$$\begin{pmatrix} L_3 \\ C_3 \\ R_3 \end{pmatrix} = \begin{pmatrix} 0.8536+0.0607A & -0.1464+0.0607A \\ 0.5000-0.0858A & 0.5000-0.0858A \\ -0.1464+0.0607A & 0.8536+0.0607A \end{pmatrix} \begin{pmatrix} L_2 \\ R_2 \end{pmatrix}$$

where A is an all-pass network gain having gain −1 below 5 kHz and +1 above 5 kHz. Putting A=0 gives a reasonable frequency-independent upconversion matrix, although not as good as the frequency-dependent case.

4×3 upconversion matrix $R_{43}$ $$\begin{pmatrix} L_4 \\ L_5 \\ R_5 \\ R_4 \end{pmatrix} = \begin{pmatrix} 0.9303 & -0.1297 & 0.0527 \\ 0.3314 & 0.6951 & -0.1479 \\ -0.1479 & 0.6951 & 0.3314 \\ 0.0527 & -0.1297 & 0.9303 \end{pmatrix} \begin{pmatrix} L_3 \\ C_3 \\ R_3 \end{pmatrix}$$

5×4 upconversion matrix $R_{54}$ $$\begin{pmatrix} L_6 \\ L_7 \\ C_5 \\ R_7 \\ R_6 \end{pmatrix} = \begin{pmatrix} 0.9535 & -0.1084 & 0.0590 & -0.0324 \\ 0.2533 & 0.7870 & -0.1989 & 0.0859 \\ -0.1349 & 0.5708 & 0.5708 & -0.1349 \\ 0.0859 & -0.1989 & 0.7870 & 0.2533 \\ -0.0324 & 0.0590 & -0.1084 & 0.9535 \end{pmatrix} \begin{pmatrix} L_4 \\ L_5 \\ R_5 \\ R_4 \end{pmatrix}$$

Other upconversion matrices

Other upconversion matrices are preferably formed by cascading the above three matrices. This yields the following "composite" upconversion matrices.

4×2 upconversion matrix $R_{42}$ $$\begin{pmatrix} L_4 \\ L_5 \\ R_5 \\ R_4 \end{pmatrix} = \begin{pmatrix} 0.7215 + 0.0708A & -0.1561 + 0.0708A \\ 0.6521 - 0.0485A & 0.1728 - 0.0485A \\ 0.1728 - 0.0485A & 0.6521 - 0.0485A \\ -0.1561 + 0.0708A & 0.7215 + 0.0708A \end{pmatrix} \begin{pmatrix} L_2 \\ R_2 \end{pmatrix}$$

where as before, A is preferably an all-pass with gain −1 below 5 kHz and gain +1 above 5 kHz, or where A=0 in the frequency independent case.

5×2 upconversion matrix $R_{52}$ $$\begin{pmatrix} L_6 \\ L_7 \\ C_5 \\ R_7 \\ R_6 \end{pmatrix} = \begin{pmatrix} 0.6325 + 0.0676A & -0.1525 + 0.0676A \\ 0.6482 - 0.0045A & 0.0287 - 0.0045A \\ 0.3945 - 0.0745A & 0.3945 - 0.0745A \\ 0.0287 - 0.0045A & 0.6482 - 0.0045A \\ -0.1525 + 0.0676A & 0.6325 + 0.0676A \end{pmatrix} \begin{pmatrix} L_2 \\ R_2 \end{pmatrix}$$

where as before A is an all-pass with gain −1 below 5 kHz and gain +1 above 5 kHz, or where A=0 in the frequency-independent case.

5×3 upconversion matrix $R_{53}$ $$\begin{pmatrix} L_6 \\ L_7 \\ C_5 \\ R_7 \\ R_6 \end{pmatrix} = \begin{pmatrix} 0.8407 & -0.1538 & 0.0557 \\ 0.5304 & 0.3648 & -0.0891 \\ -0.0279 & 0.8285 & -0.0279 \\ -0.0891 & 0.3648 & 0.5304 \\ 0.0557 & -0.1538 & 0.8407 \end{pmatrix} \begin{pmatrix} L_3 \\ C_3 \\ R_3 \end{pmatrix}$$

Downconversion matrices

The downconversion matrices for this case are obtained by putting A=0 in the above and taking the matrix transpose (i.e. turning rows into columns and vice-versa). We warn that this "transpose property" is special to the orthogonal hierarchy case, and does not generalise. Thus we get the following downconversion matrices.

2×3 downconversion matrix $R_{23}$ $$\begin{pmatrix} L_2 \\ R_2 \end{pmatrix} = \begin{pmatrix} 0.8536 & 0.5000 & -0.1464 \\ -0.1464 & 0.5000 & 0.8536 \end{pmatrix} \begin{pmatrix} L_3 \\ C_3 \\ R_3 \end{pmatrix}$$

3×4 downconversion matrix $R_{34}$ $$\begin{pmatrix} L_3 \\ C_3 \\ R_3 \end{pmatrix} = \begin{pmatrix} 0.9303 & 0.3314 & -0.1479 & 0.0527 \\ -0.1297 & 0.6951 & 0.6951 & -0.1297 \\ 0.0527 & -0.1479 & 0.3314 & 0.9303 \end{pmatrix} \begin{pmatrix} L_4 \\ L_5 \\ R_5 \\ R_4 \end{pmatrix}$$

4×5 downconversion matrix $P_{45}$ $$\begin{pmatrix} L_4 \\ L_5 \\ R_5 \\ R_4 \end{pmatrix} = \begin{pmatrix} 0.9535 & 0.2533 & -0.1340 & 0.0859 & -0.0324 \\ -0.1084 & 0.7870 & 0.5708 & -0.1989 & 0.0590 \\ 0.0590 & -0.1989 & 0.5708 & 0.7870 & -0.1084 \\ -0.0324 & 0.0859 & -0.1349 & 0.2533 & 0.9535 \end{pmatrix} \begin{pmatrix} L_6 \\ L_7 \\ C_5 \\ R_7 \\ R_6 \end{pmatrix}$$

2×4 downconversion matrix $R_{24}$ $$\begin{pmatrix} L_2 \\ R_2 \end{pmatrix} = \begin{pmatrix} 0.7215 & 0.6521 & 0.1728 & -0.1561 \\ -0.1561 & 0.1728 & 0.6521 & 0.7215 \end{pmatrix} \begin{pmatrix} L_4 \\ L_5 \\ R_5 \\ R_4 \end{pmatrix}$$

2×5 downconversion matrix $R_{25}$ $$\begin{pmatrix} L_2 \\ R_2 \end{pmatrix} = \begin{pmatrix} 0.6325 & 0.6482 & 0.3945 & 0.0287 & -0.1525 \\ -0.1525 & 0.0287 & 0.3945 & 0.6482 & 0.6325 \end{pmatrix} \begin{pmatrix} L_6 \\ L_7 \\ C_5 \\ R_7 \\ R_6 \end{pmatrix}$$

3×5 downconversion matrix $R_{35}$ $$\begin{pmatrix} L_3 \\ C_3 \\ R_3 \end{pmatrix} = \begin{pmatrix} 0.8407 & 0.5304 & -0.0279 & -0.0891 & 0.0557 \\ -0.1538 & 0.3648 & 0.8285 & 0.3648 & -0.1538 \\ 0.0557 & -0.0891 & -0.0279 & 0.5304 & 0.8407 \end{pmatrix} \begin{pmatrix} L_6 \\ L_7 \\ C_5 \\ R_7 \\ R_6 \end{pmatrix}$$

monophonic downconversion $R_{1n}$ (n=2 to 5)

$C_1$=0.7071 $L_2$+0.7071 $R_2$ $C_1$=0.5000 $L_3$+0.7071 $C_3$+0.5000 $R_3$ $C_1$=0.3998 $L_4$+0.5832 $L_5$+0.5832 $R_5$+0.3998 $R_4$ $C_1$=0.3394 $L_6$+0.4786 $L_7$+0.5579 $C_5$+0.4786 $R_7$+0.3394 $R_6$

Selected down/up-conversion matrices 3 to 2 to 3 conversion $R_{32}R_{23}$ $$\begin{pmatrix} L_3' \\ C_3' \\ R_3' \end{pmatrix} = \begin{pmatrix} 0.7500 + 0.0429A & 0.3536 + 0.0607A & -0.2500 + 0.0429A \\ 0.3536 - 0.0607A & 0.5000 - 0.0858A & 0.3536 - 0.0607A \\ -0.2500 + 0.0429A & 0.3536 + 0.0607A & 0.7500 + 0.0429A \end{pmatrix} \begin{pmatrix} L_3 \\ C_3 \\ R_3 \end{pmatrix}$$

4 to 3 to 4 conversion $R_{43}R_{34}$ $$\begin{pmatrix} L_4' \\ L_5' \\ R_5' \\ R_4' \end{pmatrix} = \begin{pmatrix} 0.8851 & 0.2103 & -0.2103 & -0.1149 \\ 0.2103 & 0.6149 & 0.3851 & -0.2103 \\ -0.2103 & 0.3851 & 0.6149 & 0.2103 \\ -0.1149 & -0.2103 & 0.2103 & 0.8851 \end{pmatrix} \begin{pmatrix} L_4 \\ L_5 \\ R_5 \\ R_4 \end{pmatrix}$$

The above conversion matrices are optimised according to the specific values of decoder parameters $\phi$, $\phi'$, $\phi_3$, $\phi_D\phi_4$, $\phi_5$, (a,b,c,). Slightly different values, associated with different speaker layouts, will give marginally different equations above, but in all cases, coefficients will differ only a little from those given here.

I claim:

1. A matrix converter $R_{n2,n1}$ for converting a first audio signal (20) stereophonically encoded for reproduction over $n_1$ speakers into a second audio signal (40) stereophonically encoded for reproduction over $n_2$ loudspeakers, when $n_1$, $n_2$ are integers $n_1>2$ and $n_2>n_1$, characterised in that the matrix converter R is an energy preserving matrix arranged substantially to preserve to within an overall constant of proportionality, the total reproduced energy and the reproduced directional effect of the encoded audio signal.

2. A matrix converter according to claim 1, said matrix converter being further such as substantially to preserve, to within a second constant of proportionality the reproduced angular disposition of velocity vectors and being further such as substantially to preserve, to within a third constant of proportionality the reproduced angular disposition of sound intensity vectors.

3. A matrix converter according to claim 2, wherein the ratio of said second constant of proportionality to said third constant of proportionality lies between one half and two.

4. A matrix converter according to claim 1, wherein the matrix coefficients expressed in terms of the matrix relationships connecting said loudspeaker feed signals represented by the first audio signals to loudspeaker feed signals represented by said second audio signals are such that across several octaves of the audio frequency range some matrix co-efficients are substantially of opposite polarity to and of magnitude less than two fifths of the dominant or largest coefficient, wherein any two stereophonic signal components intended for reproduction via said first number $n_1$ of loudspeakers are reproduced via said second number $n_2$ of loudspeakers via said matrix converter with energy gains differing by less than three decibels.

5. A matrix converter according to claim 4 wherein the said two stereophonic signal components are reproduced with energy gains differing by less than two decibels.

6. A matrix converter according to claim 5 wherein the said two stereophonic signal components are reproduced with energy gains differing by less than one decibel.

7. A matrix converter according to claim 1 in which said first and second audio signals are stereophonically encoded for speaker arrangements which are substantially left/right symmetric with respect to reflection about the notional forward direction, said matrix converter being left/right symmetric in the sense that if all left input and output signals were to be exchanged with their symmetrically disposed right counterparts, the results given by said matrix means would remain substantially unchanged.

8. A matrix converter according to claim 1, wherein the matrix is arranged so that the angular dispositions of the reproduced velocity vectors of the second audio signal is substantially equal to the angular dispositions of the reproduced sound intensity vectors in that signal at frequencies across several octaves of the audio frequency range.

9. A matrix converter according to claim 1 responsive to signals $L_3$, $C_3$ and $R_3$ intended for respective left, centre and right loudspeakers of a three-speaker stereo arrangement and producing signals $L_4$, $L_5$, $R_5$, and $R_4$ intended for reproduction via respective outer left, inner left, inner right and outer right loudspeakers of a four-speaker stereo arrangement, wherein substantially $$\begin{pmatrix} M_4 \\ M_5 \end{pmatrix} = \begin{pmatrix} \cos\phi_3 & -\sin\phi_3 \\ \sin\phi_3 & \cos\phi_3 \end{pmatrix} \begin{pmatrix} M_3 \\ C_3 \end{pmatrix}$$

and $$\begin{pmatrix} S_4 \\ S_5 \end{pmatrix} = \begin{pmatrix} \cos\phi_0 \\ \sin\phi_0 \end{pmatrix} S_3$$

to within an overall constant of gain proportionality that may vary with frequency, where $M_p=2^{-1/2}(L_p+R_p)$ and $S_p=2^{-1/2}(L_p-R_p)$ for p=3, 4 and 5, where $\phi_3$ and $\phi_D$ are predetermined angle parameters that may vary with frequency.

10. A matrix converter according to claim 1 responsive to signals $L_4$, $L_5$, $R_5$, and $R_4$ intended for reproduction via respective outer left, inner right and outer right loudspeakers of a four-speaker stereo arrangement and producing signals $L_6$, $L_7$, $C_5$, $R_7$ and $R_6$ intended for reproduction via the respective outer left, inner left, centre, inner right and outer right loudspeakers of a five-speaker stereo arrangement, wherein the converter comprises a 5×4 energy preserving matrix as described herein.

11. A matrix reproduction decoder including a matrix converter according to claim 1, the reproduction decoder including an input arranged to receive the first audio signal from a transmission or recording medium and means for outputting signals corresponding to the $n_2$ loudspeaker feed signals.

12. An audio visual system including one or more loudspeakers arranged centrally with respect to a screen and left and right loudspeakers, the system including a matrix reproduction decoder according to claim 11.

13. A portable audio system including a matrix reproduction decoder according to claim 11.

14. An audio reproduction system for installation in a vehicle incorporating a matrix reproduction decoder according to claim 11.

15. A public address system including a matrix reproduction decoder according to claim 11.

16. A transmission decoder according to claim 11 further comprising means responsive to transmitted side-chain signals conveying time-varying transmission matrix coefficients for varying the matrix coefficients of the transmission matrix decoder of the matrix converter, the coefficients being varied so as to minimise perceived noise errors in the transmitted signal.

17. A matrix reproduction decoder according to claim 11, further comprising delay compensation means for introducing delays in one or more of the said signals corresponding to feed signals so as to compensate for different distances between the different loudspeakers and a predetermined position within the listening area, thereby maintaining a desired stereophonic effect across the listening area.

18. A transmission matrix encoder according to claim 11 wherein the matrix coefficients of said matrix converter form a substantially orthogonal, unitary or energy preserving matrix.

19. A matrix reproduction decoder according to claim 11 wherein the matrix coefficients of said matrix converted form a matrix that is substantially orthogonal, unitary, energy-preserving or the Hermitian matrix adjoint of an energy preserving matrix.

20. An encoder or decoder according to claim 18, in which the converter departs from the performance of the ideal orthogonal, unitary, energy preserving or Hermitian adjoint matrix by no more than 3 dB preferably no more than 2 dB and more preferably no more than 1 dB.

21. A transmission matrix encoder including a matrix converter according to claim 1, the transmission encoder including an input arranged to receive the first audio signal and an output for outputting the second audio signal onto a transmission or recording medium.

22. A matrix converter $R_{n2,n1}$ according to claim 1, for converting a first audio signal stereophonically encoded for reproduction over $n_1$ speakers into a second audio signal stereophonically encoded for reproduction over $n_2$ loudspeakers, where $n_1$, $n_2$ are integers greater than 1 and $n_2<n_1$ characterized in that the matrix is the matrix transpose of the coefficients of a matrix converter $R_{n1,n2}$ for converting a first audio signal stereophonically encoded for reproduction over $n_1$ speakers into a second audio signal stereophonically encoded for reproduction over $n_2$ loudspeakers, when $n_1$ is an integer >1 and $n_2>n_1$, characterized in that the conversion matrix means is an energy preserving matrix arranged substantially to preserve to within an overall constant of proportionality the total reproduced energy and the reproduced directional effect of the encoded audio signal.

23. A matrix converter $R_{n3n1}$ according to claim 1 having coefficients determined by cascading matrix converters $R_{n2n1}$ and $R_{n3n2}$.

24. A matrix converter according to claim 1, in which the first audio signal input to the converter is a transmission signal.

25. A matrix converter of claim 1, which is a frequency dependent energy preserving matrix.

26. A matrix reproduction decoding means responsive to a first plurality of signals proportional to signals intended for reproduction via a first plurality of loudspeakers disposed in a first left/right symmetric stereophonic arrangement and providing a greater second plurality of signals proportional to signals intended for reproduction via a second plurality of loudspeakers disposed in a second left/right symmetric stereophonic arrangement said matrix decoder means comprising an input sum and difference matrix means for each pair of signals intended for a left/right symmetrically disposed pair of loudspeakers in said first arrangement, a first linear or matrix means responsive to all said sum signals and to any of said first plurality of signals proportional to a central loudspeaker feed signal for said first arrangement providing a first number not less than the number of signals into said first linear or matrix means of first output signals, a second linear or matrix means responsive to all said difference signals providing a second number not less than the number of said difference signals of output difference signals, said first number and said second number adding up to said second plurality, and output sum and difference matrix means, one associated with each left/right symmetric pair of loudspeakers in said second arrangement, each responsive to one of said first output signals and one of said output difference signals and providing signals from said second plurality of signals intended for said associated pair of loudspeakers in said second arrangement, whereby any of said second plurality of signals proportional to a central loudspeaker feed signal for said second arrangement is derived from one output of said first linear or matrix means.

27. A matrix reproduction decoding means according to claim 26, wherein said decoding means comprises a matrix converter for converting a first audio signal stereophonically encoded for reproduction over $n_1$ speakers into a second audio signal stereophonically encoded for reproduction over $n_2$ loudspeakers, when $n_1$, $n_2$ are integers >1 and $n_2>n_1$, characterized in that the matrix converter R is an energy preserving matrix arranged substantially to preserve to within an overall constant of proportionality, the total reproduced energy and the reproduced directional effect of the encoded audio signal in which said first and second audio signals are stereophonically encoded for speaker arrangements which are substantially left/right symmetric with respect to reflection about the notional forward direction, said matrix converter being left/right symmetric in the sense that if all left input and output signals were to be exchanged with their symmetrically disposed right counterparts, the results giving by said matrix means would remain substantially unchanged.

28. A conversion matrix for converting a first ambisonically encoded audio signal having components W, X and Y or linear combinations thereof into a second, stereophonically encoded signal for reproduction over $n_2$ loudspeakers, wherein $n_2$ is an integer $\leqq 3$, the conversion matrix comprising a $n_2 \times 2$ conversion matrix means for converting said first audio signal characterized in that the conversion matrix means is an energy preserving matrix arranged substantially to preserve to within an overall constant of proportionality the total reproduced energy and the reproduced directional effect of the encoded audio signal, said conversion matrix means arranged to receive at one input a first signal $M_{dec}$ formed from the sum of the omnidirectional component W and a first velocity component X and at the other input a signal $S_{dec}$ formed from the other velocity component Y and means for outputting a further signal component derived from the difference $T_{dec}$ of the said components W and X.

29. A conversion matrix according to claim 28 further comprising a rotation matrix arranged to apply a rotation by an angle ($\phi$–45°) which may be frequency dependent to the sum and difference components $M_{dec}$ and $T_{dec}$.

30. A conversion matrix according to claim 29, in which $\phi$ varies from a lower value in a range from substantially 25° to 45° below substantially 5 kHz to a higher value in a range from substantially 45° to substantially 65° above 5 kHz.

31. A conversion matrix according to claim 28 further comprising means for applying a variable attenuation to the difference component $T_{dec}$.

32. An audio transmission/reproduction system including in series a plurality of conversion matrices $R_{ji}$ for converting an input audio signal encoded for reproduction over i loudspeakers into an output audio signal encoded for reproduction over j loudspeakers, where i,j are integers and at least one of i,j is $\leqq 3$ for one or more of the conversion matrices, wherein the conversion matrices form a cascadable hierarchy in which for any two matrices $R_{n3n2}$, $R_{n2n1}$ the following conditions are satisfied:

if $n2 \leqq \min(n1,n3)$, then:

$$R_{n3n2}R_{n2n1}=R_{n3n1}$$

and if $n2 \geqq n1$ then:

$$R_{n1n2}R_{n2n1}=I_{n1n1}$$

where $I_{nn}$ is the n×n identity matrix;

and in which any conversion matrix $R_{ji}$ for which j>i is an energy preserving matrix arranged substantially to preserve to within an overall constant of proportionality the total reproduced energy of the encoded audio signal.

33. An audio transmission/reproduction system including in series a plurality of conversion matrices $R_{ji}$ for converting a first signal directionally encoded for transmission/reproduction via a first number $n_i$ of channels into a second signal directionally encoded for reproduction via a second number $n_j$ of channels in which at least one of $n_i$, $n_j$ is $\geqq 3$ and in which the matrices are elements of a cascadable hierarchy, at least one of the directionally encoded signals being for a reproduction format whose directional encoding does not have mathematical rotational symmetry.

34. A decoder for use in a frontal and rear stage stereo transmission/reproduction hierarchy including a conversion matrix formed as the inverse of a matrix including the stereo sum signal M which is formed from a forward facing combination of the directional component W and a velocity component X, the difference component S which is proportional to the side ways component Y, and the rear mono signal B which is formed from a backwards-facing combination of W and X and arranged to derive from stereo channels a B format signal for reproduction in an ambisonic or surround sound or frontal/rear stage stereo system.

35. A matrix converter $R_{n2,n1}$ for converting a first audio signal stereophonically encoded for reproduction over $n_1$ speakers into a second audio signal stereophonically encoded for reproduction over $n_2$ loudspeakers, when n=2 and $n_2$ is an integer>$n_1$, characterized in that the matrix converter R is a frequency dependent energy preserving matrix arranged substantially to preserve to within an overall constant of proportionality the total reproduced energy and the reproduced directional effect of the encoded audio signal.

36. A matrix converter according to claim 35, said matrix converter being further such as substantially to preserve, to within a second constant of proportionality, the reproduced angular disposition of velocity vectors and being further such as substantially to preserve, to within a third constant of proportionality, the reproduced angular disposition of sound intensity vectors.

37. A matrix converter according to claim 36 in which said third constant of proportionality is dependent on frequency.

38. A converter according to claim 37, in which said third constant of proportionality is arranged to be greater within an audio frequency band above 5 kHz than within the audio band at frequencies between 700 Hz and 3 kHz.

39. A matrix converter according to claim 35, in which there is provided means for modifying the reproduced width having the effect of altering the gain of that signal component representing the difference component of the first audio signal.

40. A matrix converter according to claim 35 responsive to signals $L_2$ and $R_2$ intended for respective left and right loudspeakers of a two-speaker stereophonic arrangement and producing signals $L_3$, $C_3$ and $R_3$, intended for reproduction via respective left, centre and right loudspeakers of a three-speaker stereo arrangement, wherein $$\begin{matrix} M_3 \\ C_3 \end{matrix} = \begin{matrix} \sin\phi \\ \cos\phi \end{matrix} M_2$$

and $$S_3 = wS_2,$$

to within an overall constant of gain proportionality that may vary with frequency, where $M_p=2^{1/2}(L_p+R_p)$ and $Sp=2^{1/2}(L_p-R_p)$ for p=2 and 3, where $\phi$ is a parameter that may depend on frequency between 15° and 75°, and where w is a width gain exceeding $\sin\phi$ which may also depend on frequency, wherein $\phi$ may take on values near 0° or 90° at low bass frequencies.

41. A matrix converter according to claim 35 responsive to signals $L_2$ and $R_2$ intended for respective left and right loudspeakers of a two-speaker stereo arrangement and producing signals $L_4$, $L_5$, $R_5$ and $R_4$ intended for reproduction via respective outer left, inner left, inner right and outer right loudspeakers of a four-speaker stereo arrangement, wherein substantially $$\begin{matrix} M_4 \\ C_5 \end{matrix} = \begin{matrix} \sin\phi_{42} \\ \cos\phi_{42} \end{matrix} M_2$$

and $$\begin{matrix} S_4 \\ S_5 \end{matrix} = \begin{matrix} \cos\phi_D \\ \sin\phi_D \end{matrix} wS_2$$

to within an overall constant of gain proportionality that may vary with frequency, where $M_p=2^{1/2}(L_p+R_p)$ and $Sp=2^{1/2}(L_p-R_p)$ for p=2, 4 and 5, where $\phi_{42}$, $\phi_D$ and w are parameters that may vary with frequency, where $\phi_{42}$ lies within 25° of its preservation decoder value of 39.79°=50.36°−10.57° and $\phi_D$ lies within 15° of its "preservation decoder" value of 28.64°, wherein $\phi_{42}$ and $\phi_D$ may lie between 0° and 90° at low bass frequencies.

42. A transmission matrix encoder including a matrix converter according to claim 35, the transmission encoder including an input arranged to receive the first audio signal and an output for outputting the second audio signal onto a transmission or recording medium.

43. A matrix converter according to claim 35 in which the first audio signal input to the converter is a transmission signal.

44. An audio transmission/reproduction system according to claim 35 including a plurality of conversion matrices.

* * * * *